US006042101A

United States Patent [19]

Menard et al.

[11] Patent Number: 6,042,101

[45] Date of Patent: Mar. 28, 2000

[54] AUTOMATED MEDIA TRANSPORT DEVICE AND METHOD OF USING THE SAME

[75] Inventors: Alan W. Menard, Bolton; Timothy P. MacDonald, South Windsor; John M. Davies, Willington; Mark C. Schwartz, Windsor; David P. Squires, Lebanon; Bruce L. Davidson, East Hartford, all of Conn.

[73] Assignee: Gerber Systems Corporation, South Windsor, Conn.

[21] Appl. No.: 08/868,119

[22] Filed: Jun. 3, 1997

[51] Int. Cl.[7] ..... B65H 5/00

[52] U.S. Cl. ..... 271/10.01; 271/105; 271/107

[58] Field of Search ..... 271/105, 106, 271/107, 108, 10.01

[56] References Cited

U.S. PATENT DOCUMENTS

| | | | |
|---|---|---|---|
| 3,272,568 | 9/1966 | Koorneef et al. | 308/5 |
| 3,411,075 | 11/1968 | Kahoun | 324/34 |
| 3,462,680 | 8/1969 | Kahoun et al. | 324/24 |
| 3,525,929 | 8/1970 | Mounce | 324/34 |
| 3,816,659 | 6/1974 | Landsman | 178/7.6 |
| 3,894,276 | 7/1975 | Janssen | 318/135 |
| 3,938,191 | 2/1976 | Jarmy | 360/102 |
| 4,012,676 | 3/1977 | Giebler | 318/135 |
| 4,028,732 | 6/1977 | Saltet et al. | 358/289 |
| 4,131,916 | 12/1978 | Landsman | 358/285 |
| 4,186,991 | 2/1980 | Koide et al. | 350/6.91 |
| 4,209,239 | 6/1980 | Wood et al. | 354/4 |
| 4,348,697 | 9/1982 | Takahashi et al. | 358/286 |
| 4,385,297 | 5/1983 | Schmitt et al. | 340/870.31 |
| 4,387,452 | 6/1983 | Bircot et al. | 369/32 |
| 4,402,061 | 8/1983 | Hazet al. | 365/127 |
| 4,409,624 | 10/1983 | Kingsley | 358/285 |
| 4,413,863 | 11/1983 | Lombard | 308/9 |
| 4,415,911 | 11/1983 | Tazaki | 346/140 |
| 4,432,082 | 2/1984 | Hsieh et al. | 369/32 |
| 4,432,083 | 2/1984 | Hsieh et al. | 369/44 |
| 4,435,797 | 3/1984 | Hsieh et al. | 369/32 |

(List continued on next page.)

FOREIGN PATENT DOCUMENTS

| | | |
|---|---|---|
| 30 14 409 | 10/1980 | Germany . |
| 44 11 574 | 5/1994 | Germany . |
| 2 049 300 | 12/1980 | United Kingdom . |

OTHER PUBLICATIONS

"Linear Motor Applications" by Boaz Eidelberg, Anorad Corp., Oct. 1992, 4 sheets.

"Air Bearings, Technology & Applications" by Robert Kody, Dover Instrument Corporation, Nov./Dec. 1992 3 sheets.

"Accuracy in Positioning Systems" by Kevin McCarthy, New England Affiliated Technologies, 15 sheets.

"Positioning Systems: An Overview" by Kevin McCarthy, New England Affiliated Technologies, 11 sheets.

Literature re Trilogy.

Literature re Linear Motor Applications Note, New England Affiliated Technologies, 6 sheets.

"The Amateur Scientist" by Shawn Carlson, Scientific American, Aug. 1996, pp. 96, 98–99.

*Primary Examiner*—David H. Bollinger

*Attorney, Agent, or Firm*—McCormick, Paulding & Huber LLP

[57] ABSTRACT

An automated media transport apparatus and method includes a load module for loading media plates from a flat cassette through one end of an internal drum of an imaging module. Sensors detect the presence of interleaved paper sheets from the media plates being loaded, and paper assemblies remove any interleaved paper sheets. An unload module unloads imaged media plates from the other end of the drum, and position the unloaded plates onto a multi-directional conveyor of the unload module. The conveyor is capable of moving the imaged media plate in one of several directions to other devices for further processing of the media plates.

12 Claims, 42 Drawing Sheets

U.S. PATENT DOCUMENTS

| | | | |
|---|---|---|---|
| 4,443,870 | 4/1984 | Hazel et al. | 369/44 |
| 4,445,798 | 5/1984 | Munehiro | 400/320 |
| 4,455,910 | 6/1984 | Kraft et al. | 83/874 |
| 4,543,615 | 9/1985 | Van Canpenhout et al. | 358/285 |
| 4,550,252 | 10/1985 | Tee | 250/223 |
| 4,585,331 | 4/1986 | Stoffel et al. | 355/8 |
| 4,666,315 | 5/1987 | Scranton | 384/1 |
| 4,700,368 | 10/1987 | Munn et al. | 377/8 |
| 4,704,712 | 11/1987 | Siryj | 369/249 |
| 4,777,979 | 10/1988 | Twerdochlib | 137/554 |
| 4,798,478 | 1/1989 | Crystal | 384/12 |
| 4,834,353 | 5/1989 | Chitayat | 269/73 |
| 4,879,513 | 11/1989 | Spiegel et al. | 324/207 |
| 4,985,651 | 1/1991 | Chitayat | 310/12 |
| 5,079,502 | 1/1992 | Rogacki et al. | 324/207.19 |
| 5,098,203 | 3/1992 | Henderson | 384/12 |
| 5,204,633 | 4/1993 | Ahladas et al. | 324/654 |
| 5,228,358 | 7/1993 | Sakino et al. | 74/479 |
| 5,387,995 | 2/1995 | Harig | 359/204 |
| 5,504,426 | 4/1996 | Ricci et al. | 324/207.17 |
| 5,553,839 | 9/1996 | Wolfson | 271/3.11 |
| 5,558,320 | 9/1996 | Menard et al. | 271/4.01 |
| 5,640,473 | 6/1997 | Wheeler et al. . | |
| 5,655,452 | 8/1997 | Blake et al. | 101/477 |
| 5,821,981 | 10/1998 | Menard et al. . | |
| 5,828,501 | 10/1998 | Menard et al. . | |
| 5,841,567 | 11/1998 | Squires et al. . | |

AUTOMATED MEDIA TRANSPORT DEVICE AND METHOD OF USING THE SAME

CROSS REFERENCES TO RELATED APPLICATIONS

Some of the matter contained herein is disclosed in the commonly owned U.S. patent application Ser. Nos. 08/674,439, entitled "Apparatus And Method For Positioning A Lens To Expand An Optical Beam Of An Imaging System"; 08/674/766, entitled "A Method And Apparatus For Imaging At A Plurality Of Wavelengths"; 08/677,343, entitled "Method And Apparatus For Generating An Optical Beam For Use In An Imaging System"; No. 08/674,763, entitled "Magnetically Preloaded Air Bearing Motion System For An Imaging Device"; "Multiple Beam Scanning System For An Imaging Device"; and "Media Feed Apparatus For An Imaging Device". Each of the foregoing patent applications are incorporated herein by reference.

FIELD OF THE INVENTION

The present invention relates to imaging devices and methods, and relates more particularly to automated media loading and unloading apparatus for such devices.

BACKGROUND OF THE INVENTION

Imaging devices, such as photoplotters and scanners, are known in the art. Scanners function by illuminating a test sample with an unmodulated optical beam and capturing the light reflected by or transmitted through the test sample after it leaves the copy. The reflected or transmitted optical signals are received by a detector and recorded. By way of example, photoplotters are used in the fields of publishing, graphic arts and the fabrication of printed circuit boards.

Internal drum photoplotters have a cylindrical surface portion to receive a media plate to be imaged. An optical beam generator emits a modulated optical feed beam onto a parabolic spinning mirror, and the mirror reflects the beam onto the media. As the mirror spins, the reflected imaging beam advances across the media surface from one side edge of the surface to an other side edge, exposing a sequence of pixels which together form a scan line generally perpendicular to the axis of the drum. The spinning mirror is mounted on a carriage, which moves along a spar oriented parallel to the axis of the drum and perpendicular to the scan line. The carriage moves continuously so that the imaging process is helical along the cylinder. The rotating imaging beam advances across the surface area of the drum in this manner until the entire image is exposed to the media.

Smaller internal drum imaging devices expose media plates having typical dimensions of 21"×24" for "4-up" media format printing, i.e., large enough to fit four images on a plate, and plates of 32"×42" for plates of "8-up" format printing. The widths of the smaller plates permit the radius of the internal drum to be sufficiently small and yet provide access between the drum and the spar for loading and unloading the media plates onto and off of the drum.

The dimensions of larger media plates for larger imaging devices capable of exposing media of larger format printing, e.g., "16-up", are approximately 52" by 68". The handling and loading of the larger media onto the internal drum typically requires the assistance of one or more individuals.

In one other machine, the loading and unloading of media plates is performed automatically. Such a machine is shown and described in the above-noted U.S. Pat. Application entitled "Media Feed Apparatus For An Imaging Device".

Each media plate is moved along a transport path oriented perpendicular to the drum axis. The media feed apparatus is employed with large format media, e.g., 16-up, and accordingly requires a relatively large footprint. Such apparatus require substantial time to load and unload the media plates. Since there is no separate mechanism for removing any interleaves, the same suction cups used to move the media plates would also remove the interleaf. Moreover, the media feed apparatus is very complicated and correspondingly expensive.

Accordingly, it is an object of the present invention to provide an automated apparatus for loading media plates into and unloading media from an imaging device that reduces the cycle time required to load and remove media plates of media onto and from an internal drum of the imaging device.

It is another object to provide an automated media feed apparatus which automatically adapts to the use of different-sized media, and does not require manual reconfiguration of the apparatus.

It is a further object to provide an automated media feed apparatus for an imaging device that accurately loads a media plate onto the internal drum of the imaging device, and compensates for skewing of the media plate which may occur during loading.

It is still another object to provide an automated media feed apparatus for an imaging device unloads a media plate from the internal drum of the imaging device, and accurately positions the imaged media plate on a conveyor for transferring the imaged plate for further processing.

It is yet another object to provide a conveyor capable of transferring the imaged plates in one of several available apparatus for further processing of the imaged media plates.

SUMMARY OF THE INVENTION

The present invention relates to the automated loading and unloading of media plates into and out of imaging devices, and preferably drum type imaging devices.

In accordance with one aspect of the present invention, a system is disclosed for automatically removing a media plate from a stack of media plates, and loads and unloads the media plate into and from an internal drum of an imaging device. The internal drum has an axis and opposing ends. Each media plate of the stack of media plates may be separated by an interleaf.

The system includes a transfer mechanism for transferring a media plate from the stack into the internal drum in a loading direction, which is oriented at least generally parallel to the drum axis. The transfer mechanism loads a media plate through one end of the internal drum.

An unloading mechanism unloads a media plate from the internal drum in a direction generally parallel to the loading direction and through the other end of the internal drum. The transfer mechanism loads another media plate through the one end of the internal drum as the unloading mechanism unloads a media plate through the other end of the internal drum.

According to another aspect of the present invention, an apparatus is provided for loading a media plate from a stack of media plates into a generally cylindrical internal drum of an imaging device. The media plates have generally parallel first and second edges. The drum has a drum axis and opposing ends.

The apparatus includes a frame, which defines a generally cylindrical media plate receiving portion, and has a shape corresponding generally to the shape of the internal drum. The frame is movable in a direction parallel to the drum axis through one end of the drum, and between a first location positioned near the media plates and a second location positioned within the internal drum.

A first, extendible pickup of the apparatus is mounted to the frame for grasping a first edge of an uppermost media plate. The first pickup is movable between a first position, in which the first pickup is extended from the frame to engage a first edge of an uppermost media plate, and a second position, in which the first pickup is positioned adjacent to the generally cylindrical frame.

The apparatus also includes a second pickup mounted to the frame for grasping the uppermost media plate at a second position. The second pickup is spaced on the frame from the first pickup.

A member of the apparatus extends along the generally cylindrical frame, and is oriented parallel to the drum axis. the member is mounted for rotation about an wrapping axis for wrapping a media plate grasped by the first pickup around the frame and into engagement with the second pickup. The media plate is thus formed into a generally cylindrical shape, and releasably retained on the frame for loading of the retained media plate into the internal drum of the imaging device.

According to still another aspect of the present invention, an apparatus is provided for removing an interleaf from the top of a stack of media plates separated by interleaves, as media plates are removed from the stack of plates.

The apparatus includes an interleaf pickup member, which extends generally parallel to one edge of the stack for grasping and retaining a interleaf from the top of the stack of media plates. A rotation mechanism supports the interleaf pickup member, and rotates the member generally about a longitudinal axis between at least an interleaf engaging position and an interleaf wrapping position, the means for rotating.

A drive unit cooperates with the rotation mechanism and moves the pickup member and the rotation mechanism in a first direction generally parallel to the top of the stack. The rotation mechanism rotates the pickup member between the interleaf engaging and wrapping positions as the drive unit moves the member in the first direction in order to remove an uppermost interleaf from the stack of media plates.

According to yet another aspect of the present invention, an apparatus is disclosed for unloading a media plate from a generally cylindrical internal drum of an imaging device. The media plates typically have parallel first and second edges, and the drum has a drum axis.

A frame of the apparatus defines a generally cylindrical media plate receiving surface, which corresponds generally to the shape of the internal drum. The frame is movable in a direction parallel to the drum axis and between a first location positioned within the internal drum and a second location positioned outside of the drum.

The apparatus includes a first pickup, which is mounted to the frame for grasping a first edge of a media plate positioned in the internal drum. The first pickup is movable between a first position, in which the first pickup is extended out from the cylindrical surface to engage a first edge of a media plate positioned in the internal drum, and a second position, in which the first pickup is retracted and positioned adjacent to the generally cylindrical surface.

The apparatus also includes a second pickup, which is mounted to the frame for grasping the uppermost media plate at a second location. The second pickup is movable between a first position, in which the second pickup is extended beyond the cylindrical surface to engage a media plate positioned in the internal drum, and a second position, in which the second pickup is positioned adjacent to the generally cylindrical surface. One of the first and second pickups is mounted for movement around the frame and relative to the other pickup, in order to vary the spacing between the first and second pickups and draw a retained media plate against the cylindrical surface when the first and second pickups are retracted.

According to a further aspect of the present invention, an apparatus is disclosed for conveying an article in one of at least two directions.

The conveyor includes a number of belts, which are mounted for common rotation along a first direction. The belts define spaces between the belts, and the belts generally define a first plane.

A number of rollers of the conveyor are mounted for common rotation along a second direction, with the rollers being positioned in the spaces defined between the belts. The rollers generally defining a second plane.

The conveyor also includes a roller displacement mechanism for moving the rollers relative to the belts in a direction generally perpendicular to the first plane. The rollers are displaced between a first position, in which the second plane is located on one side of the first plane, and a second position, in which the second plane is located on the other side of the first plane.

According to yet a further aspect of the present invention, an apparatus is disclosed for processing media plates having at least one characteristic which affects the processing of the plates.

A housing of the apparatus receives a stack of media plates. The apparatus also includes an indicator mounted at a predetermined location on the housing, for indicating at least one characteristic of the media plates contained in the housing. The indicator includes one or more apertures, which are open or closed in accordance with the at least one characteristic of the media plates.

The apparatus further includes a mechanism for positioning the housing so that the indicator is positioned at a known location. A reader of the apparatus is positioned at a predetermined location relative to the known location of the indicator, for reading whether the apertures are open or closed. A processor processes the media plates based upon the information read by the reader.

According to an additional aspect of the invention, a controller is disclosed for detecting the presence of an interleaf disposed on an upper surface of a media plate, and removing the interleaf using an interleaf removal assembly. The interleaf removal assembly includes a lower carriage, which is movably coupled to a horizontal way; an upper carriage, which is movably coupled to a vertical way; a vacuum bar, which is rotatably coupled to the upper carriage; an interleaf sensor which is disposed on the vacuum bar; a vacuum assembly for securing the media plate to the vacuum bar; and a cassette reader for identifying the media plate disposed within a media cassette.

The controller includes means for receiving a media signal representative of the dimensions of the media plate. Means are included for receiving a signal from an interleaf sensor indicative of the presence of paper disposed on the surface of the media plate. Means are also included for providing a first actuation signal to the vacuum means to secure the sheet of paper to the vacuum bar in response to the media signal.

The controller also includes means for receiving a first position signal representative of the location of the lower carriage. Means are included for providing a drive signal to the lower carriage for advancing the lower carriage to a predetermined position in response to the first position signal. Means are also included for receiving a second position signal representative of the rotational position of the vacuum bar. Additional means are provided for providing a drive signal to the upper carriage for rotating the vacuum bar to a predetermined position in response to the second position signal. Additional means are provided for providing a second actuation signal to a lifting means to raise and lower the upper carriage in response to a command signal.

According to a still additional aspect of the invention, a controller is disclosed for loading a media plate onto a scanning surface of an internal drum of an imaging device using a media transport device. The drum has a leading edge, a trailing edge, and a pair of docking sensors disposed laterally at the leading edge of the internal drum. The media transport device has a load shoe assembly, which is movable in a direction parallel to the drum axis through one end of the drum, and between a first location positioned near the media plates and a second location within the internal drum. The load shoe assembly includes a leading edge pickup assembly for releasably engaging a leading edge of the media plate and being movable between a first position in which the leading edge assembly is extended to engage the media plate, and a second position in which the leading edge assembly is retracted adjacent the load shoe assembly; a trailing edge pickup assembly for releasably engaging a trailing edge of the media plate; and a roller for urging the media plate to the trailing edge pickup assembly. The roller extends along the load shoe assembly and is oriented parallel to the drum axis, and is mounted for rotation about a wrapping axis for wrapping the media plate engaged by the leading edge pickup assembly to the leading edge pickup assembly.

The controller includes means for receiving a first position signal representative of the location of the load shoe assembly; means for providing a first drive signal to the load shoe assembly for advancing the load shoe assembly axially to and from the internal drum of the imaging device in response to the first position signal; means for receiving a second position signal representative of the position of the leading edge pickup assembly; means for providing a second drive signal to the leading edge assembly for advancing the leading edge assembly to engage the leading edge of the media plate in response to the second position signal; means for receiving a third position signal representative of the position of the trailing edge pickup assembly; means for providing a third drive signal to the trailing edge pickup assembly for moving the trailing edge pickup assembly to engage the trailing edge of the media plate in response to the third position signal; means for receiving a fourth position signal representative of the position of the roller; means for providing a fourth drive signal to the roller for advancing the roller over a bottom surface of the media plate to urge the media plate to the trailing edge pickup assembly in response to the fourth position signal; means for receiving docking signal signals representative of the position of the a media plate disposed on the internal drum; and means for providing an actuation signal for moving radially the trailing edge pickup assembly in response to the docking signals.

According to yet another additional aspect of the invention, a controller for unloading a media plate from a scanning surface of an internal drum of an imaging device using a media transport device is disclosed. The drum has a leading edge, and a trailing edge. The media transport device has an unload shoe assembly, which is movable in a direction parallel to the drum axis through one end of the drum and between a first location positioned within the drum and a second location positioned outside the internal drum. The unload shoe assembly includes a leading edge pickup assembly for releasably engaging a leading edge of the media plate, and is movable between a first position, in which the leading edge assembly is extended to engage the media plate, and a second position in which the leading edge assembly is retracted adjacent the unload shoe assembly. A trailing edge pickup assembly releasably engages a trailing edge of the media plate, and is movable between a first position extend to engage the media plate and a second position adjacent the unload shoe assembly, the trailing edge pickup assembly being further mounted for movement about the unload shoe assembly.

The controller includes means for receiving a first position signal representative of the position of the slide assembly; means for providing a first drive signal to the slide assembly for extending and retracting the unload shoe into and from the internal drum in response to the first position signal; means for receiving a second position signal representative of the position of the trailing edge pickup assembly; means for providing a second drive signal to the trailing edge assembly for moving the trailing edge assembly in response to the second position signal; and means for providing an engagement and retraction signal for extending and retracting the leading edge pickup assembly and trailing edge pickup assembly to and from the internal drum for engaging and lifting the media plate off the internal drum in response to a command signal.

According to still another aspect of the invention, a controller is disclosed for configuring a conveyor assembly to selectively transport a media plate to a processing station. The conveyor assembly includes a belt assembly for advancing the media plate in a selected direction, a roller assembly for advancing the media plate in a selected direction, and a lifting means for raising and lowering an engagement surface of the roller assembly above an engagement surface of the belt assembly.

The controller includes means for receiving a command signal indicative of the direction to the processing station; means for providing a first drive signal to the belt assembly for advancing the media plate to the processing station in response to the command signal; means for providing a second drive signal to the roller assembly for advancing the media plate to the processing station in response to the command signal; and means for providing an actuation signal to the lifting means for raising and lowering the engagement surface of the roller assembly in response to the command signal.

Another aspect of the present invention is a method of transporting media to and from an imaging device using: a media transport device having a load shoe assembly for loading the media onto the internal drum of the imaging device; and an unload shoe assembly for unloading the media. The method includes the steps of: detecting the presence of paper on the media; removing the paper from the media; securing media to the load shoe assembly; extending the load shoe assembly axially into the internal drum; docking the media to the internal drum; retracting the load shoe assembly from the internal drum; imaging the media; extending the unload shoe assembly into the internal drum; securing the media to the unload shoe assembly; retracting the unload shoe assembly from the internal drum; and releasing the media onto a media support.

Still another aspect of the present invention is a method of loading and preparing a media cassette into a media load module of a media transport device for an imaging device. The media transport device includes a load shoe assembly having a retractable engagement pin disposed thereon, and the cassette includes a retractable cover having a handle. The method includes the steps of: inserting media cassette into the media load module; moving the load shoe assembly forward into the internal drum to align the engagement pin with the handle of the cover of the media cassette; extending the engagement pin to engage the handle of the cover; retracting the load shoe assembly from the internal drum to a predetermined position to retract the cover; and retracting the engagement pin from the handle the cover.

Yet another aspect of the present invention is a method of removing paper from the media using a media transport device for an imaging device. The media transport device includes a paper removal assembly having a vacuum bar for engaging a paper sheet disposed on the surface of the media. The method includes the steps of: securing the vacuum bar to paper disposed on media; raising the vacuum bar; rotating the vacuum bar a predetermined number of degrees; moving the vacuum bar across the media beyond an edge of the media; lowering vacuum bar below the media; moving the vacuum bar below the media to a predetermined position; releasing paper from the vacuum bar; and moving the vacuum bar below the media to an initial position.

A further aspect of the present invention is a method of loading media onto an internal drum of an imaging device using a media transport device including a load shoe assembly having a leading edge pickup assembly for securing a leading edge of the media thereto, a trailing edge pickup assembly for securing a trailing edge of the media thereto, and a roller for securing the trailing edge the trailing edge of the media to the trailing edge pickup assembly. The method includes the steps of: moving the load shoe assembly to a predetermined position above the media cassette; moving the leading edge pickup assembly to the media; activating a vacuum generator; securing the leading edge pickup assembly to the leading edge of the media; retracting the leading edge pickup assembly to a home position; moving the trailing edge pickup assembly to a predetermined position along the load shoe assembly; moving roller along bottom surface of the media; and moving the load shoe assembly axially into internal drum to a load position.

Another aspect of the present invention is a method of docking media onto an internal drum of an imaging device using a media transport device, the media transport device including a load shoe assembly having a leading edge pickup assembly for securing a leading edge of the media thereto and a trailing edge pickup assembly for securing a trailing edge of the media thereto, the internal drum having a pair of laterally-spaced docking sensor disposed on a leading edge of the internal drum. The method includes the steps of: releasing the media from the leading edge pickup assembly; lowering the trailing edge pickup assembly; moving the leading edge of media against the docking sensors; deactuating a preselected number of vacuum cups disposed on the trailing edge assembly that correspond to the triggered docking sensor; moving the leading edge of the media against an untriggered docking sensor; stopping movement of the media when the untriggered docking sensor provides a signal representative a predetermined limit; and securing the media to the internal drum.

A final aspect of the present invention is a method of unloading media from an internal drum of an imaging device using a media transport device, the media transport device including an unload shoe assembly having a leading edge pickup bar for securing a leading edge of the media thereto and a trailing edge pickup bar for securing a trailing edge of the media thereto. The method includes the steps of: retracting the leading edge pickup bar; retracting the trailing edge pickup bar; extending the unload shoe assembly into the internal drum; moving the trailing edge pickup bar to predetermined position; extending the unload shoe assembly into the internal drum; extending the leading edge pickup; extending the trailing edge pickup bar; securing the leading edge pickup bar to the leading edge of the media; securing the trailing edge pickup bar to the trailing edge of the media; retracting the leading edge pickup bar; retracting the trailing edge pickup bar; moving the trailing edge pickup bar upward; and retracting the unload shoe assembly from the internal drum.

One advantage of the present invention is that the media plates are automatically loaded and unloaded in a direction parallel to the drum axis, and thus there is no need to deflect the plates around the optics and associated structure during loading and unloading of the plates. Accordingly, the highly complex structure required to engage and guide the edges of a media plate to load and unload media plates in a direction generally parallel to a drum radius, i.e., in a direction perpendicular to the drum axis, is substantially avoided.

Another advantage of the present invention is that media sheets are loaded through one end of the drum, and unloaded through the other end of the drum, and thus a media sheets may be unloaded from the drum while another media plate is being loaded into the drum.

Still another advantage of the present invention is that a conveyor is capable of conveying unloaded media plates in several direction, thus simplifying the apparatus for distributing unloaded plates to one of several devices for further processing of the plates.

Yet another advantage of the present invention is that the paper removal assemblies ensure complete removal of the interleaves from a media sheet, which ensures that only the media plate will be retained against the internal drum and imaged. The top paper removal assembly rotates and translates the edge of an upper interleaf, which avoids tearing and jamming associated with prior paper removal assemblies and ensures complete removal of the upper interleaf. The bottom paper removal assembly includes two mechanisms for separating an underlying interleaf from the underside of a media sheet which is to be loaded into the drum.

A further advantage of the present invention is that the cassette includes an indicator for conveying information about media plates contained in the cassette to the system. Thus, the system can automatically compensate or adjust any subsystems that should be adjusted due to the use of various-sized media plates.

BRIEF DESCRIPTION OF THE DRAWINGS

FIG. 11 is another perspective view of the load shoe, taken generally opposite from the position at which FIG. 10 is taken.

DETAILED DESCRIPTION OF THE PREFERRED EMBODIMENTS

Figure 1:
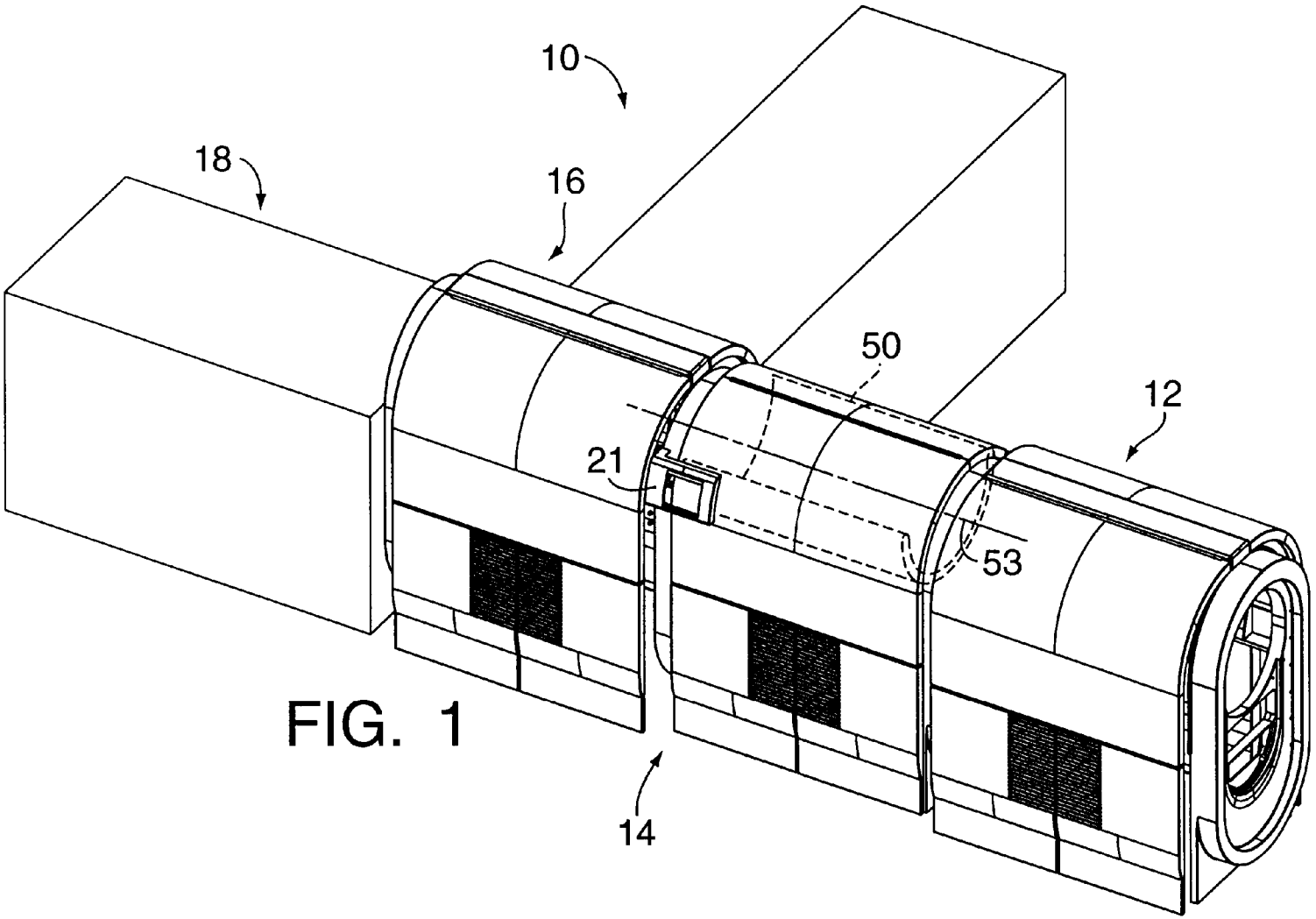
FIG. 1 is a schematic, perspective view of an automated media transport apparatus of the present invention, illustrating a media load module, an imaging device, and a media unload module which feeds imaged media to one or more conveyors for further processing of the media.

Turning now to FIG. 1, an automated media transport apparatus for an imaging device is illustrated generally by the reference numeral 10. The apparatus 10 includes a media load module 12, an imaging device 14, a media unload module 16, which feeds imaged media to one or more conveyors 18, 20 for further processing, all under the common control of a controller 21. The apparatus 10 provides increased and improved throughput of media plates. The imaging device is an internal drum type imaging device, such as the Crescent 3030 manufactured and sold by Gerber Systems, Inc., the assignee of the present invention, although those skilled in the art will recognize that the apparatus may be employed with other imaging devices, including but not limited to other drum type and flat bed imaging devices.

As a general overview of the apparatus 10, the load module 12 loads media plates M from a flat cassette and into an internal drum of the imaging module 14 through one end of the drum. Sensors detect the presence of interleaved paper sheets which rest on top of or adhere to the underside of the plates being loaded, and paper assemblies remove any paper sheets. An unload module 16 unloads imaged media plates from the other end of the drum, and positions the unloaded plates onto a multi-directional conveyor of the unload module. The conveyor is capable of moving the imaged media plate in one of several directions to other devices 18, 20 for further processing of the media plates. The various modules and their cooperation are discussed in more detail below.

Figure 2:
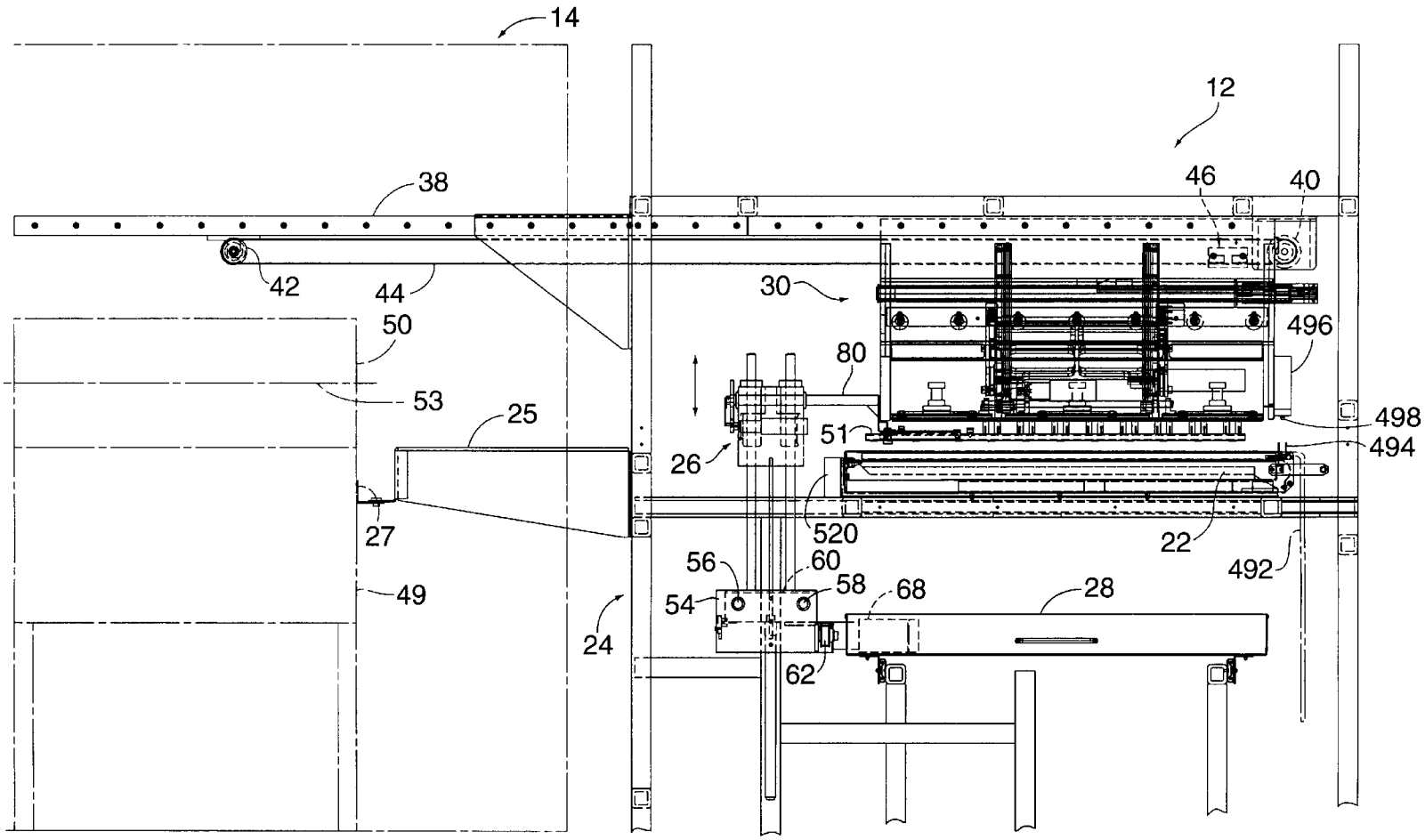
FIG. 2 is a side view of the media load module of FIG. 1, illustrating a cassette containing one or more media plates separated from one another by interleaved sheets, a load shoe assembly for transferring media plates from the cassette to the imaging apparatus, and a paper removal assembly for removing the interleaves from the media plates.
Figure 3:
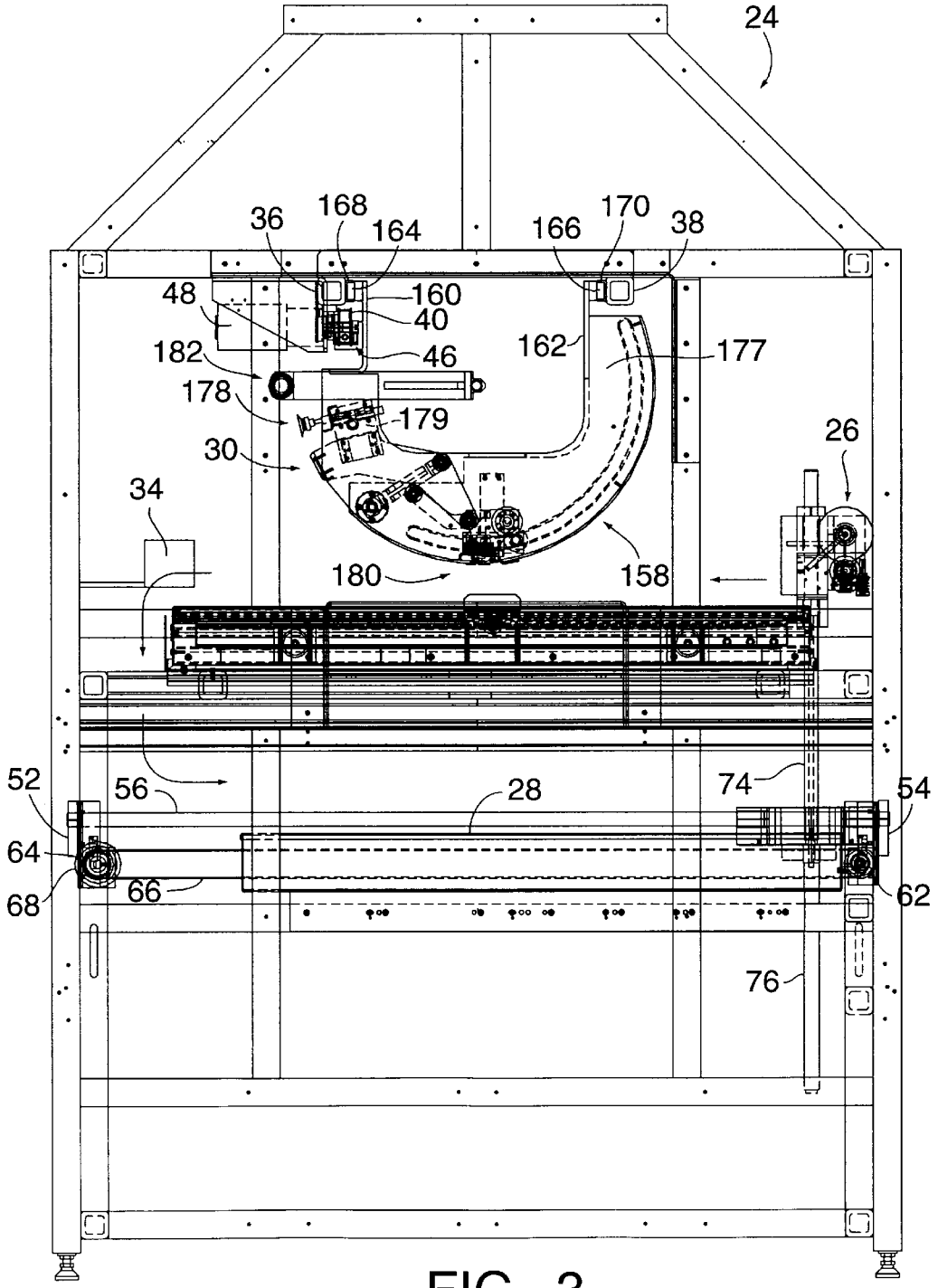
FIG. 3 is a left end view of the media load module of FIG. 2.
Figure 4:
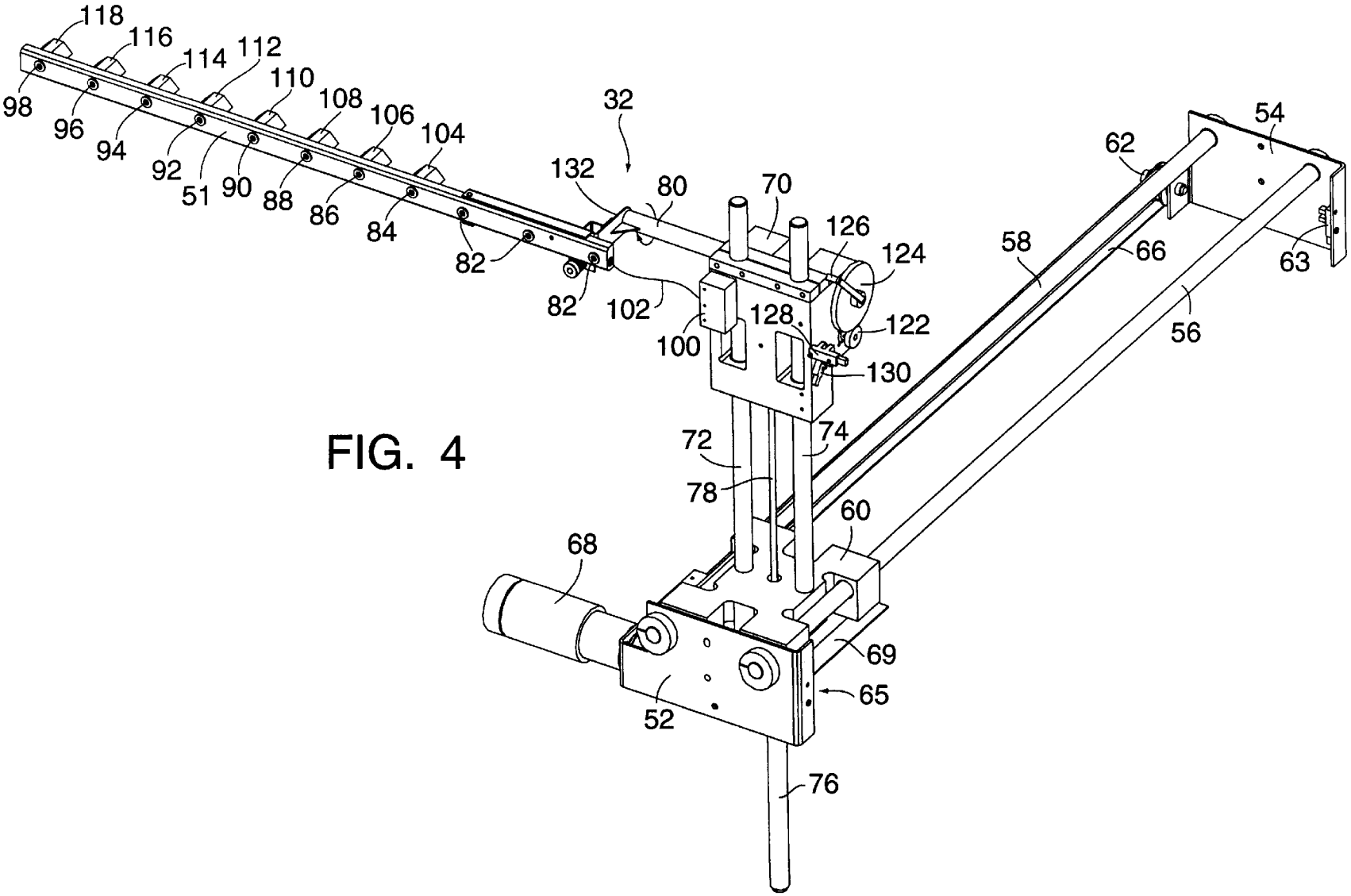
FIG. 4 is a perspective view of part of the paper removal assembly of FIGS. 1 and 2.

With reference to FIGS. 2 and 3, the load module 12 receives a cassette 22, described further below, which is mounted on a frame 24 of the loading module and contains one or more media plates to be imaged in the imaging device 14 (FIG. 1). A registration bracket 25 with pins is attached to the frame 24, and cooperates with a corresponding registration flange 27 attached to the frame (not shown) of the imaging device, to enable registration of the load module 12 (FIG. 1) and the imaging device 14 (FIG. 1). The media plates are separated by interleaved sheets, which are typically made from a paper or similar material and aid in the fabrication and cutting of the plates. The load apparatus 12 also includes a paper removal apparatus 26 for removing the interleaved paper and dropping the removed paper in a disposal tray 28 positioned generally beneath the cassette, and a load shoe assembly 30 for loading media plates from the cassette 22 into the drum of the imaging device 14, as described further below. The paper removal assembly 26 includes two subassemblies, a subassembly 32 (FIGS. 4, 5 and 6) ("top paper removal subassembly") for removing a topmost paper sheet from a media plate to be loaded into the imaging device, and a subassembly 34 (FIG. 7) ("bottom paper removal subassembly") for ensuring that the paper underneath the media plate to be loaded does not adhere to the media plate to be loaded.

The load shoe assembly 30 is mounted for movement along rails 36, 38 that are attached to the frame 24. Pulleys 40, 42 are mounted at either end of one of the rails, and a toothed drive belt 44 extends around the pulleys. The load shoe assembly 30 is secured to the belt 44 by a belt clamp 46, and a servo motor 48 drives one of the pulleys, so that actuation of the servomotor in one direction or the other rotates the pulleys and drives the load shoe assembly 30 in a direction parallel to the drum axis 53 and between a position generally over the cassette 22 and a position generally over the internal drum 50 (illustrated in dashed lines in FIG. 2) of the imaging device (FIG. 1). The drum may be mounted to a frame supported on air bladders 49 (illustrated schematically in FIG. 2 and described in the "Media Feed Apparatus For An Imaging Device"), which may be selectively inflated and deflated to isolate the drum and imaging optics from the surrounding environment during imaging. As indicated in FIGS. 1 and 2, the drum defines a drum axis 53.

The top paper removal subassembly 32 includes a vacuum bar 51, which extends generally in a direction parallel to the rails 36, 36 supporting the load shoe assembly 30. The vacuum bar 51 engages and removes an uppermost interleaf resting on the top of the stack of media plates in the cassette prior to the media plate being loaded in the imaging device, as is described below.

With reference to FIGS. 2–5, the top paper removal subassembly 32 is mounted to the frame 24 by brackets 52, 54, with a pair of parallel rails 56, 58 extending between the brackets. A lower carriage 60 of the assembly is mounted for linear movement along the ways. Pulleys 62, 64 and horizontal limit switches 63, 65 are mounted at opposite ends of the ways and to respective ones of the brackets 54, 52, and a toothed belt 66 extends around the pulleys. The limit switches are preferably optical limit switches, such as the switches shown and described in co-pending application entitled "Media Feed Apparatus For An Imaging Device", although other types of switches may be employed with equal effect. The lower carriage 60 is secured to the belt 66 by a belt clamp 67 or other suitable mechanism. A horizontal axis servomotor 68 is coupled to one of the pulleys and to the controller 21 (FIG. 1), and enables linear movement of the lower carriage 60 along the rails 56, 58. The controller 21 actuates the horizontal axis servomotor 68 as needed to drive the lower carriage along the ways and between positions defined by the horizontal limit switches 63, 65 and a cooperating limit flag 69 mounted to the lower carriage 60.

An upper carriage 70 of the assembly is mounted to a second pair of parallel rails 72, 74 for movement relative to the plate 60 in a direction oriented perpendicular to the direction of movement of the lower carriage 60 relative to its ways 56, 58. An air cylinder 76 is mounted to the lower carriage 60 and is coupled to an air or vacuum source via air lines and one or more conventional solenoids (not shown). The cylinder 76 drives an associated shaft 78, which is mounted to the upper carriage 70, to provide movement of the upper carriage 70 along a vertical axis relative to the lower carriage 60. The upper carriage is driven between an uppermost position (shown in FIGS. 2–5), and a lowermost position in which the cylinder is deactuated to allow the upper carriage is be lowered under its own weight toward the lower carriage.

The vacuum bar is coupled to a shaft 80, which is mounted for rotation relative to the upper carriage 78, so that the vacuum bar is rotatable relative to the upper carriage and thus also to the cassette 22. As shown best in FIG. 4, the vacuum bar 51 includes several suction cups, which may include "foam doughnuts", or other suitable materials 82, 82, 82, and 84–98. The suction units serve as suction cups, and are coupled to a vacuum generator 100 via air line 102. While the suction cups 82, 82, 82, are connected directly to the vacuum generator 100, the remaining cups 84–98 are connected to one another in series via air lines (not shown) and solenoid valves 104–118, which are controlled by the controller 21. When the vacuum bar is positioned on a topmost media plate M, the solenoids 82, 82, 82 correspond generally to an "origin" position of the media plates in the cassette, and the remaining solenoids are actuated or not actuated based upon a predetermined size of the media plates and associated interleaves contained in the cassette.

Rotation of the vacuum bar 51 is provided by a rotational axis servomotor 120 mounted to the upper carriage 70, and the shaft is rotated by gears 122, 124 coupled respectively to the rotational servomotor 120 and the shaft 80. The controller 21 (not shown) controls actuation of the servomotor 120, to rotate the vacuum bar 51 between first and second rotational positions defined by a rotation limit flag 126, which is mounted to the gear 124, and two limit switches 128, 130.

Figure 5:
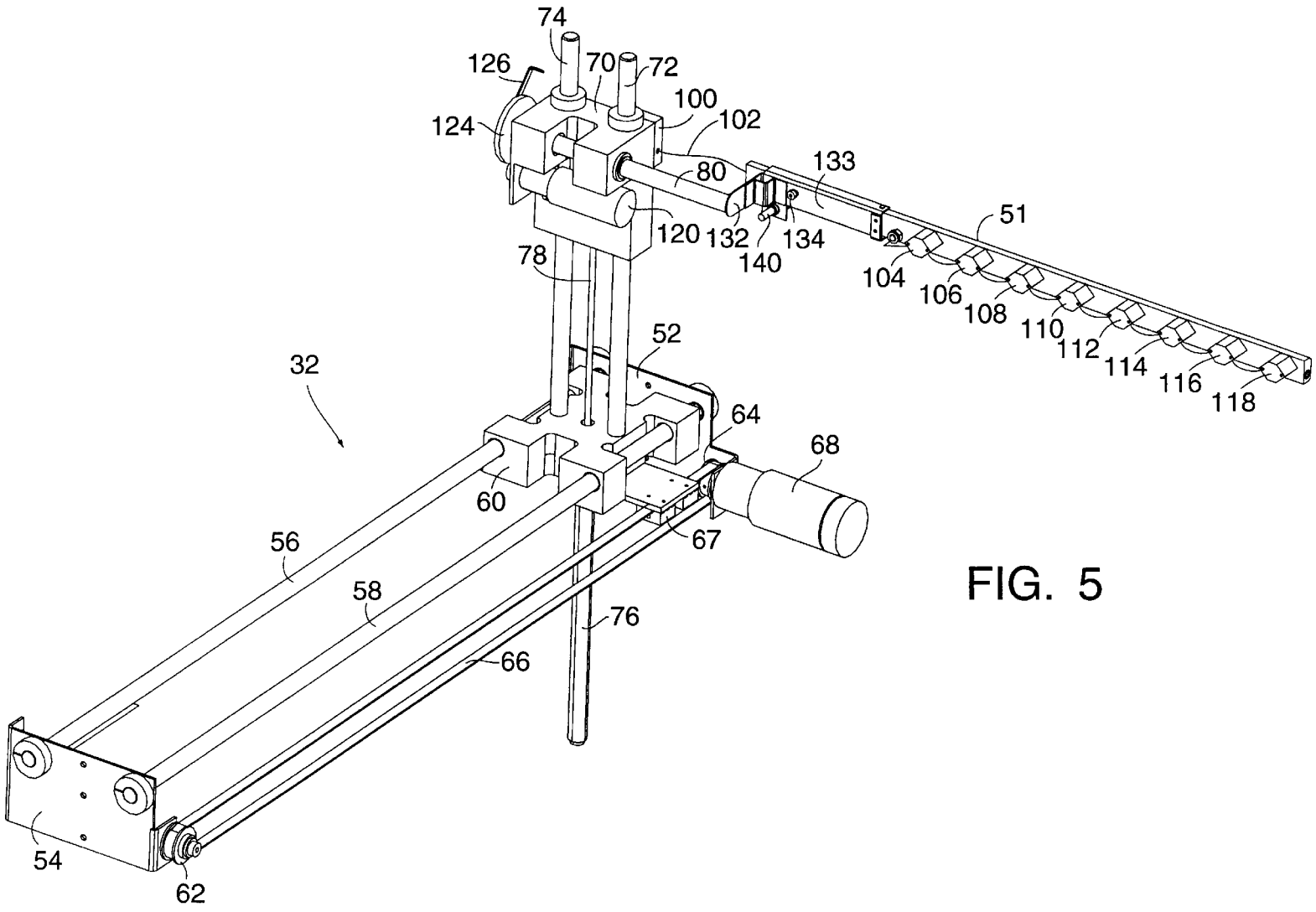
FIG. 5 is another perspective view of the assembly of FIG. 4.
Figure 6:
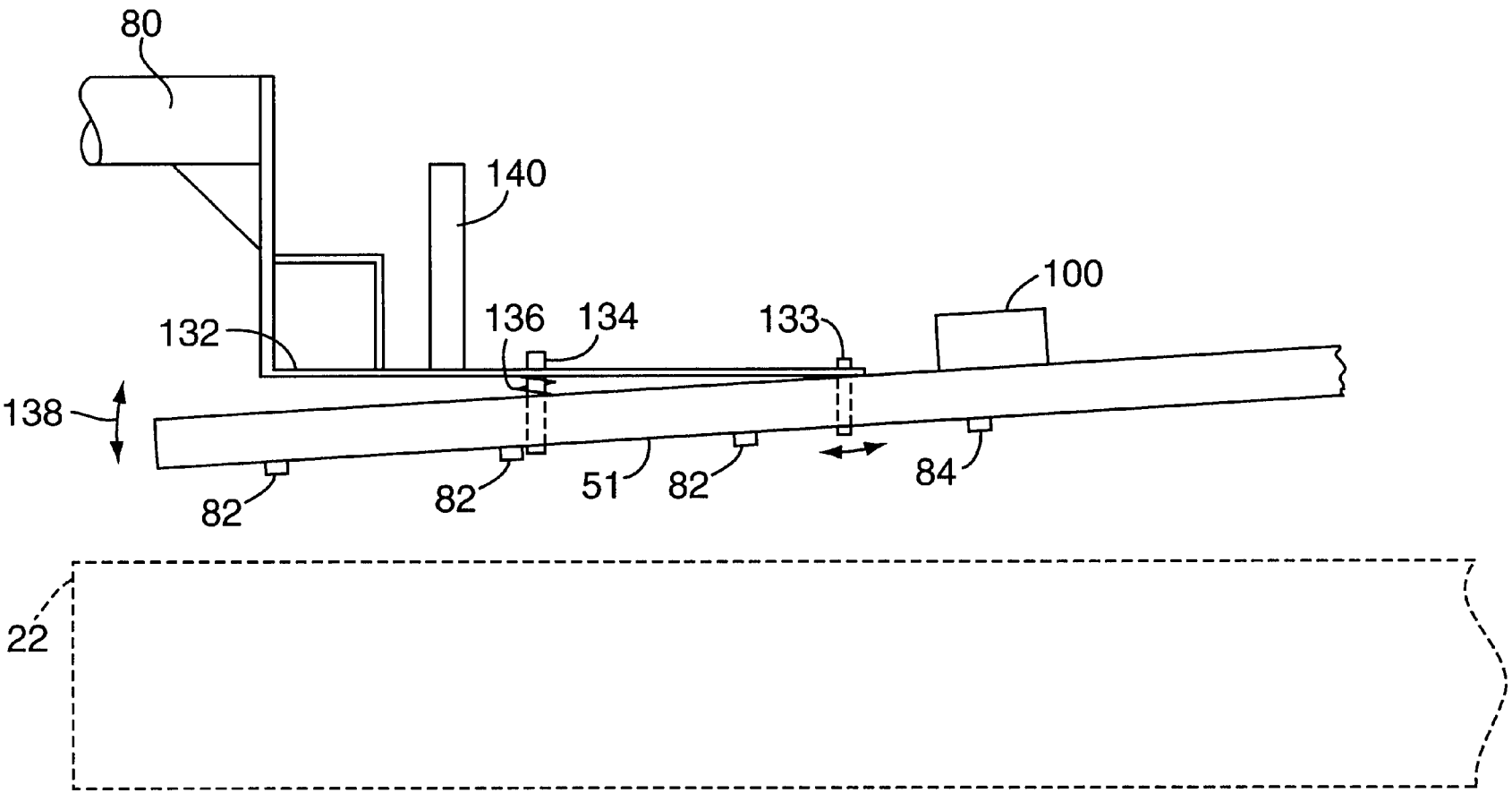
FIG. 6 is a schematic, fragmentary view of a vacuum bar balance of FIG. 5, which couples the vacuum bar to the remainder of the assembly of FIGS. 4 and 5.

As shown best in FIGS. 5 and 6, the vacuum bar is mounted to the shaft via a vacuum bar balance. The shaft 80 carries a flange 132, one end 133 of which is fastened directly to the vacuum bar 51. A post 134 passes through corresponding holes in the flange and the vacuum bar, and a compression spring 136 is positioned on the post between the flange and the vacuum bar. Since the flanges are oriented generally horizontally, the compression spring 136 biases one end of the vacuum bar 51 below the other end (not shown in FIG. 6), so that the suction cups 82, 82, 82, will engage an interleaf in the cassette 22 prior to the other doughnuts 84–108. After the suction cups 82, 82, 82 engage the interleaf, and as the upper carriage 70 travels downward toward the lower carriage 60, the vacuum bar rotates generally about the end 133 as indicated by the arrow 138 and the compression spring is compressed, so that other suction cups 84–98 may engage and grab the interleaf, as described further below.

The top paper removal subassembly 32 also includes an inductive paper sensor 140, which is connected to and cooperates with the controller (not shown) to determine the presence or absence of a topmost interleaf when the vacuum bar 51 is lowered onto the media plates in the cassette. The sensor includes an inductive coil, and associated magnetic material for generating a field about the coil. The coil provides an output signal to the controller representative of the change in the magnetic field as the sensor approaches a metallic surface of the media plate. Accordingly, the output signal is indicative of the gap or distance between the sensor and the media plate. When the sensor is placed upon a media plate, the controller receives the output signal and determines the gap. If the gap is equal to the thickness of an interleaf, the controller determines that an interleaf is present. If the gap is less than the thickness of an interleaf, no interleaf is present.

Figure 7:
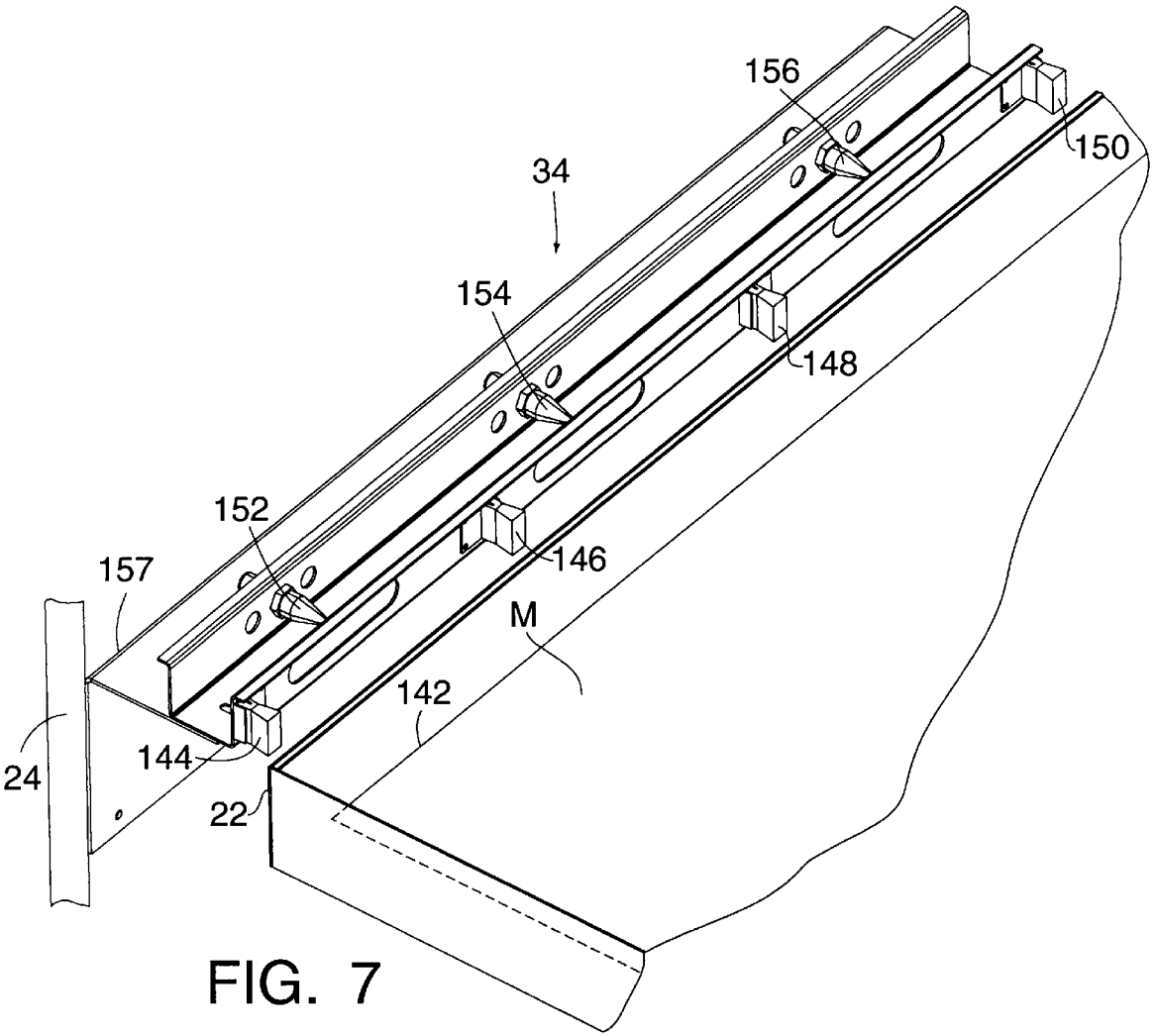
FIG. 7 is a perspective view of a portion of the paper removal assembly of FIG. 4 for removing any paper which adheres to the underside of the media plate to be loaded into the imaging device of FIG. 1.

Turning to FIGS. 3 and 7, the bottom paper removal assembly 34 is mounted to the frame 24 of the load module 12 (FIG. 1), and is positioned near one edge of the cassette installed in the load module, which edge corresponds to the leading edge 142 of a media plate M. As is described further below, the air nozzles and brushes cooperate to remove any interleaf which adheres, due to static or other cause, to the underside of a media plate being removed from the cassette for loading into the imaging device. The assembly 34 includes a series of brushes 144, 146, 148, 150 and air nozzles 152, 154, 156 mounted to a bracket 157. The brushes 144–150 are positioned to overhang slightly the leading edge of the media plates. The air nozzles 152–156 are positioned generally between the brushes 144–150, and are connected to an air source (not shown) through a common solenoid (not shown), which is controlled by the controller to emit or not emit jets of air through the nozzles.

Figure 7A:
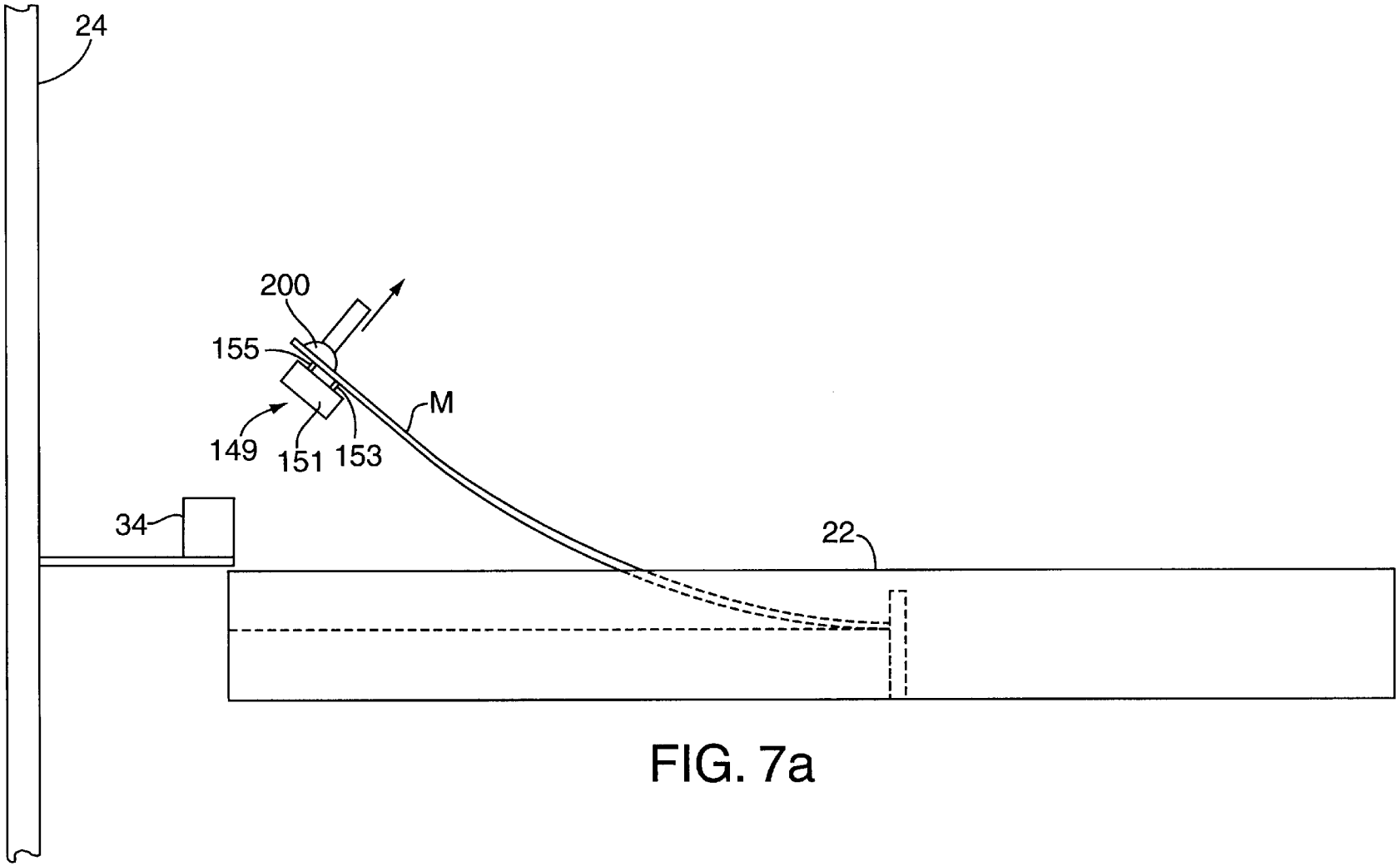
FIG. 7*a* is a fragmentary, end view of the unload module of FIGS. 2 and 3, illustrating a sensor for detecting the presence of an interleaf adhered to the underside of a media plate.
Figure 8:
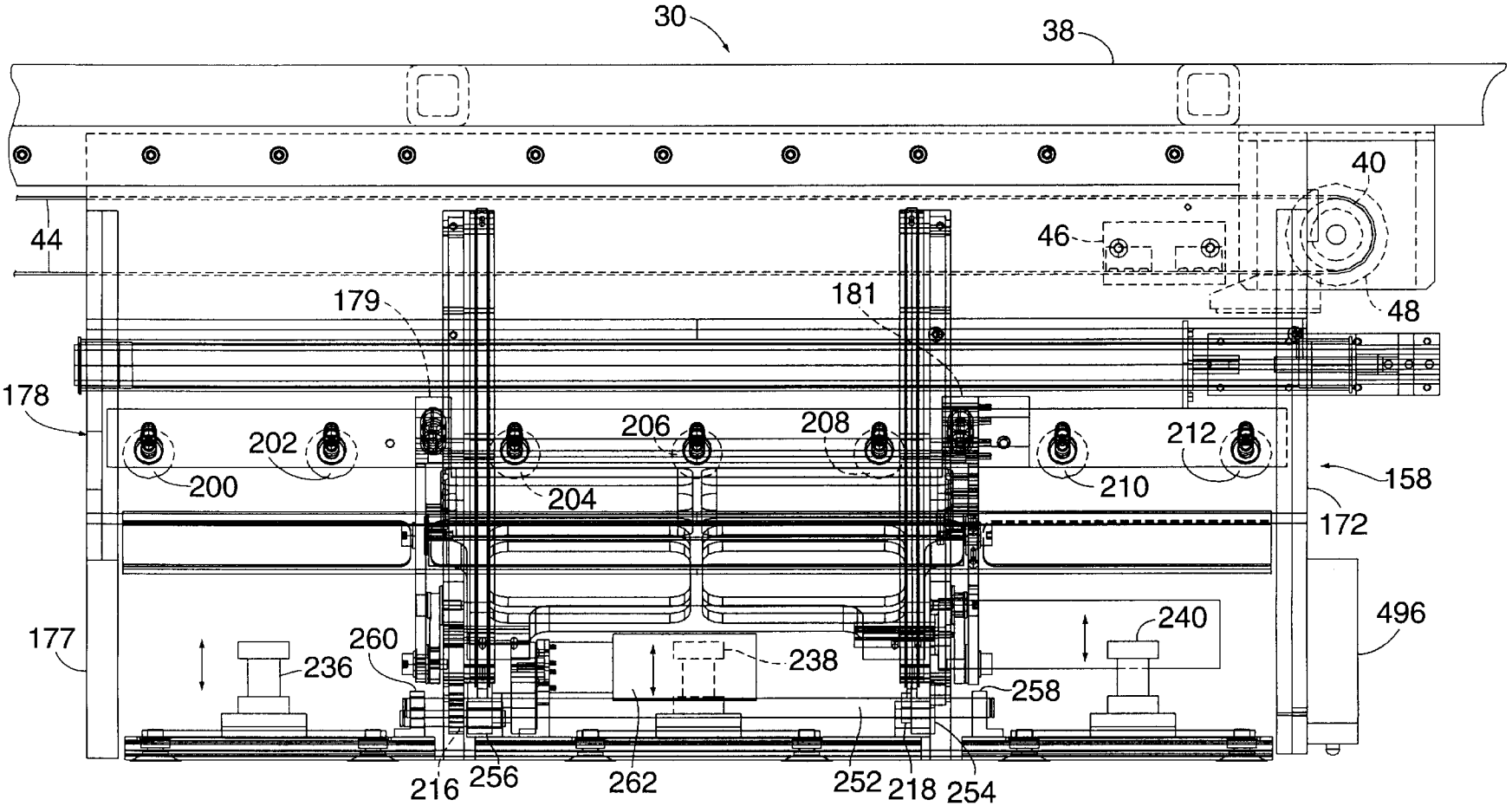
FIG. 8 is a fragmentary, side view of the load module of FIG. 2, illustrating the media load shoe of the media load assembly.
Figure 9:
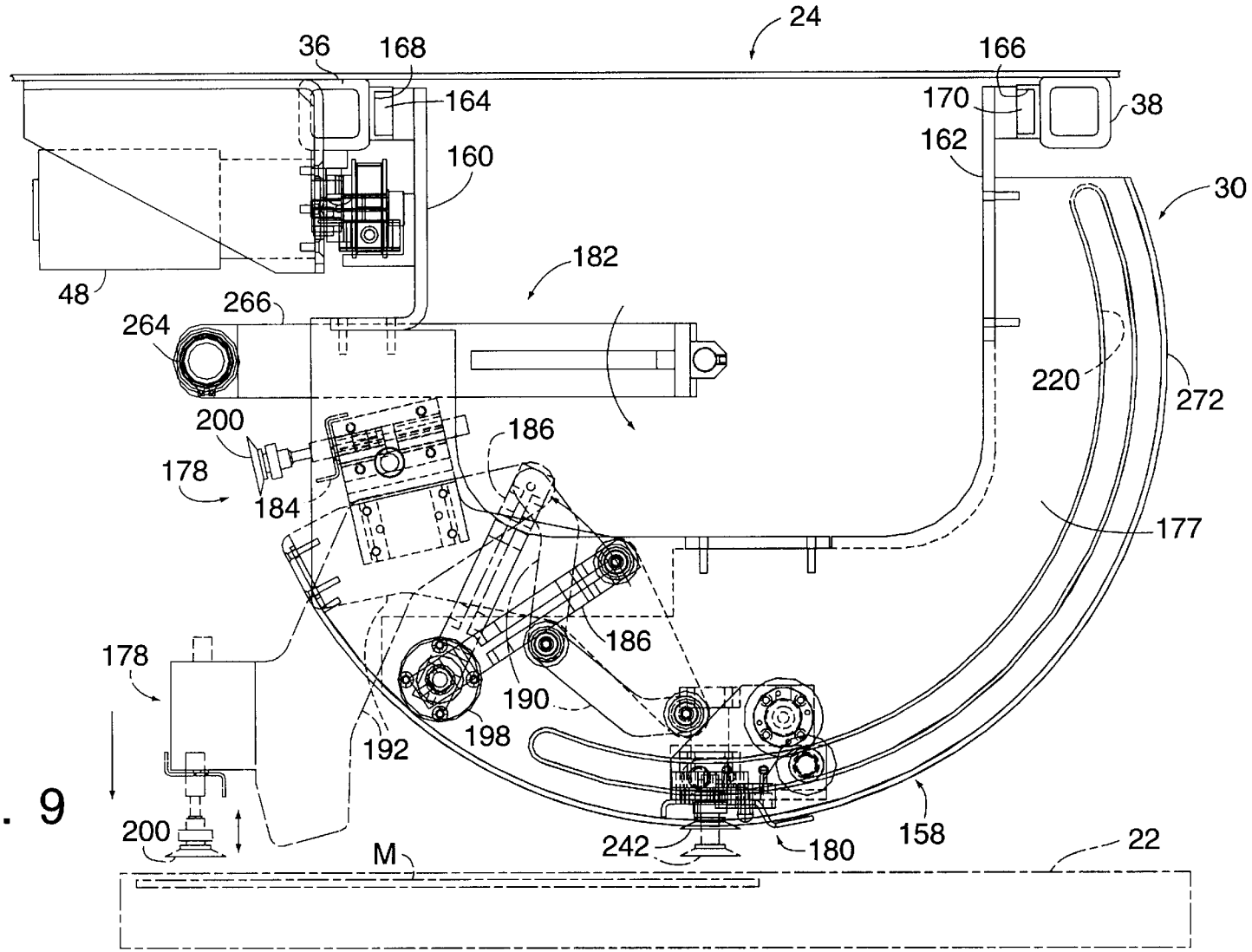
FIG. 9 is a fragmentary, end view of the load module of FIG. 2, illustrating the media load shoe.

Turning now to FIG. 7*a*, the top paper removal subassembly 32 includes a conductive paper sensor 149, which is coupled to the controller 21 (not shown in FIG. 7*a*) and detects the presence or absence of an interleaf which may adhere to the underside of the media plate M being removed from the cassette 22. If an interleaf adheres to the underside, the interleaf and not the media plate will be positioned against the internal drum. Consequently, the media plate will not be firmly retained on the drum during imaging, and the imaging will result in an improperly formed image on the media plate. Thus, the conductive paper sensor 149 is mounted for movement relative to the cassette 22 and media plates, e.g., the sensor may be mounted to the side of the vacuum bar of the paper removal assembly (not shown in FIG. 7*a*), and includes a body 151 which carries two electrical contacts 153, 155. After the illustrated suction cup 200 and other suction cups of the leading edge pickup bar grasp and begin to raise the leading edge of the media plate, the conductive paper sensor 149 is brought into contact with the underside of the media plate M. In the absence of paper adhered to the underside of the media plate, current flows along the plate and between the contacts and the controller determines that no paper is adhered. If, however, paper has adhered to the underside of the media plate, e.g., due to static or other reason, then no current flow and the controller initiates a procedure to remove the paper adhering to the underside of the media plate, as is described further below.

Figure 10:
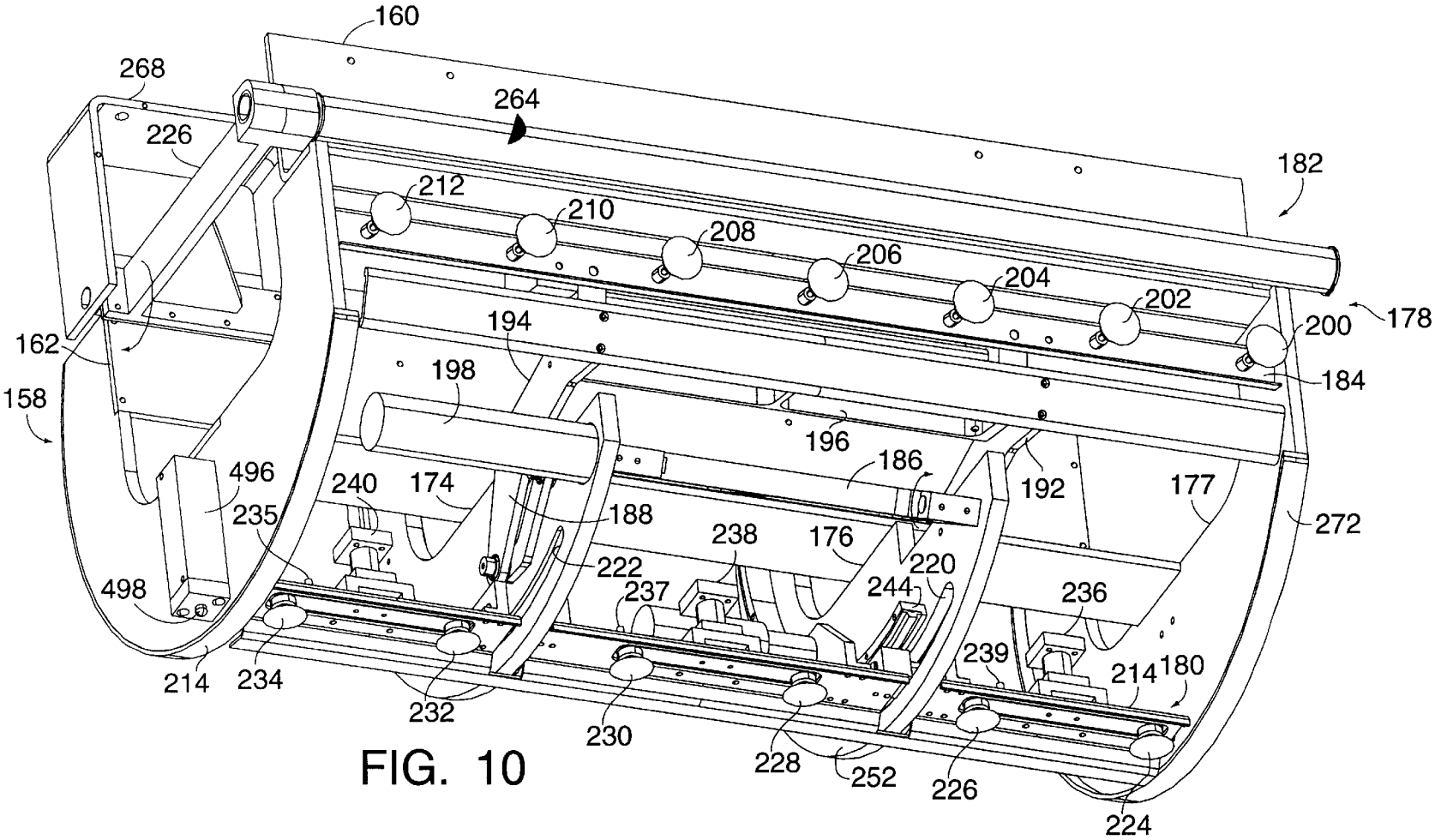
FIG. 10 is a perspective view of the load shoe of FIGS. 8 and 9, taken generally from the side opposite the side illustrated in FIG. 8.
Figure 11:
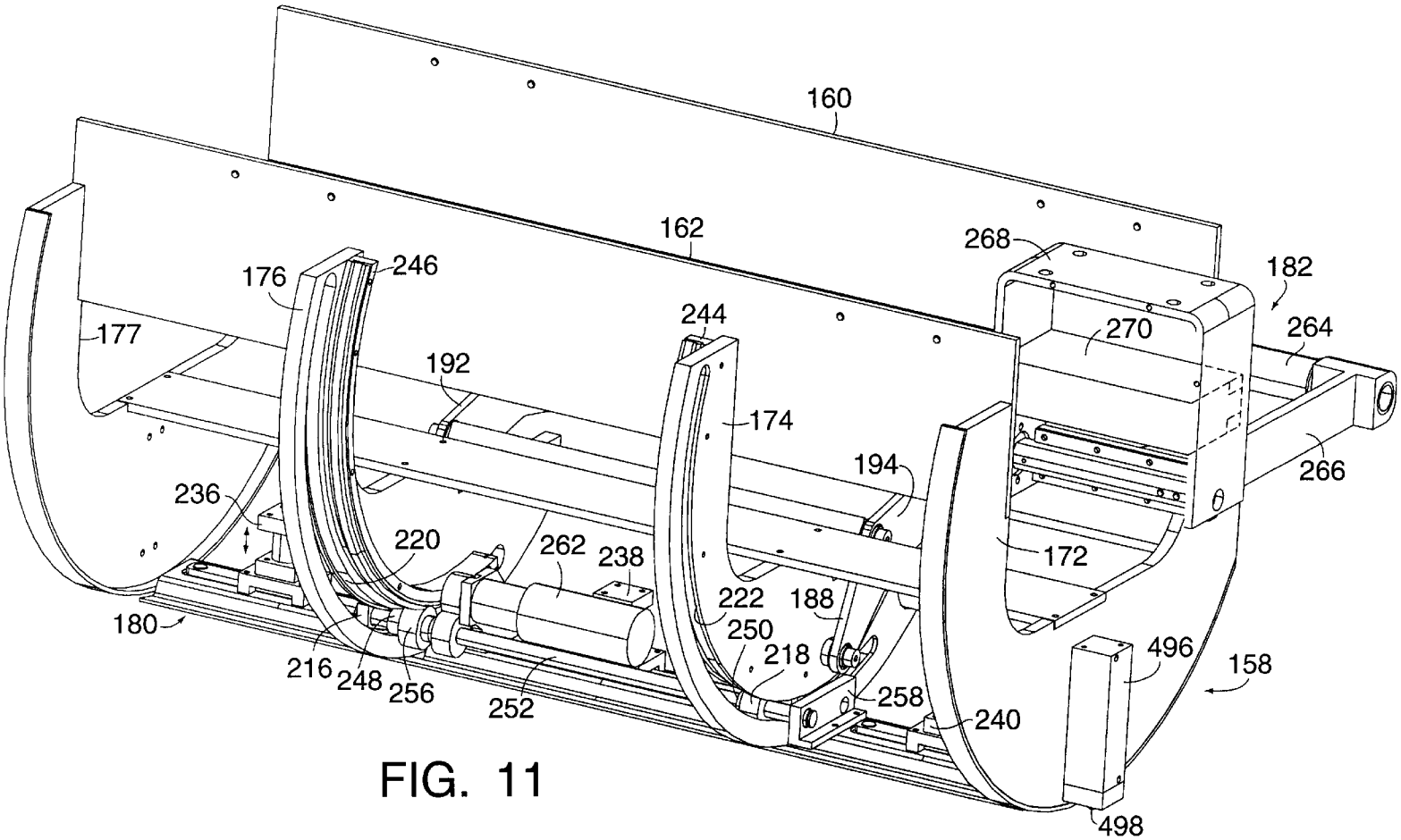

With reference to FIG. 8–11, the load shoe assembly 30 is mounted for movement along the rails 36, 38. A load shoe 158 is coupled to the rails 36, 38 via load shoe track bearing support plates 160, 162, which carry rollers 164, 166 positioned within tracks 168, 170 that are mounted to the rails 36, 38. With particular reference to FIGS. 10 and 11, the load shoe 158 includes four generally U-shaped, load shoe plates 172, 174, 176, 177 attached to the load shoe track bearing support plates 160, 162. Two of the load shoe plates are end plates 172, 177 and two of which are inner plates 174, 176. A leading edge pickup assembly 178 is coupled to the load shoe 158, as are a trailing edge pickup assembly 180, and a roller assembly 182 for rolling a media plate onto the load shoe, as described below.

The leading edge pickup assembly 178 includes a leading edge pickup bar 184, which is coupled to the two inner plates 174, 176 via a four bar linkage. The linkage includes a pivot plate 186, which is rotatably mounted to the inner plates 174, 176, and two pivot arms 188, 190, with one end of each arm rotatably mounted to the inner plates. A pair of pivot supports 192, 194 are coupled to one another by a pivot support plate 196, and the pivot supports in turn are coupled to the other ends of each pivot arm 188, 190 and to the pivot plate 186. A leading edge pickup servomotor 198 is mounted to the inner plate 174 and is controlled by the controller 21 (FIG. 1) for rotatably driving the pivot plate 186, to extend or retract the pleading edge pickup bar 184, as is also described below.

Figure 17:
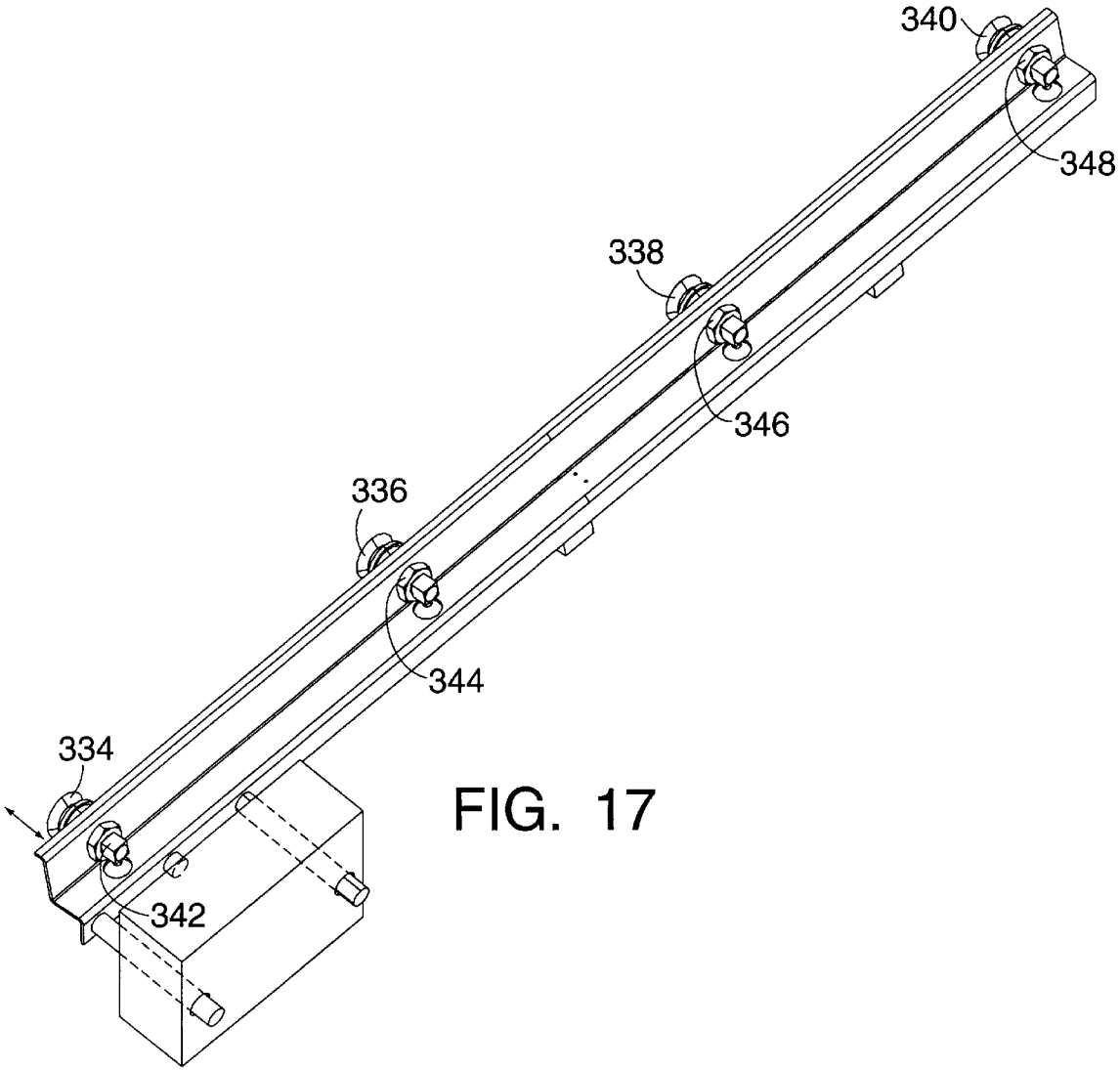
FIG. 17 is a perspective view of a leading edge pickup assembly of the unload shoe of FIGS. 15 and 16.
Figure 18:
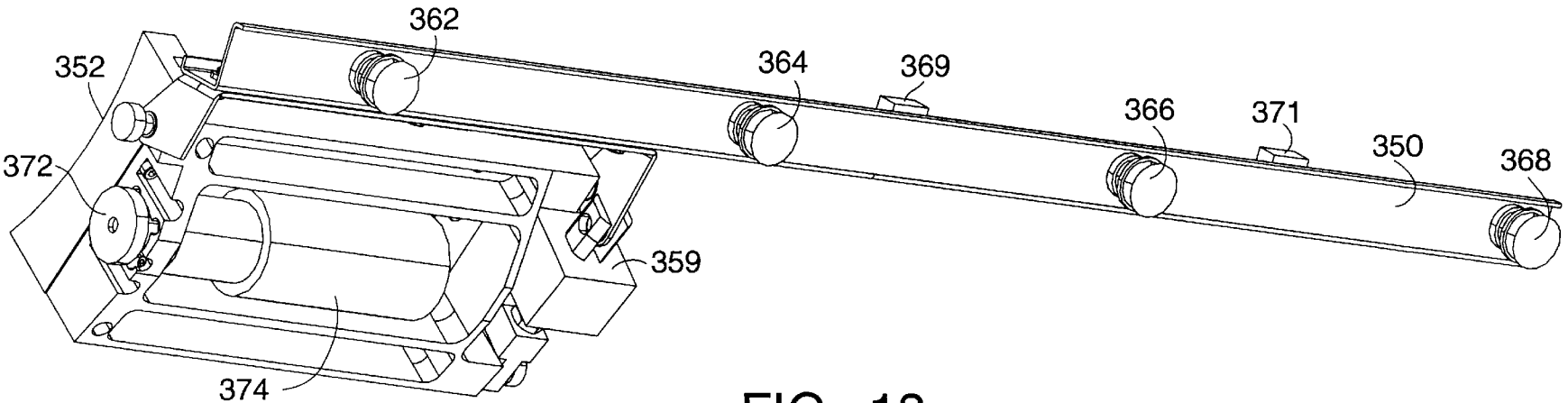
FIG. 18 is a perspective view of a trailing edge pickup assembly of the unload shoe of FIGS. 15 and 16.
Figure 19:
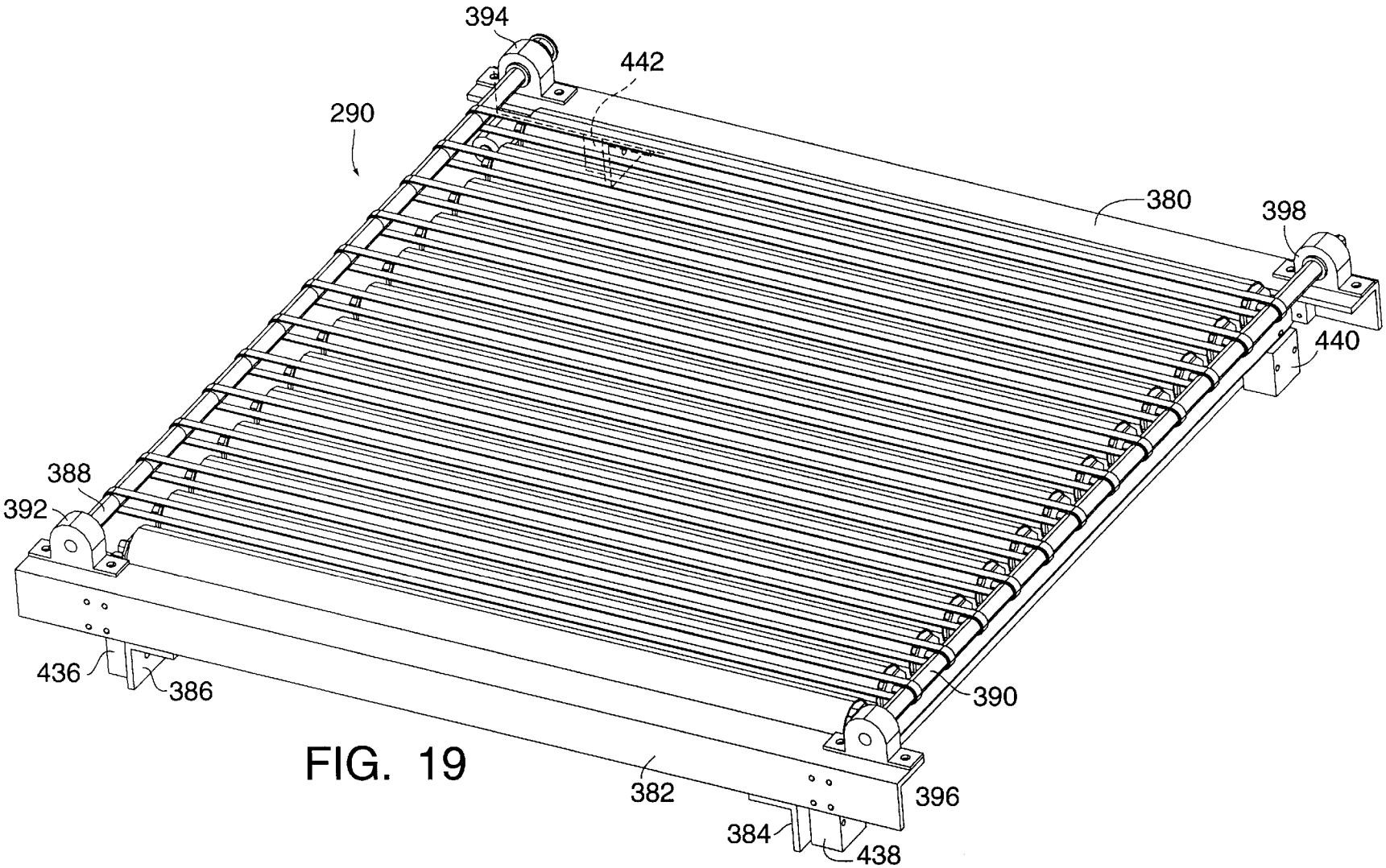
FIG. 19 is a perspective view of the conveyor assembly of the unload module, illustrating a belt assembly and a roller assembly of the conveyor.
Figure 20:
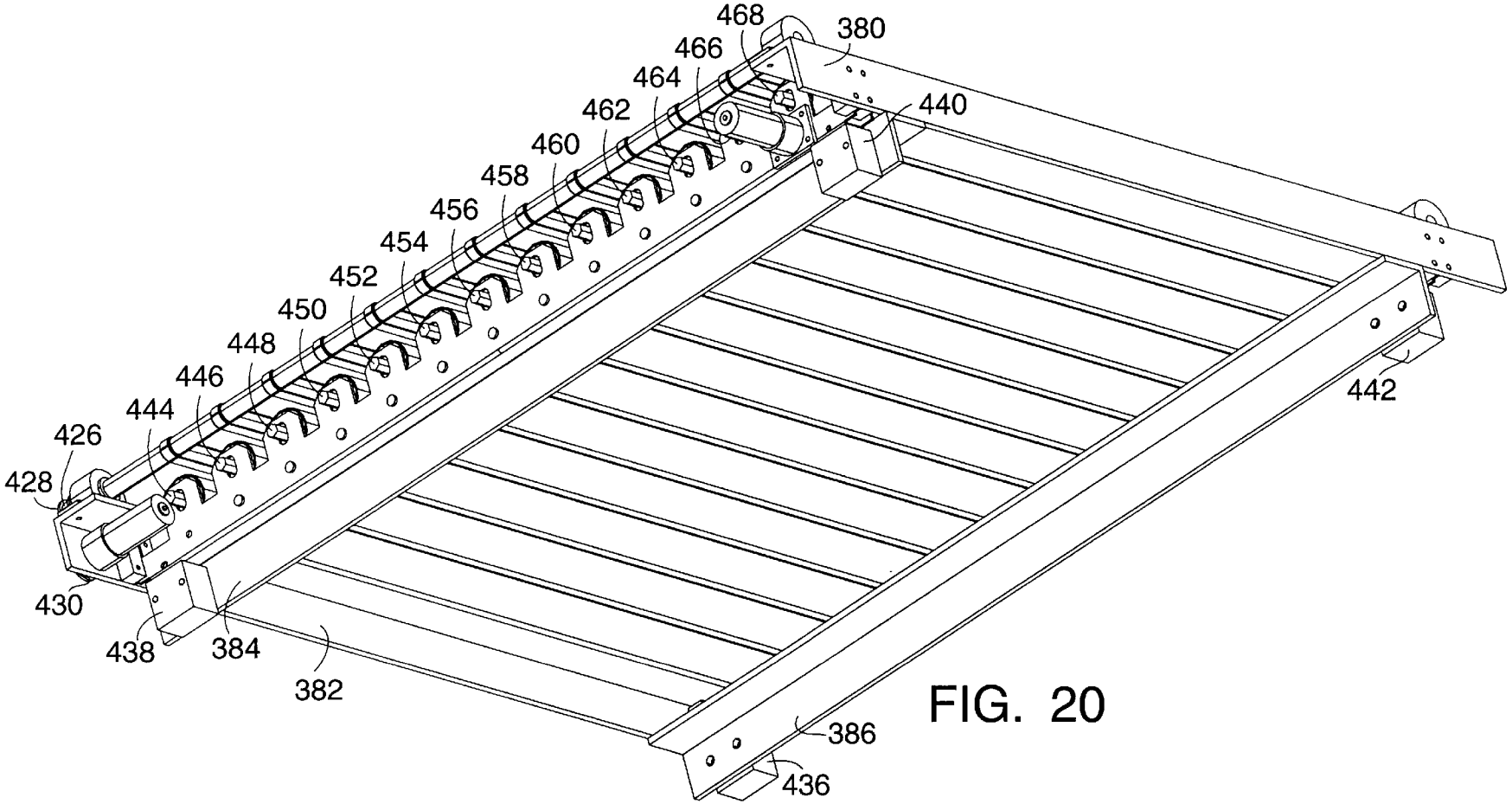
FIG. 20 is a perspective view of the underside of the conveyor assembly of FIG. 19.

The leading edge pickup bar 178 carries a number of suction cups 200, 202, 204, 206, 208, 210, 212, each of which includes a check valve coupled to a common vacuum source via air lines (not shown). The leading edge pickup bar 178 is movable generally between a retracted position (shown generally in FIGS. 8–11), in which the bar is positioned adjacent to the outer edge of the U-shaped members 172–178, and an extended position (the bar is shown almost in a fully extended position in dashed lines in FIG. 9), in which the pickup bar 178 and suction cups are extended and positioned on the media plate which is to be loaded into an imaging device. Depending upon the particular geometry of the four bar linkage, it may also be desirable to provide for additional rotational and translational movement of the leading edge pickup bar 178 by mounting the bar to the free ends of the pivot supports 192, 194 using air cylinders 179, 181 (FIG. 8 and to drive an assembly similar to the assembly described below for the trailing edge pickup of the unload assembly (FIG. 17).

The trailing edge assembly 180 of the load shoe 150 includes a trailing edge pickup bar 214, which is coupled to bearing pads 216, 218 positioned in arcuate channels 220, 222 of the two inner plates 174, 176. The trailing edge pickup bar 214 carries a number of pairs of suction cups 224, 226, 228, 230, 232, 234, which are carried by non-rotating air cylinders 236, 238, 240 mounted to the bar 214. The suction cups are coupled in pairs to a common vacuum source via respective solenoids 235, 237, 239 and air lines (not shown), similar to the solenoids used on the top paper removal subassembly described above. The air cylinders are coupled to a common air source via one or more solenoids (not shown). The trailing edge pickup bar 214 is movable generally between a retracted position (shown generally in FIGS. 8–11), in which the bar is positioned adjacent to the outer edge of the U-shaped members 172–178, and an extended position 242 (shown in dashed lines in FIG. 9), in which the pickup bar 214 and suction cups are extended and positioned on a media plate to be gripped and loaded into an imaging device, so that the trailing edge pickup bar 214 can grab and retain a media plate, and position and release a media plate within the internal drum of the imaging device, as described further below.

In order to accommodate different sized media plates, and as needed to properly position the leading edge of a retained media plate in the internal drum, the trailing edge pickup bar 214 is mounted for movement along the outer edges of the U-shaped members 172–177. As noted above, the trailing edge pickup bar 214 is supported by bearing pads 216, 218 for movement in the arcuate channels 220, 222. A pair of arcuate tracks 244, 246 are mounted to the inner U-shaped plates 174, 176, and a pair of pinion gears 248, 250 are driven by a trailing edge drive shaft 252. The shaft 252 is mounted to shaft blocks 254, 256 and shaft support plates 258, 260 and a trailing edge servomotor 262 drives the shaft under the direction of the controller 21, as described further below.

The roller assembly 182 wraps a media plate M onto the load shoe after the leading edge of the plate is grabbed by the leading edge pickup bar 178. The roller assembly 182 includes a roller 264, which extends along the length of the load shoe 158, and is rotatably mounted on one portion of an L-shaped roller swing arm 266. The arm 266 in turn is mounted to a roller assembly support bracket 268 for rotation relative to the remainder of the load shoe, to wrap a media plate onto the trailing edge pickup assembly 180 and retain the media plate for loading into the imaging device. A roller servomotor 270 (shown schematically), which drives the roller arm, is mounted to the roller assembly support bracket 268 and is coupled to the controller 21. As the roller 264 wraps a media sheet onto the load shoe, the media plate rests against wear strips 272, 274 positioned along the outer edges of the outer plates 172, 177.

Figure 12:
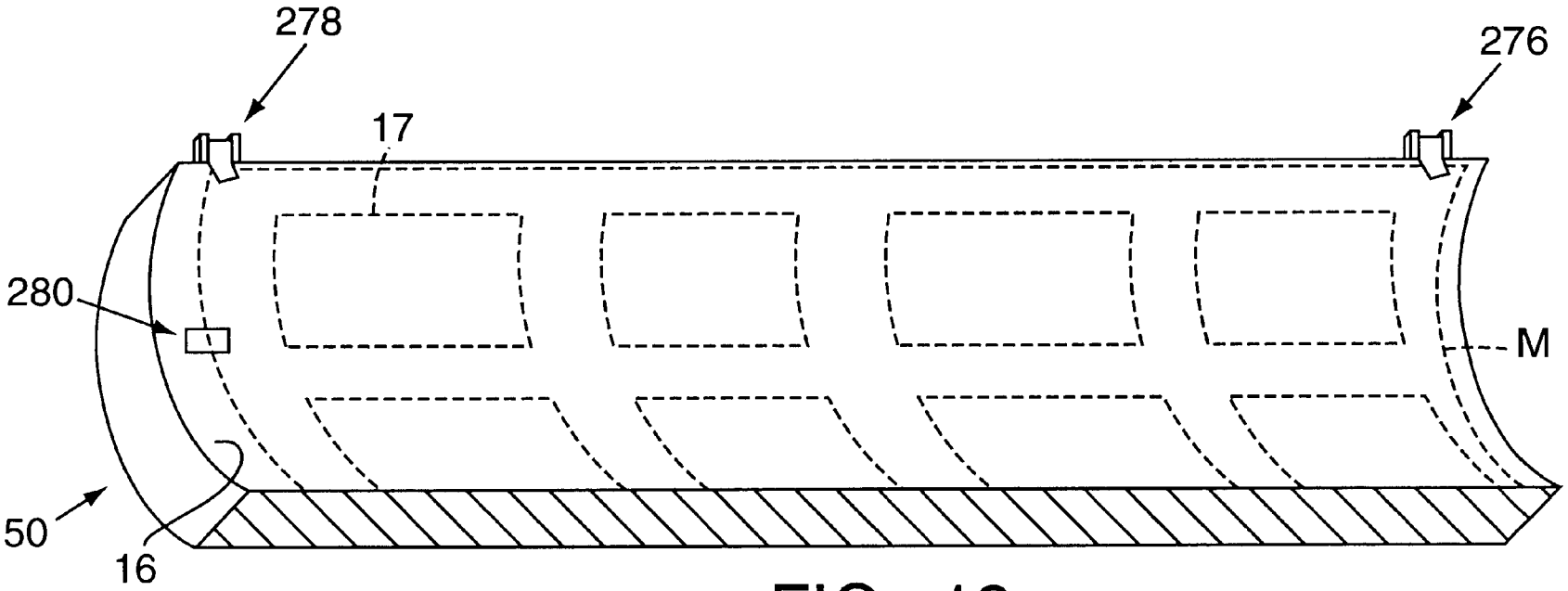
FIG. 12 is a cut-away perspective view of an internal drum of the imaging device of FIG. 1.

With reference to FIG. 12, a pair or more of docking sensors 276, 278, also shown and described in the "Media Feed Apparatus For An Imaging Device" are positioned along the portion of the internal drum corresponding to the leading edge of the media plate, and another sensor 280 is positioned along the front edge of the drum, i.e., the edge of the plate at which imaging commences. The load shoe 158 then loads a media plate grabbed from the cassette into the internal drum under the direction of the controller, as is described further below.

Figure 13:
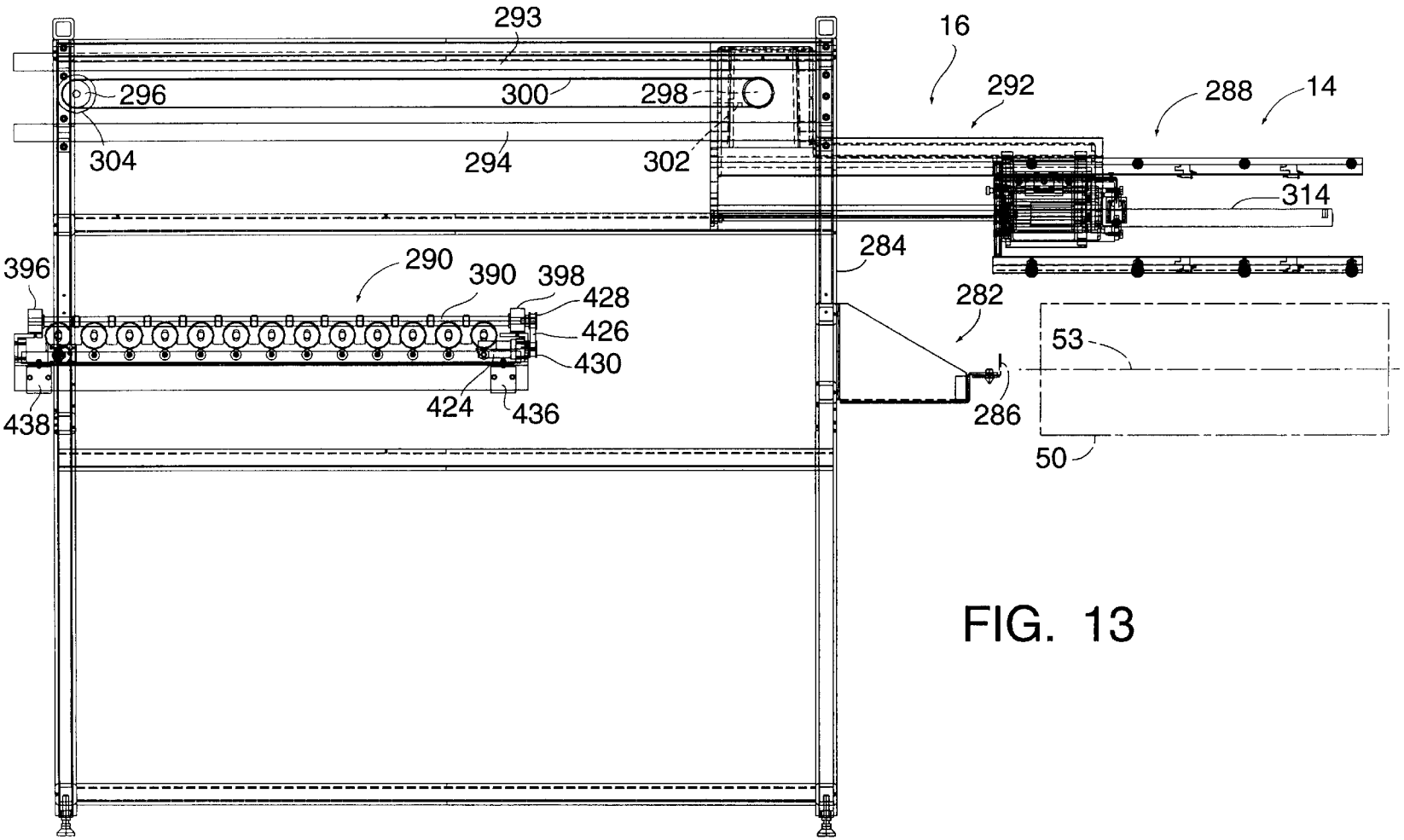
FIG. 13 is a side view of the media unload module of FIG. 1, illustrating an unload shoe assembly for removing imaged media plates from the imaging apparatus, and a conveyor assembly for distributing unloaded, imaged media plates to other apparatus for further processing.
Figure 14:
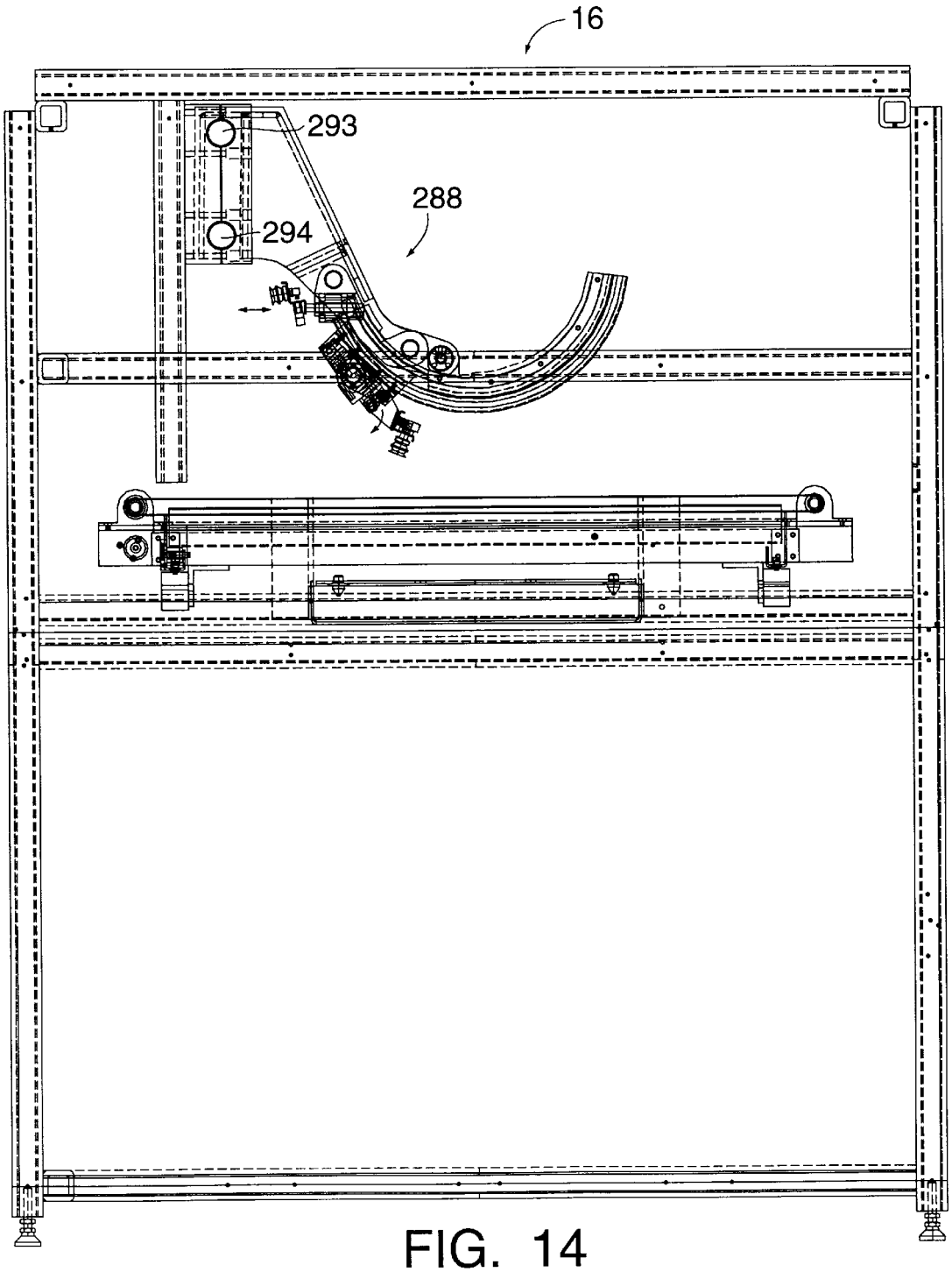
FIG. 14 is a left end view of the media unload module of FIG. 13.
Figure 15:
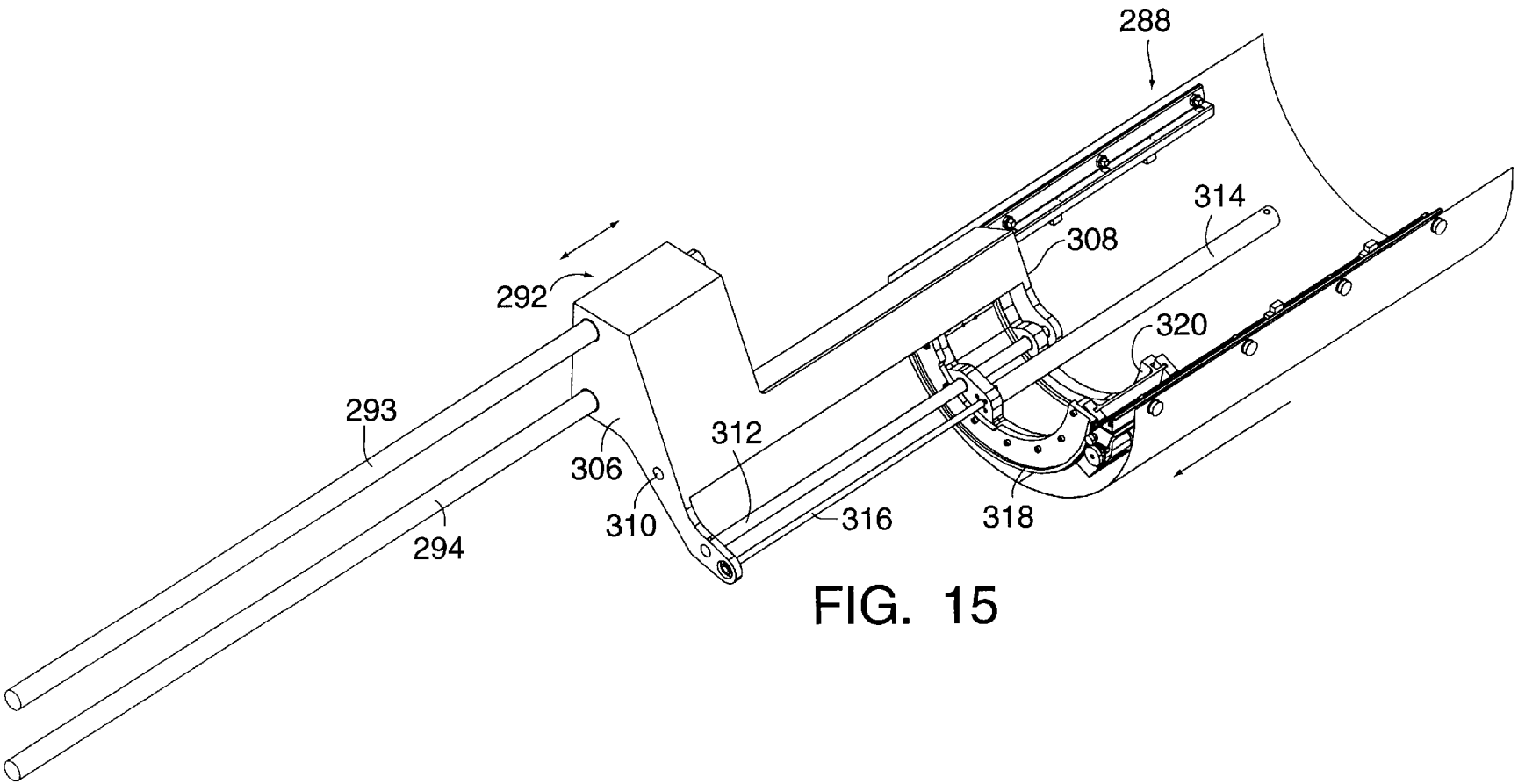
FIG. 15 is a perspective view of an unload shoe of FIGS. 13 and 14, illustrating the unload shoe mounted for movement along a slide assembly.
Figure 16:
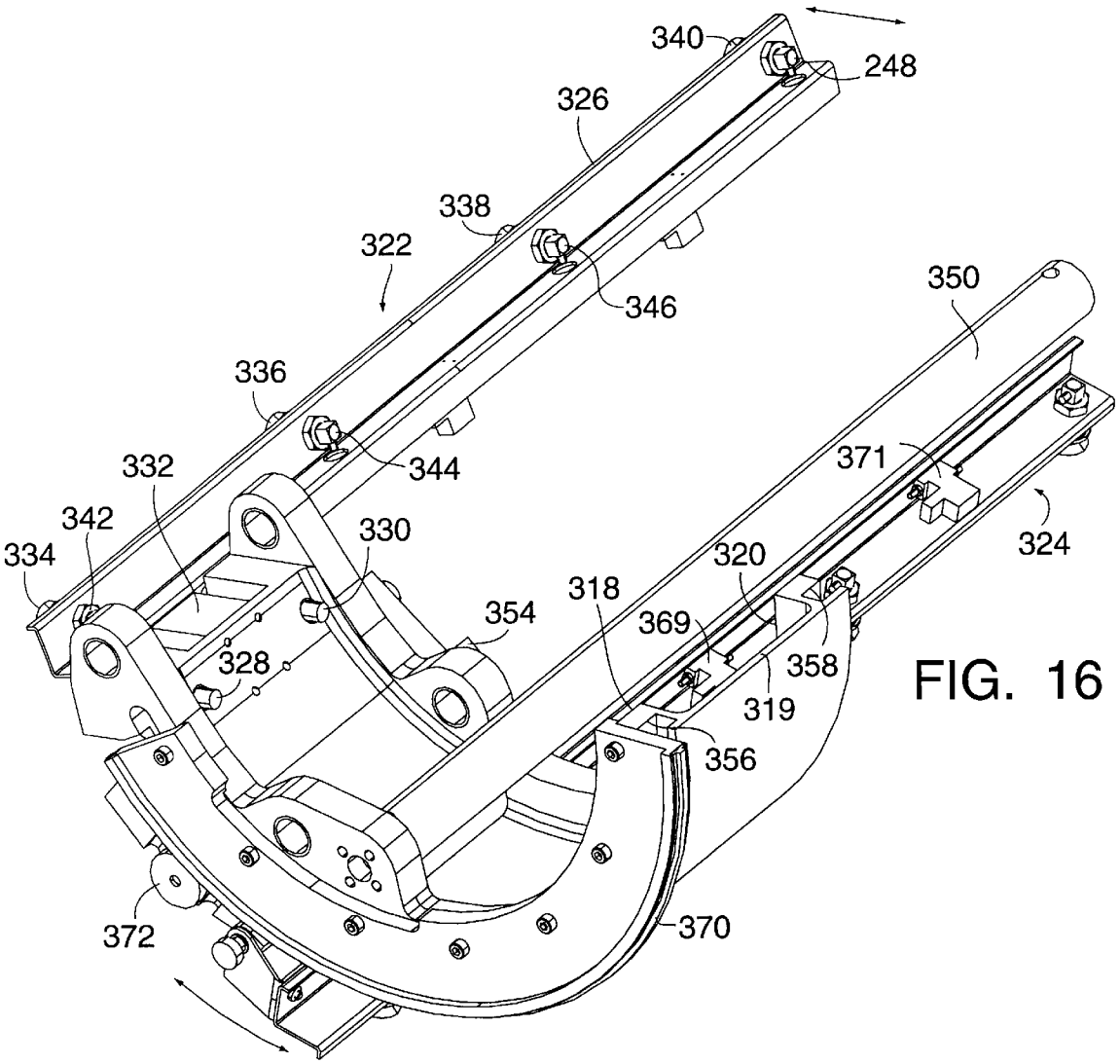
FIG. 16 is a perspective view of the assembly of FIG. 15, illustrating the unload shoe removed from the slide assembly.

Turning now to FIGS. 13 and 14, the media unload module 16 removes an imaged media plate from the imaging device after completion of an imaging operation, and then transfers the plate to one or more work stations where the imaged plates are processed further. A registration bracket 282 with pins is attached to a frame 284 of the unload module, and cooperates with a corresponding registration flange 286 attached to the frame (not shown) of the imaging device, to enable registration of the unload module 16 (FIG. 1) and the imaging device 14 (FIG. 1).

The unload module 16 also includes an unload shoe assembly 288, which actually removes imaged plates from the internal drum of the imaging device, and a multi-directional conveyor assembly 290, which transfers the removed plates to other apparatus for further processing, e.g., development of the image or images. The unload shoe assembly 288, described further below, is mounted to a slide assembly 292 for movement relative to the frame 284 along rails 293, 294 which are attached to the frame. A pair of pulleys 296, 298 are mounted to one of the rails, and a toothed drive belt 300 extends around the pulleys. The slide assembly 292 is coupled to the belt 300 by a belt clamp 302, and a slide servomotor 304 drives one of the pulleys. Thus, actuation by the controller of the slide servomotor in one direction or the other rotates the pulleys and drives the slide and unload shoe assemblies 288, 292 in a direction parallel to the drum axis 53 and generally between the internal drum 50 of the imaging device 14 and the multi-directional conveyor assembly 290 of the unload module 16.

With reference to FIGS. 15–18, the slide assembly 292 includes a slide carriage, one end 306 of which is mounted to the rails 293, 294 and the other end 308 of which carries the unload shoe assembly 288. The unload shoe is also coupled to the slide assembly for movement along an additional set of rails 310, 312 by an air cylinder 314, which is attached to the unload shoe, and a cooperating shaft 316, the free end of which is coupled to the end 306 of the slide assembly. The air cylinder is coupled to an air source through one or more solenoids (not shown), to drive the unload shoe between an extended position (FIG. 13), in which the unload shoe may be positioned within an internal drum 50 of the imaging device, and a retracted position (illustrated in dashed lines in FIG. 13 and by the arrow below the unload shoe in FIG. 15) in which the unload shoe is positioned generally over the conveyor assembly 290.

The unload shoe 288 includes two generally U-shaped, unload shoe plates 318, 320, which are attached to a common plate 319 and coupled to the other end 308 of the slide assembly 292. A leading edge pickup assembly 322 is coupled to the unload shoe 288, as is a trailing edge pickup assembly 324.

The leading edge pickup assembly 322 includes a leading edge pickup bar 326, which is coupled for movement toward and away from the common plate 319 by a pair of posts 328, 330 mounted for linear movement to the common plate. A leading edge pickup air cylinder 332 is coupled to an air source through one or more solenoids (not shown), and is mounted between the common plate 319 and the leading edge pickup bar 326. The controller 21 controls actuation of the air cylinder 332, and drives the pickup bar 326 to extend or retract the leading edge pickup bar 184, as is described below.

The leading edge pickup bar 326 carries a number of suction cups 334, 336, 338, 340, each of which is coupled to a vacuum source (not shown) by respective solenoids 342, 344, 346, 348. As noted above, the leading edge pickup bar 326 is movable generally between a retracted position (shown generally in FIGS. 15 and 16), in which the bar is positioned adjacent to the outer edge of the U-shaped members 318, 320, and an extended position (FIG. 17), in which the pickup bar and suction cups are extended and positioned against a media plate which is positioned in the internal drum and is to be gripped and unloaded.

The trailing edge assembly 324 includes a trailing edge pickup bar 350, which is coupled to bearing pads 352, 354 positioned in arcuate channels 356, 358 of the two plates 318, 320 via an air cylinder 359. The air cylinder 359 are coupled to a common air source via one or more solenoids (not shown). The trailing edge pickup bar 324 carries a number of suction cups 362, 364, 366, 368, which are coupled to a common vacuum source (not shown) via respective solenoids 369, 371 similar to the solenoids described above in connection with the trailing edge pickup assembly and the top paper removal subassembly of the load shoe. The trailing edge pickup bar 368 is movable generally between a retracted position (shown generally in FIGS. 15 and 16), in which the bar is positioned adjacent to the outer edge of the U-shaped members 318, 320, and an extended position, in which the pickup bar and suction cups are extended and positioned against a media plate to be gripped and unloaded from an imaging device.

In order to accommodate different sized media plates, but more importantly as needed to secure a retained media plate against the outer edges of the U-shaped members 318, 320 and to properly position an imaged plate on the conveyor assembly 290, the trailing edge pickup bar 350 is mounted for movement along the outer edges of the U-shaped members. As noted above, the trailing edge pickup bar 350 is supported by bearing pads 352, 354 for movement in the arcuate channels 356, 358. An arcuate track 370 is mounted to one of the plates 318, and a cooperating pinion gear 372 is driven by a trailing edge servomotor 374 that is operated under the direction of the controller 21, as described further below.

With reference now to FIGS. 19–22, the multi-directional conveyor assembly 290 transfers imaged media plates from the unload shoe 288 (FIGS. 13–15) to other conveyors 18, 20 (FIG. 1), for subsequent processing of the imaged plates. The conveyor assembly 290 may be pivotally attached to the frame 284 of the unload module 16 (FIGS. 13 and 14), so that the assembly may be moved out of the way from the side of the imaging device in the event that access to the imaging device is warranted. The conveyor assembly 290 includes a belt assembly 376 (FIG. 21) for moving imaged media plates in one of two parallel directions, and a cooperating roller assembly 378 (FIG. 22) for moving imaged media plates in one of two additional direction, which in the illustrated embodiment are perpendicular to the belt directions. Both the belt assembly and the roller assembly are mounted to a common frame including parallel conveyor assembly brackets 380, 382, 384, 386.

Figure 21:
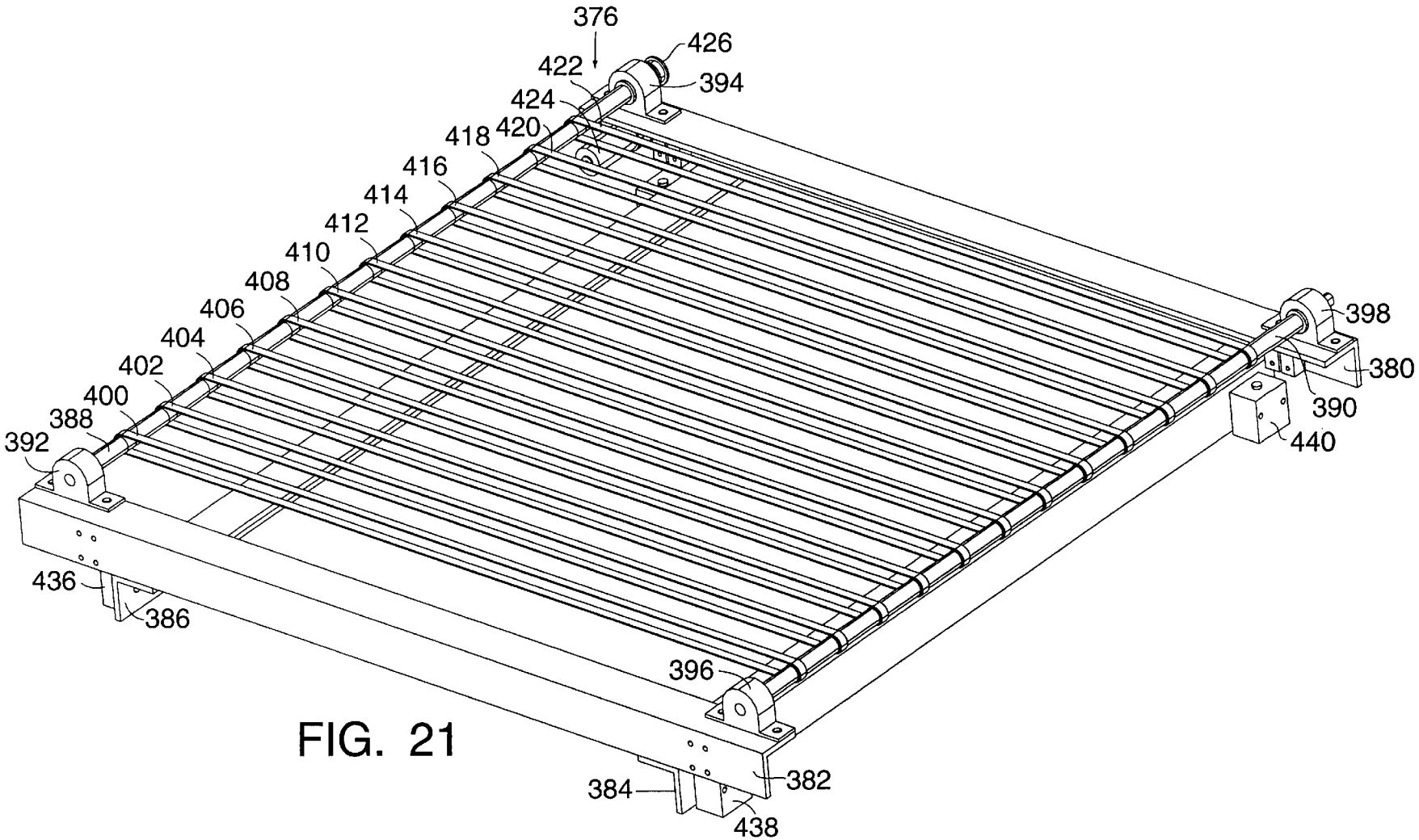
FIG. 21 is a perspective view of the belt assembly of FIGS. 19 and 20.

As indicated in FIG. 21, the belt assembly 376 includes a pair of crown shafts 388, 390, each of which is mounted for rotation to a respective pair of pillow blocks 392, 394, 396, 398. The blocks 392, 394, 396, 398 in turn are mounted to the frame of the conveyor assembly. Several belts 400–422 are mounted for common rotation on the crown shafts, and one of the shafts is driven by a belt servomotor 426 via a belt 424 and pulleys 428, 430 (FIG. 13) mounted to the motor and one crown shaft. As is the case with the other servomotors, the belt servomotor 426 is actuated as needed under the direction of the controller 21.

Figure 22:
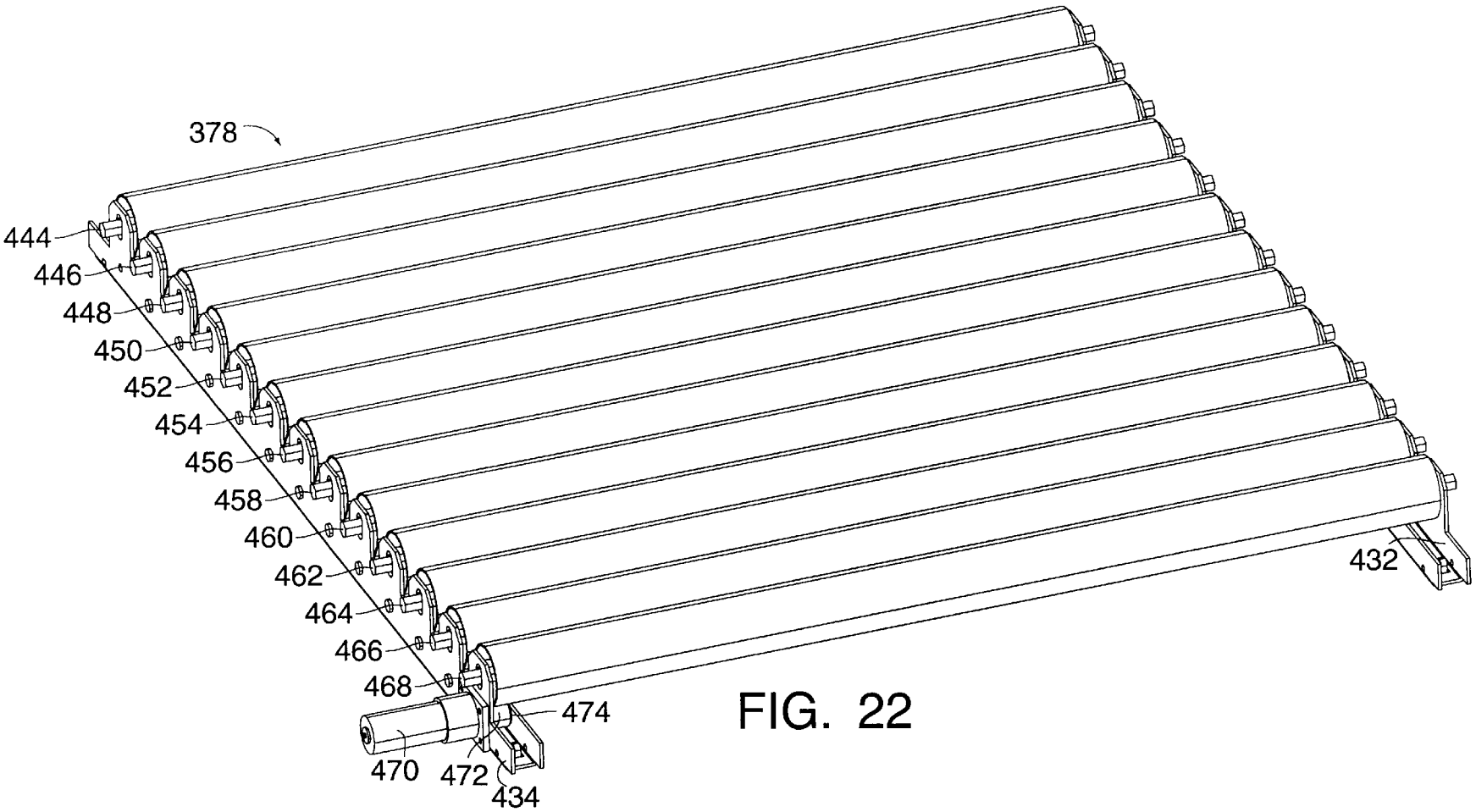
FIG. 22 is a perspective view of the roller assembly of FIGS. 19 and 20.

As indicated in FIG. 22, the roller assembly 378 includes end plates 432, 434 (FIG. 22), which are raised and lowered relative to the frame and belt assembly by air cylinders 436, 438, 440, 442 mounted to the frame brackets. The air cylinders are connected through air lines and a common solenoid valve (not shown) to an air source, with the solenoid being actuated by the controller as needed, depending upon the direction in which the imaged plate needs to be moved, as is described below. When the air cylinders are actuated, the rollers protrude through the openings between the belt assembly. The end plates 432, 434 each define a number of slots, and a corresponding number of rollers 444, 446, 448, 450, 452, 454, 456, 458, 460, 462, 464, 466, 468 are mounted in the slots. A roller servomotor 470 is mounted to one of the end plates, and is operated under the direction of the controller to drive a belt 472 which passes over pulleys 474 (one shown). The rollers rest on and are driven by the belt.

Figure 24:
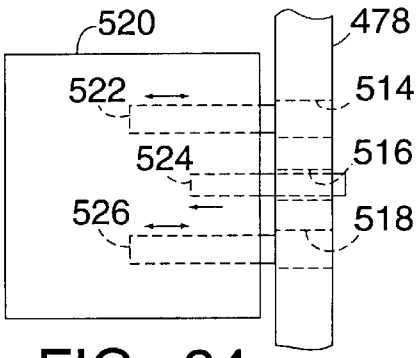
FIG. 24 is a schematic, top view of the cassette of FIG. 23, illustrating the cooperation between a media indicating mechanism of the cassette and a reader for reading the media indicating mechanism.
Figure 23:
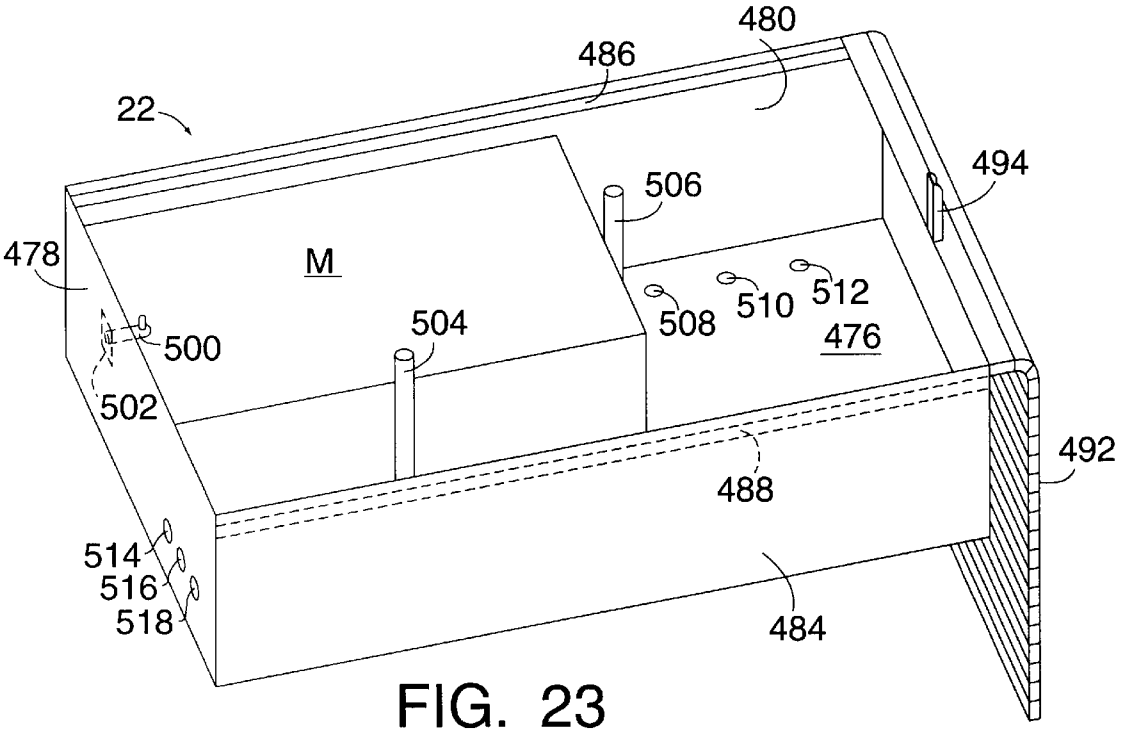
FIG. 23 is a perspective view from the front of the cassette of FIGS. 2 and 3.

A cassette 22 is illustrated in FIGS. 23 and 24, and as noted above contains one or more media plates M separated by interleaves, which are typically paper or similar material. The cassette 22 has a bottom 476 and sides 478, 480, 482, 484 which form an open top box. The sides 480, 484 each define respective grooves 486, 488. A tambour 492, e.g., a cover including a number of flexibly connected slats, serves as the top of the cassette and is received in the grooves. A handle 494 of the tambour cooperates with an air cylinder 496 and tambour shaft 498 (FIGS. 2, 3, 8 and 10) which are mounted to the rear of the load shoe 158. The air cylinder is coupled to an air source through a solenoid and air lines (not shown) and is actuated by the controller. When extended, the tambour shaft 498 engages the handle 494 as the load shoe 158 is moved from the internal drum and toward the cassette, i.e., from the left to the right as viewed in FIG. 2, in order to open the tambour after a cassette is loaded into the load module. The top may initially be locked in a closed position by a spring loaded plunger 500 or similar mechanism which latches to the top. Upon loading a cassette into the load module, the plunger 500 abuts a plate 502 mounted to the load module and is depressed, to unlock the tambour.

In FIG. 23, a stack of media plates M is positioned within the cassette by sides 478, 480 and adjustable stack posts 504, 506. The posts are mounted to the bottom 476 of the cassette, and are adjusted relative to the bottom in the same manner as the corresponding members mounted to the media support platform of the above-noted "Media Feed Apparatus For An Imaging Device". A number of holes 508, 510, 512 (only three shown) are also provided on the bottom 476 of the cassette, and correspond to the position of the cups of vacuum pickup bar of the top paper removal subassembly. When the cups abut the holes 508, 510, 512, the check valves are not opened, and the controller then determines that the cassette is empty.

As shown in FIGS. 23 and 24, the cassette 22 also includes media indicating apertures 514, 516, 518, which are either open or closed to convey particular information concerning the media contained in the cassette. The media indicating apertures are preferably used to indicate the size of the media plates, although other information may also be indicated. A reader 520 (see also FIG. 2) includes a corresponding number of spring loaded fingers 522, 524, 526 coupled to the controller 21 (FIG. 1). When the cassette is loaded into the load module, the apertures are registered with a reader 520 (see also FIG. 2), and the fingers 522, 526 are depressed into the reader 520 or remain extended and project through an open aperture. The controller then determines the size of the media plates M depending upon which fingers are depressed and which fingers remain extended.

Figure 25:
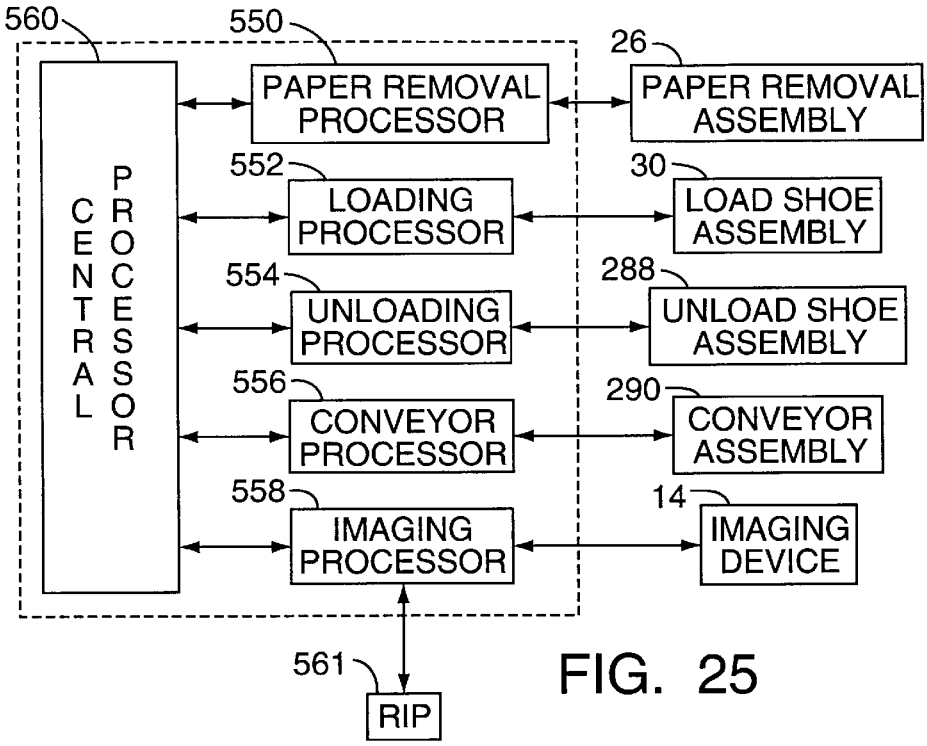
FIG. 25 is a schematic functional diagram of the media transport apparatus for the imaging device of FIG. 1.

As noted above, the media transport apparatus 10 includes a controller 21, shown also in FIG. 25, that controls the operation of each of the assemblies of the transport apparatus and the imaging device in accordance to an algorithm. The controller includes a paper removal processor 550 for controlling the operation of the paper removal assembly 26, a loading processor 552 for controlling the operation of the load shoe assembly 30, an unloading processor 554 for controlling the unload shoe assembly 288, a conveyor processor 556 for controlling the operation of the conveyor assembly 290, and an imaging processor 558 for controlling the operation of the imaging device 14. The controller 21 further includes a central processor 560 that coordinates the operation of each of the assemblies.

The imaging device 14 and its operation is similar to the imaging device shown and described in the "Media Feed Apparatus For An Imaging Device", which is incorporated herein by reference. The imaging processor receives a modulated signal from the raster imaging processor (RIP) 561 representative of the image to be scanned. The imaging processor, in response to the modulated signal and imaging information provided by the central processor, positions optical lens for focusing an imaging beam, moves the imaging carriage along a spar, and energizes beam generators for providing the modulated imaging beam to expose the media plate M.

Figure 26:
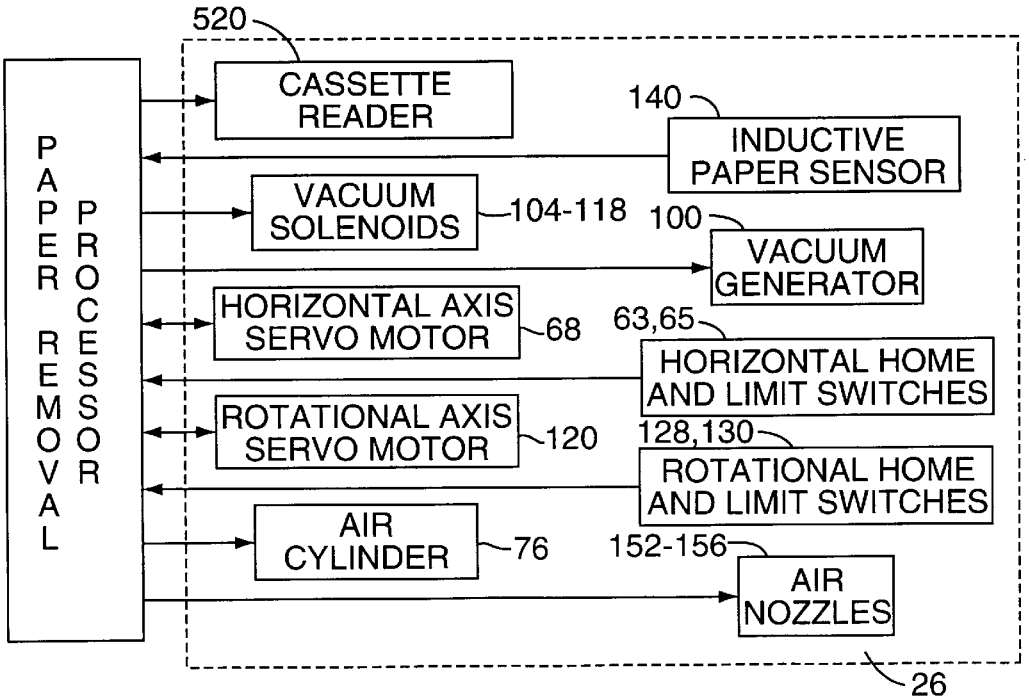
FIG. 26 is a schematic functional diagram of the paper removal assembly of the media transport apparatus of FIG. 25.

As shown in FIG. 26, the paper removal processor 550 controls the operation of the horizontal and rotational axis servo motors 68,120 in accordance to a paper detection and removal algorithm. The rotational and horizontal home and limit switches 128,130, 63,65 provide feedback to the processor 550 of the initial positions of the vacuum bar 51 and the lower carriage 60. The processor 550 further provides signals to a vacuum generator 100 and a predetermined number of solenoid valves 104–118 for selectively providing vacuum pressure to the suction cups 82,82,82, 84–98 in response to a signal provided by the inductive paper sensor 140, indicating the presence of paper. The processor 550 also provides a signal to actuate the air nozzles 152–156 to remove any paper adhered to the bottom surface of the media plate M when the leading edge is lifted.

Figure 27:
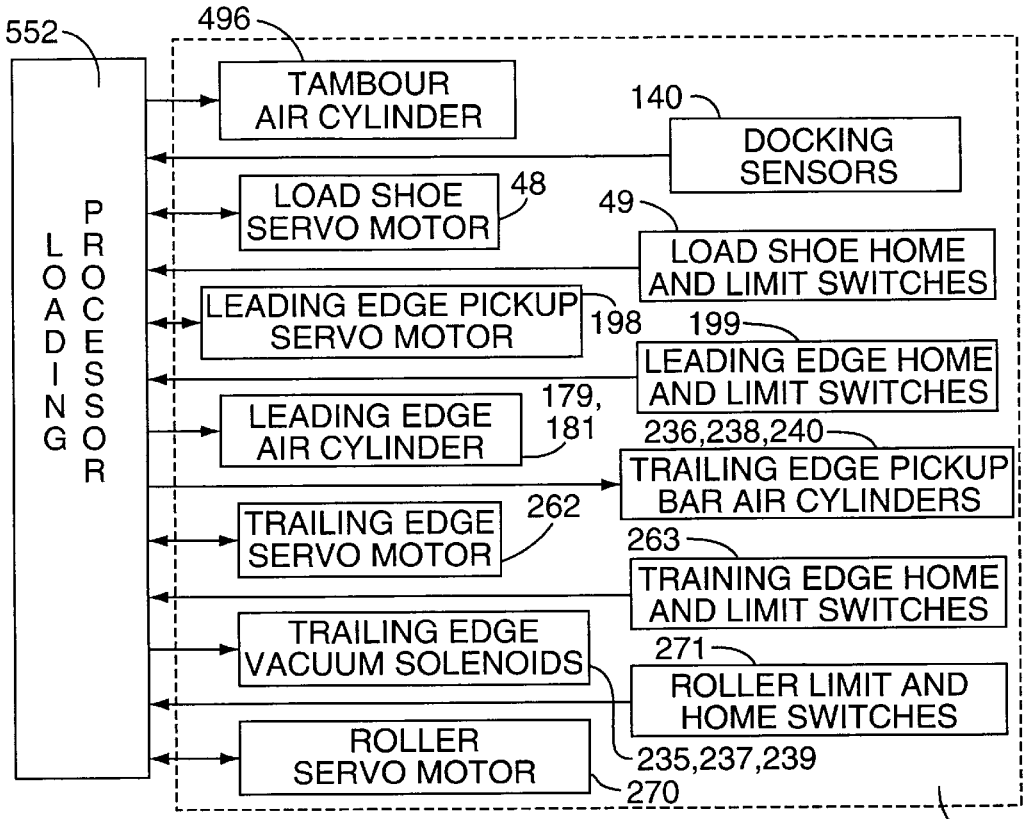
FIG. 27 is a schematic functional diagram of the load shoe assembly of the media transport apparatus of FIG. 25.

As shown in FIG. 27, the loading processor 552 provides control signals to the load shoe assembly 330 for securing a media plate M to the load shoe 158, transporting and docking the media plate to the internal drum 50, and opening the media cassette 22. In the operation of opening the cassette, the controller 21 actuates the tambour air cylinder 496 for engaging the cover of the cassette and provides signals for driving the load shoe servo motor 48 to open and close the cover. In the operation of securing the media plate M to the load shoe 158, the controller 21 provides signals to drive the leading edge pickup servo motor 198 and leading edge air cylinders 179,181 for pivoting the leading edge pickup bar 184 to engage and lift the leading edge of the media. The leading edge pickup servo motor 198, limit switch and home switches 199 provide position feedback of the leading edge pickup bar to the controller. The controller also provides a signal to drive the trailing edge servo motor 262 for positioning the leading edge pickup bar 184 along the load shoe 158 and docking of the media plate M onto the internal drum, in response to feedback signal generated by the trailing edge servo motor, home and limit switches, and the docking sensors 276,278. Furthermore, the controller 21 provides signals to actuate the trailing edge air cylinders 236,238,240 for lowering the media plate onto the internal drum surface during the docking procedure, and signals to actuate a predetermined number of trailing edge solenoids 235,237,239 to engage the media plate.

Figure 28:
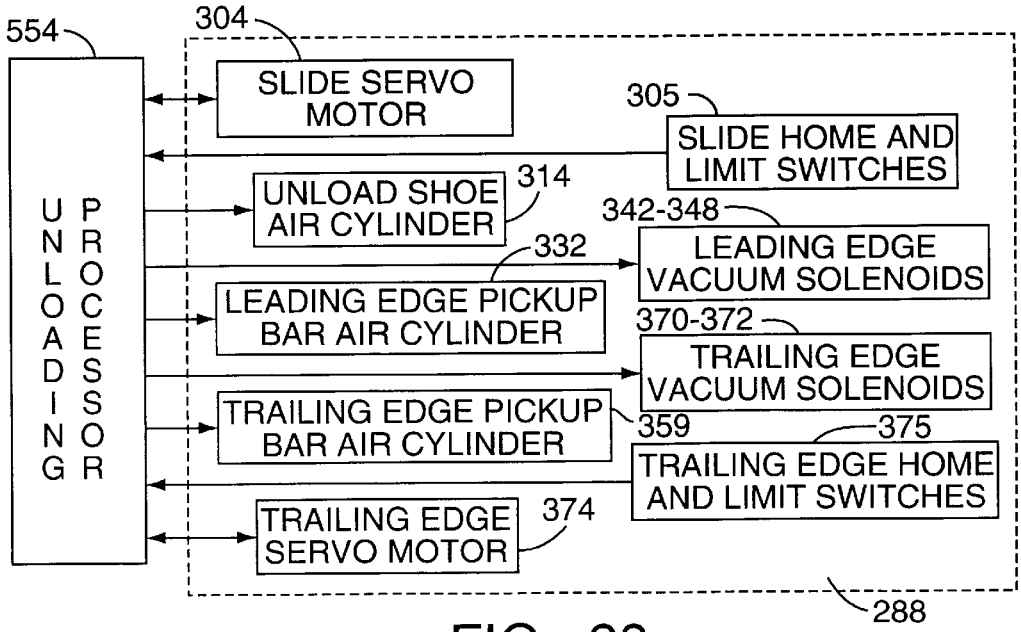
FIG. 28 is a schematic functional diagram of the unload shoe assembly of the media transport apparatus of FIG. 25.

As shown in FIG. 28, the unload processor 554 provides signals to drive the slide servo motor 304 and actuate the unload shoe air cylinder 314 for inserting and removing the unload shoe assembly 288 into and from the internal drum 50 in response to an unload algorithm. Slide home and limit switches 305 and encoder from the servo motor 304 provide feedback of the position of the slide assembly 292 and unload shoe 288 to the controller. The controller 21 further provides signals to actuate the vacuum solenoids 370,372 disposed on the leading edge pickup bar 326 and trailing edge pickup bar 350. The air cylinders 332,359 of the leading and trailing edge pickup bars are actuated by a signal generated by the controller 21 for extending the bars to the surface of the media plate. The controller also provides a signal to drive the trailing edge pickup bar along the unload shoe 288 in response to a media unload algorithm. The trailing edge servo motor 374 and home and limit switches 375 provide feedback of the position of the trailing edge pickup bar.

Figure 29:
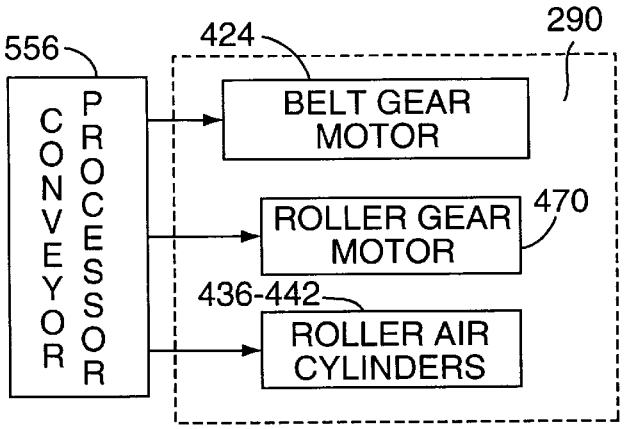
FIG. 29 is a schematic functional diagram of the conveyor assembly of the media transport apparatus of FIG. 25.

As best shown in FIG. 29, the conveyor processor 556 provides a signal to actuate the roller air cylinders 436–442 to lower and raise the engagement surfaces of the rollers 444–468 in response to a conveyor algorithm. The controller 21 also selectively provides a signal to drive either the belt gear motor 424 or the roller gear motor 470 according to the direction of unloading the media plate to the next processing station.

Figure 30:
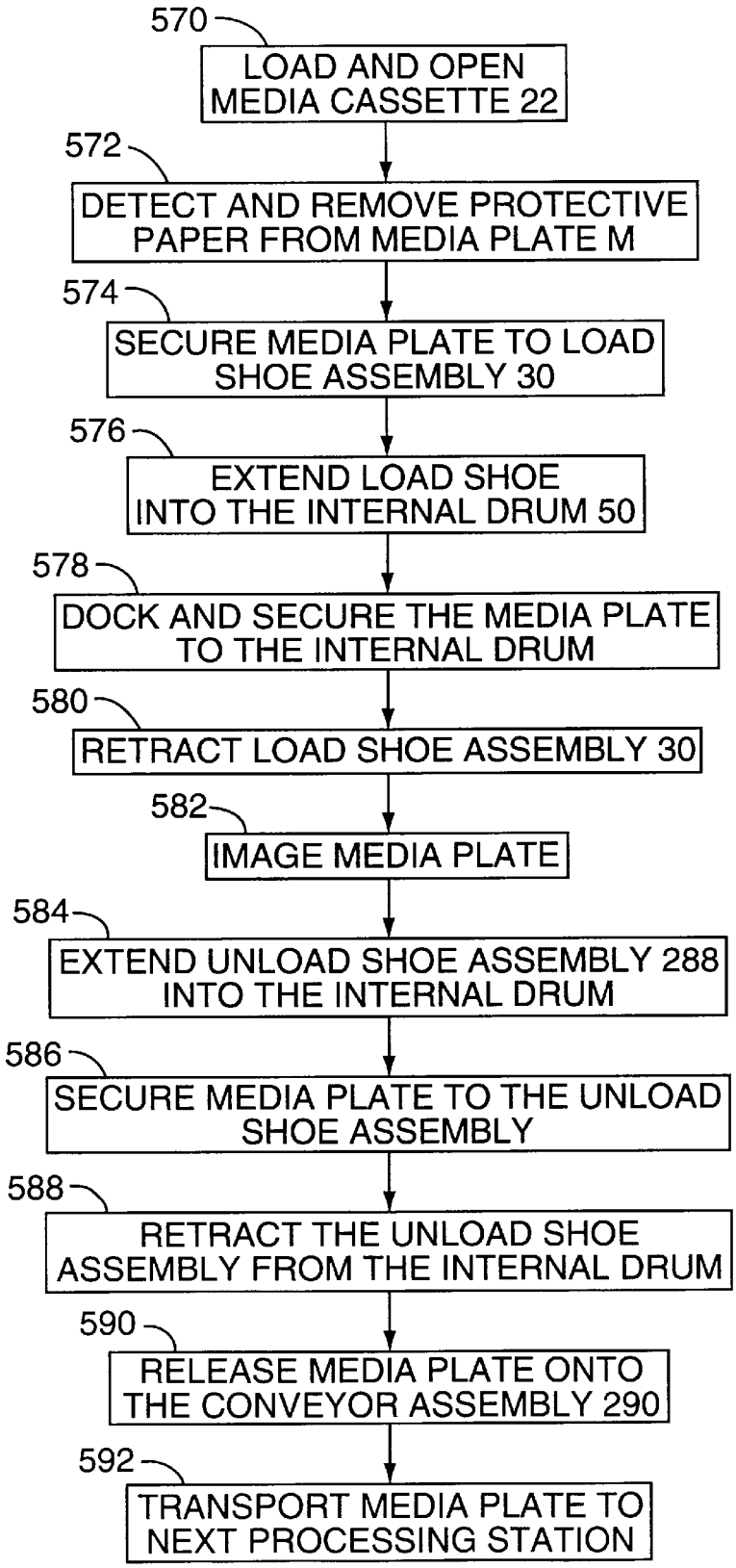
FIG. 30 is a functional diagram of a preferred general sequence of the operations of the media transport apparatus of FIG. 1.

The flow diagram of FIG. 30 illustrates the general operation, shown in blocks 570–592, of automatically preparing and transporting a media plate M to and from the internal drum 50 of an imaging device 14. The media cassette 22 is first loaded within the load module 12 by the operator. The load shoe assembly 30 then engages and opens the handle 494 of the tambour cover 492 of the cassette. The paper removal assembly 26 then contacts the top media plate disposed in the cassette and senses whether a protective sheet of paper is disposed on the upper surface of the plate. If paper is present, the paper removal assembly engages the leading edge of the paper and peels it away.

The load shoe assembly 30 then engages the leading edge and trailing edge of the media plate M and secures it about the support surfaces of the load shoe 158. The load shoe assembly is then extended axially into the internal drum 50 of the imaging device 14 to a predetermined position. The load shoe assembly docks the media plate onto the surface of the internal drum. The load shoe assembly 30 is then retracted from the internal drum. Thereafter, the media plate is imaged.

The media plate M is then removed from the internal drum 50 by the unload shoe assembly 288. The unload shoe assembly is extended into the internal drum and the pickup bars 326,350 engage the leading edge and trailing edge of the plate, respectively. The media plate is retracted from the drum and transported to the conveyor assembly 556. The conveyor assembly is configured to transport the media plate M either axially or radially to the axis of the internal drum to the next processing station. The unload shoe assembly then positions the media onto the conveyor assembly for transport to the next station.

The operations shown in FIG. 30 describe the sequential steps of automatically transporting and imaging a single media plate M. One should recognize, however, that multiple media plates are preferably transported to and from the internal drum 50 simultaneously. For example, media plates may be processed concurrently at each of the three modules 12,14,16. While an imaged media plate is being removed from the internal drum to the conveyor assembly 290, the next media plate may be loaded and docked onto the internal drum. Furthermore, while a media plate is being docked onto the drum, the paper removal assembly 26 may be removing the protective paper from a third media plate. This simultaneous operation of each of the assemblies increases the throughput of the imaging device 11.

Figure 31:
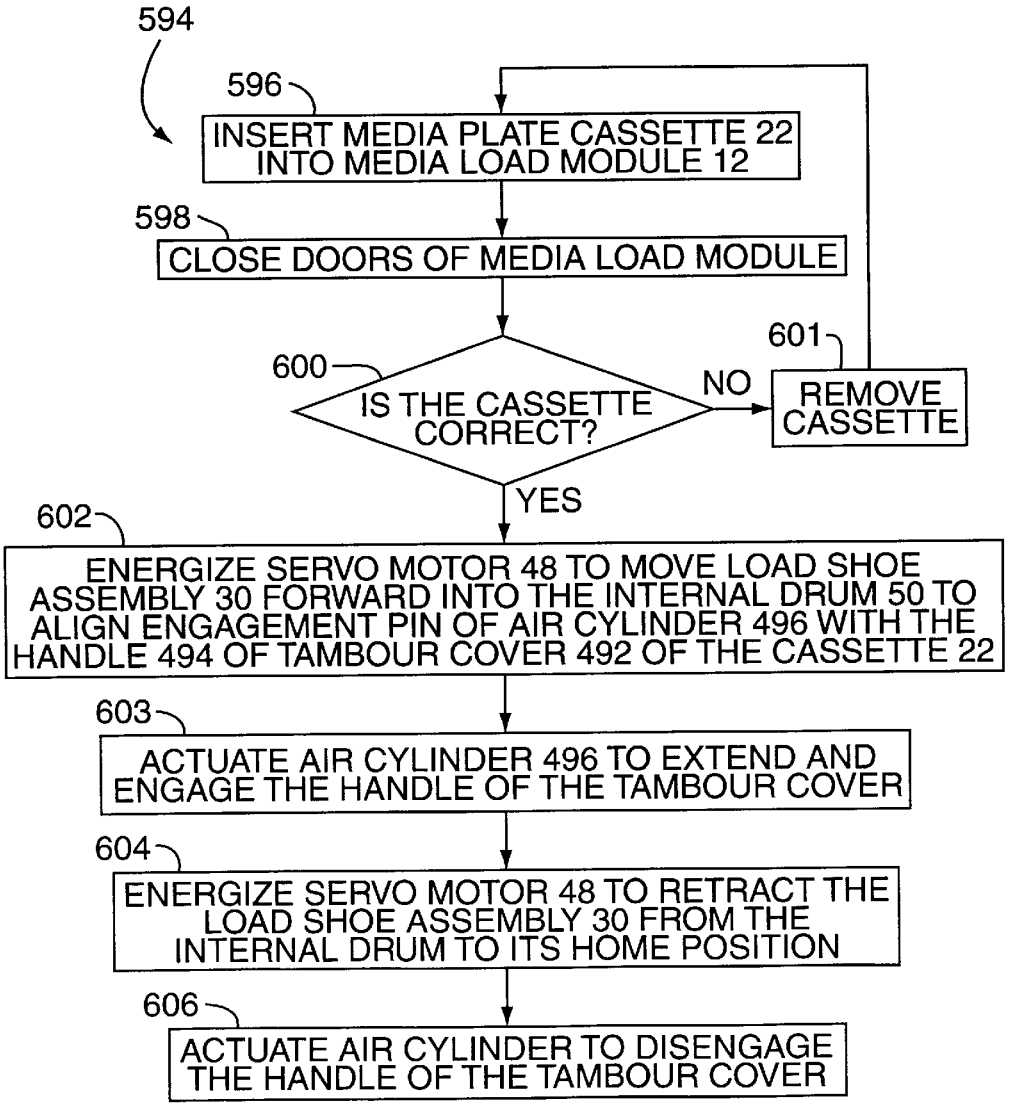
FIG. 31 is a functional diagram of a preferred sequence of operations of the loading of the media cassette into the media load module of FIG. 1.

FIG. 31 is a diagrammatic illustration of an algorithm 594 , shown in blocks 596–606, performed by the controller 21 for loading the media cassette 22 into the load module 12. The operator first slides the cassette into the load module with the tambour cover 492 disposed upward and secures the cassette in place. As the cassette is fully inserted into the load module 12, the tambour cover lock engages a support surface that urges the lock inward and releases the cover.

Once the doors of the load module 12 are closed, the controller senses the output signal of the cassette reader 520 to determine whether the cassette 22 inserted is correct. If the wrong cassette is inserted, the cassette is removed and a new cassette is inserted. If the correct cassette is inserted, the tambour cover of the cassette is opened. To open the cassette, the controller 21 provides a drive signal to the servo motor 48 of the load shoe assembly 30 to move it forward into the internal drum 50 so that the engagement pin of the tambour air cylinder 496 is aligned with the handle 494 of the cassette. The controller then provides a signal to the air cylinder 496 which extends the pin to engage the handle. The servo motor 48 is then energized to retract the load shoe assembly 30 away from the internal drum. As the load shoe assembly retracts, the tambour cover opens and drapes over the front edge of the cassette to uncover the media plates stacked therein. After the tambour cover is completely opened, the controller 21 removes the drive signal from the servo motor 48 and deactuates the air cylinders 179,181 to disengage the load shoe assembly from the cassette 22.

Figure 32A:
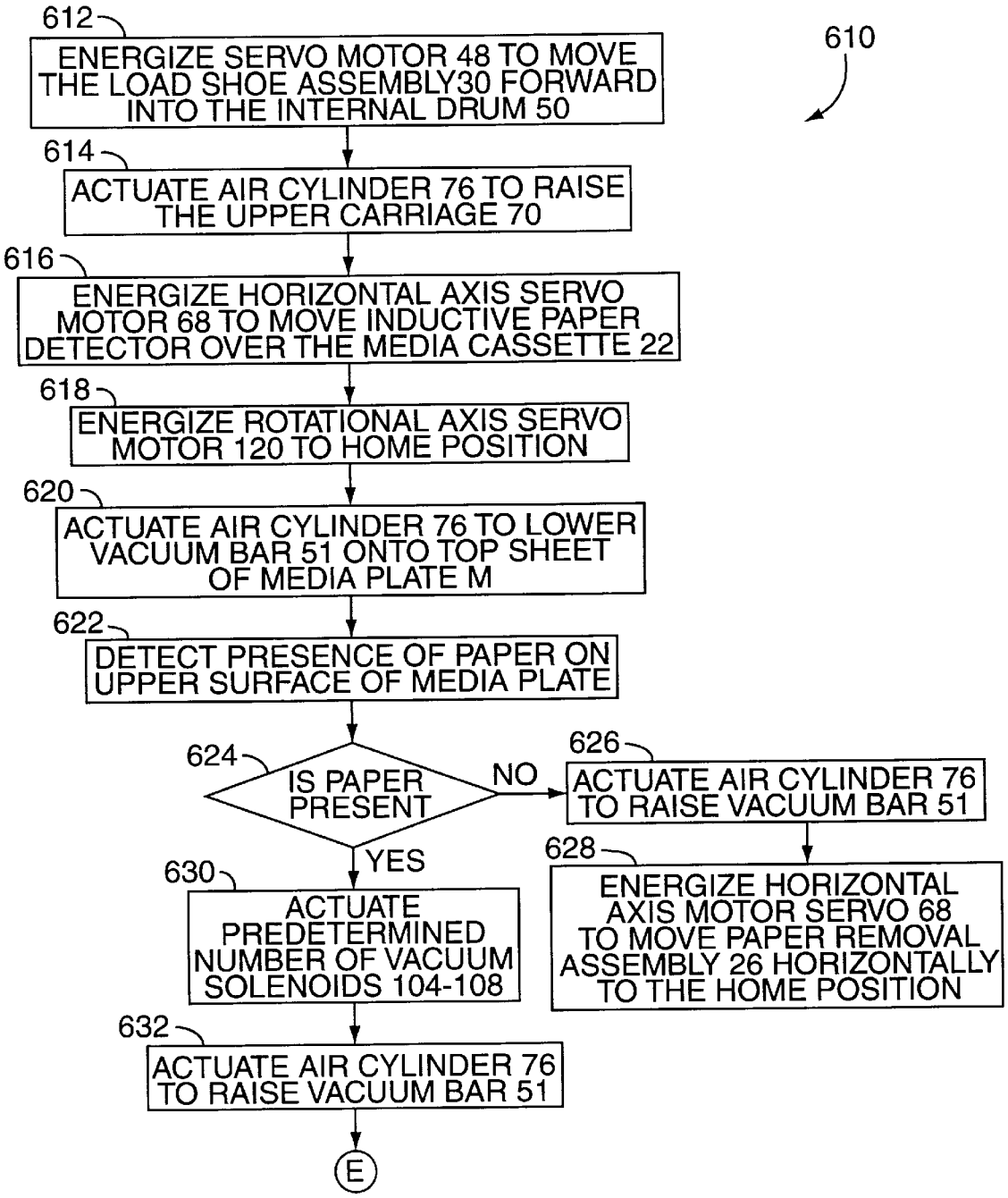
FIGS. 32*a* and 32*b* are functional diagrams of a preferred sequence of operations of the paper removal assembly of the media load module of FIG. 1 to load a media plate onto the internal drum of the imaging device.
Figure 32B:
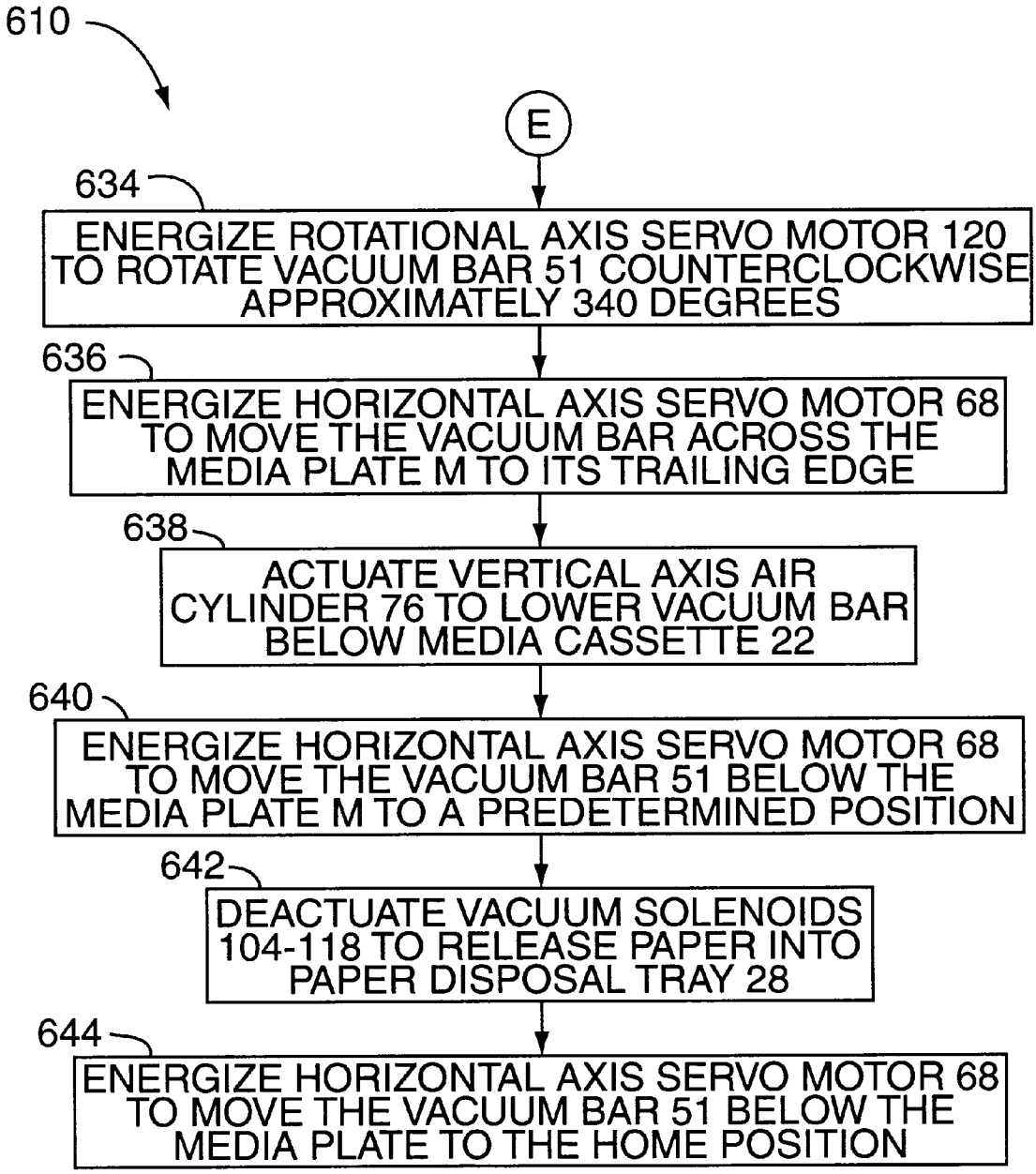

FIGS. 32(*a*)–(*b*) are diagrammatic illustrations of an algorithm 610, shown in blocks 612–644, performed by the controller 21 for automatically detecting the presence of a sheet of protective paper on the media plate M and removing the paper, if present. The controller first provides a drive signal to the servo motor 48 of the load shoe assembly 30 to move it forward into the internal drum 50 to either provide clearance for the paper removal assembly 26 or for docking a previous media plate secured to the load shoe 158. After the load shoe assembly has cleared the paper removal assembly, the controller 21 provides a signal to actuate the air cylinder 76 and raise the upper carriage 70. The horizontal axis servo motor 68 of the lower carriage 60 is then energized to move the vacuum bar 51 of the paper removal assembly over the leading edge of the top media plate M.

The controller 21 then provides a signal to energize the rotational axis servo motor 120 of the upper carriage 70 to rotate the vacuum bar 51 to the pickup position. The vertical axis air cylinder 76 is then deactuated to lower the vacuum bar onto the media plate so that the inductive paper sensor 140 contacts the plate. The controller senses the output signal provided by the paper sensor to determine whether the protective paper is present. If the signal has a value less than a predetermined value representative of the thickness of the paper, no paper is present and therefore, the controller provides a signal to actuate the air cylinder 76 to raise the vacuum bar 51. The horizontal axis servo motor 68 is then energized to return the lower carriage 60 to its home position.

Figure 32C:
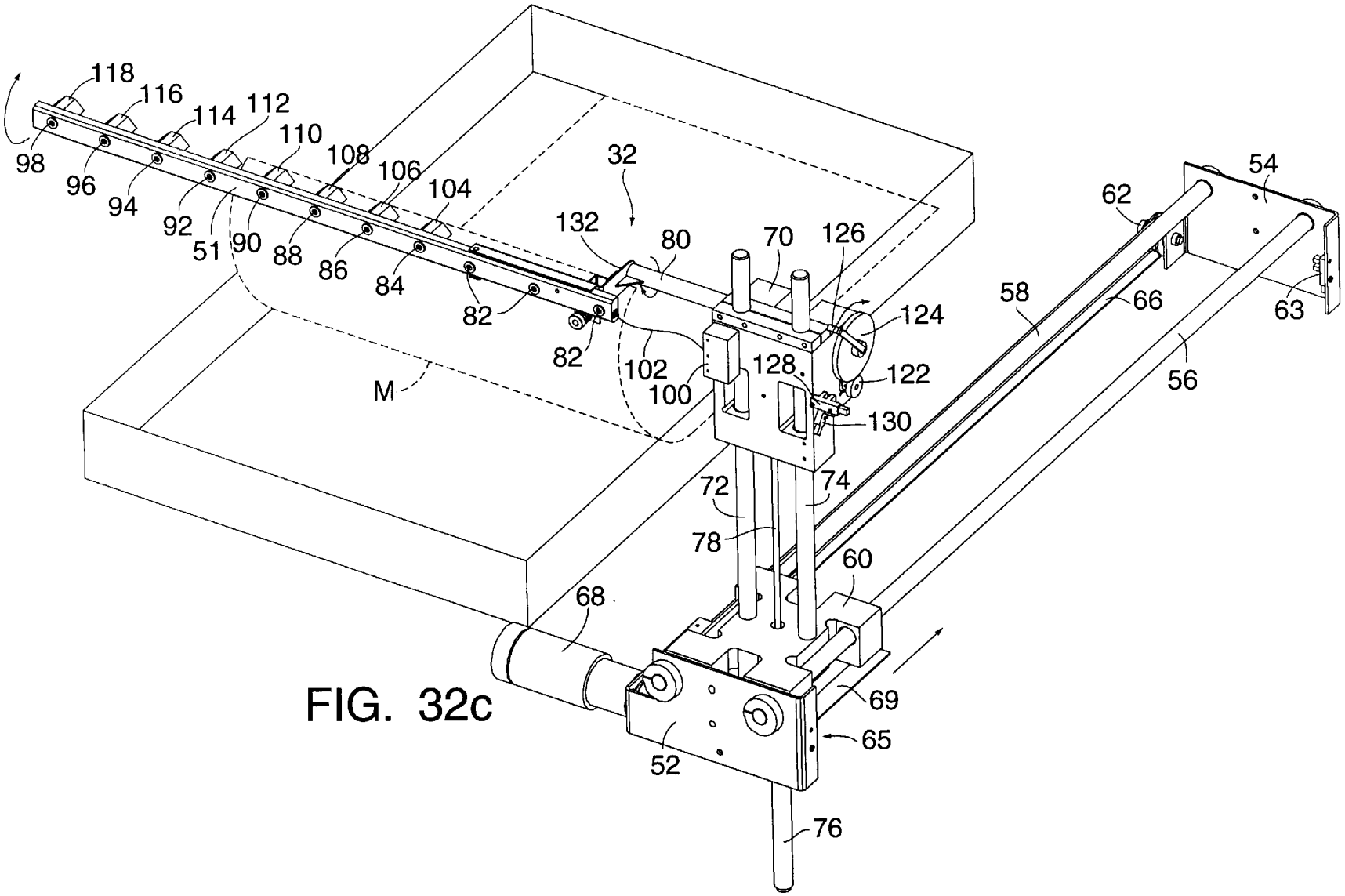
FIG. 32*c* is a schematic, perspective view of the top paper removal subassembly, illustrating the assembly removing a topmost interleaf from a stack of media plates.

If the signal from the inductive paper sensor 140 has a value greater than the predetermined value, paper is present and therefore, the controller 21 provides a signal to actuate a predetermined numbers of vacuum solenoids 104–118 on the vacuum bar 51 that correspond to the length of the media plate to engage the paper. The air solenoid is then actuated to raise the upper carriage 70. The paper is wrapped about the vacuum bar by energizing the rotational axis servo motor 120 to rotate the vacuum bar approximately 340 degrees counterclockwise as the lower carriage moves horizontally from the leading edge to the trailing edge of the media plate. Wrapping the paper around the vacuum bar also ensures proper removal of the paper without tearing or jamming, which tends to occur if the paper is not wrapped around the bar. The paper is peeled off the media plate as the lower carriage continues to travel to a position beyond the trailing edge of the cassette 22 at a predetermined rate, as indicated in FIG. 32*c*.

The air cylinder 76 is then deactuated to lower the upper carriage 70 below the media cassette 22. The horizontal axis servo motor 68 is energized to move the lower carriage back to the leading edge of the cassette, thus continuing to peel back the paper, as indicated by the arrows in FIG. 3. The lower carriage 60 is stopped at a predetermined position and the vacuum solenoids 104–118 are deactuated to thus release the paper into the paper disposal tray 28. The lower carriage is then returned to its home position at the leading edge of the cassette 22.

Figure 33A:
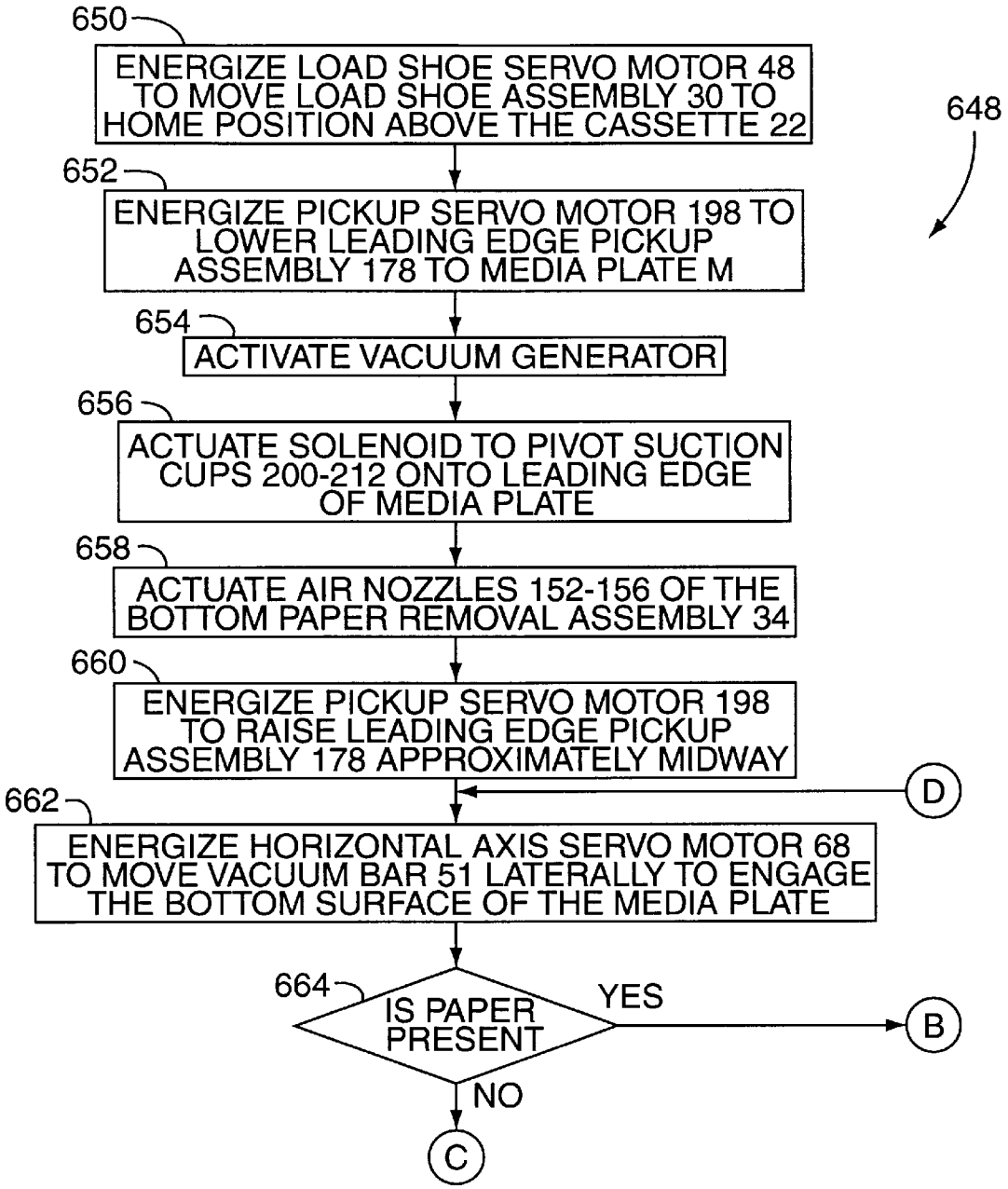
FIGS. 33*a*, 33*b* and 33*c* are functional diagrams of a preferred sequence of operations of the load shoe assembly of the media load module of FIG. 1 to load a media plate from the internal drum of the imaging device.
Figure 33B:
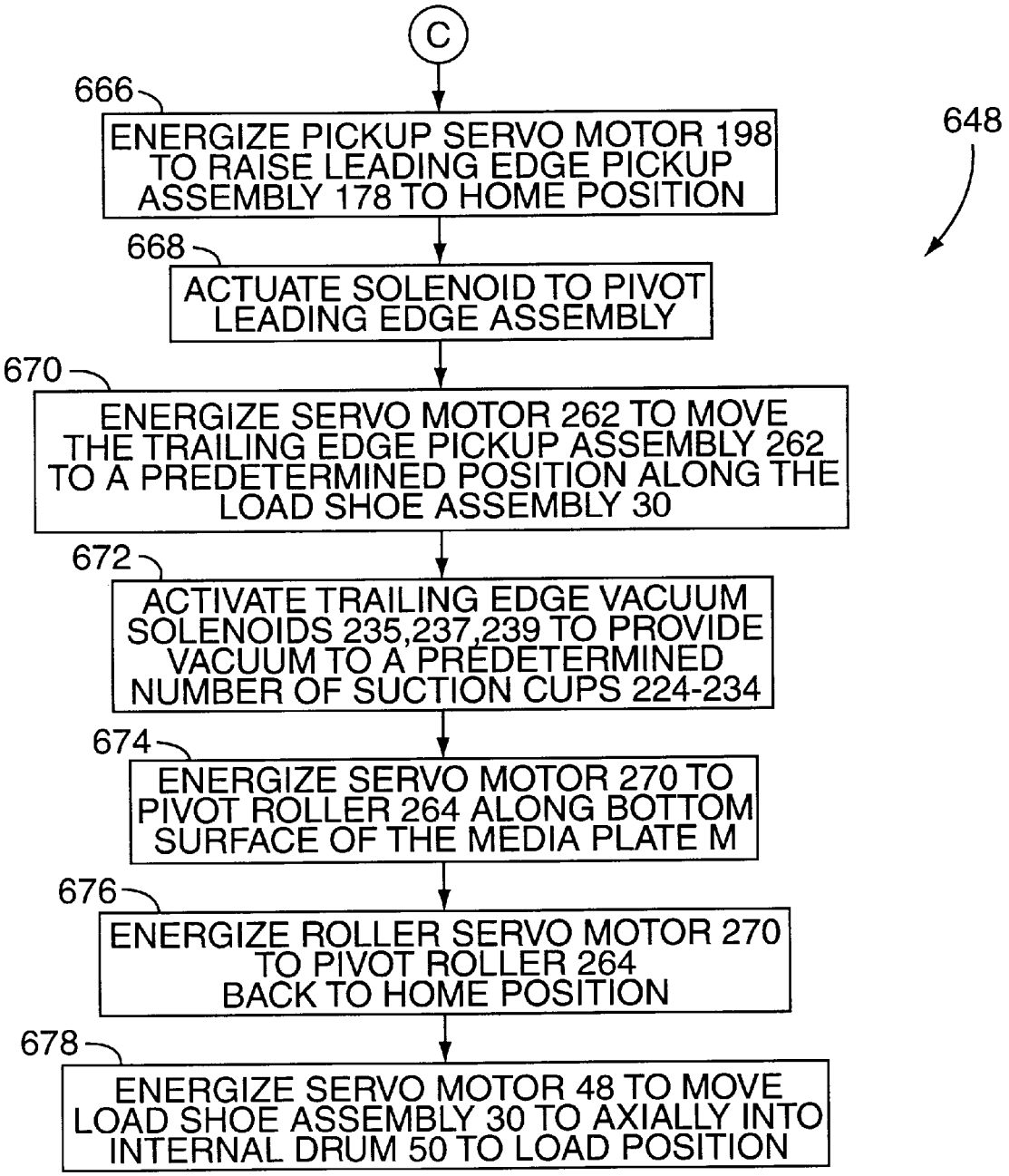
Figure 33C:
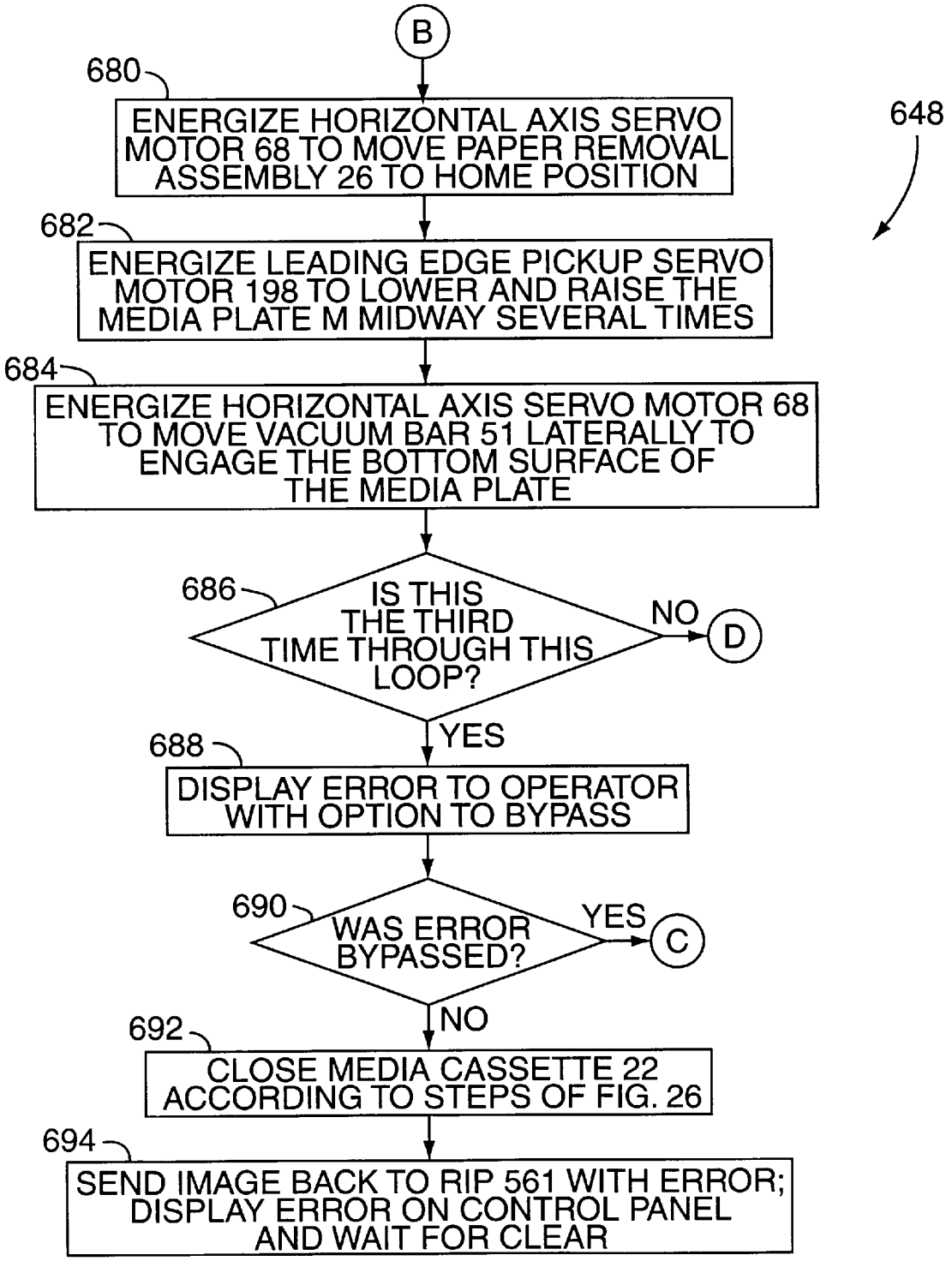

FIGS. 33(*a*)–(*c*) are diagrammatic illustrations of an algorithm 648, shown in blocks 650–694, performed by the controller 21 for transporting a media plate M from the cassette 22 to the internal drum 50 of the imaging device 14. The servo motor 48 of the load shoe assembly 30 is energized to move the assembly to a home position above the media plate disposed in the cassette. The leading edge pickup servo motor 198 is energized to extend the four-arm linkage and the leading edge pickup bar 184 to the leading edge of the media plate. The vacuum pressure is provided to the row of suction cups 200–212 disposed along the leading edge pickup bar 184. The leading edge air cylinders 179,181 are then actuated to pivot the suction cups to engage the leading edge of the media plate.

The air nozzles 152–156 of the bottom paper removal assembly 34 are then actuated to provide a continuous flow of air passing over the plates. The leading edge pickup servo motor 198 is then energized to lift the leading edge of the media M approximately midway between fully extended and fully retracted positions. As the leading edge of the media is lifted, the edge passes through the bristles of the brushes 144–150 of the bottom paper removal assembly 34. The brushes are adapted to separate the media plate and paper that may be stuck to the bottom surface of the plate. As the plate passes through the air flow provided by the nozzles, the paper is peeled away from the plate.

The paper removal assembly 26 then checks to determine whether paper is stuck to the bottom of the media plate M. Paper is detected by actuating the air cylinder 76 to raise the upper carriage 70. The rotational axis servo motor 120 is energized to position the conductive electrical contacts to contact the lower surface of the media plate as the lower carriage 60 is moved laterally to contact the media plate. The controller 21 senses the current flow between the two electrical contacts. Absence of current is indicative of paper disposed on the media plate and, no current is representative of the presence of paper.

If paper is present, the horizontal axis servo motor 68 of the lower carriage 60 is energized to retract the paper removal assembly 26 back to its home position. The servo motor 198 of the load shoe 158 is energized to raise and lower the leading edge of the media plate several times across the brushes 144–150 and air nozzles 152–156 in an attempt to remove the paper. The controller then repeats the operations shown in blocks 662 and 664. If the paper is still present after a predetermined number of attempts, the controller 21 displays an error to the operator with an option to bypass the error. If the error is bypassed, the controller continues to secure the media plate M to the load shoe assembly 30 and insert the assembly into the internal drum 50. If the operator does not bypass the error, the media cassette 22 is closed, the image is sent back to the RIP 561 and an error is displayed to the operator.

If paper is not detected on the bottom surface of the media plate M, the controller 21 continues to load the media plate onto the load shoe assembly 30. The leading edge pickup servo motor 198 is energized to raise the leading edge of the media plate to its home position. The controller provides a signal to actuate the leading edge air cylinders 236,238,240 to pivot the leading edge of the media to its retracted position. The trailing edge servo motor 262 of the trailing edge pickup assembly 180 is energized to position the trailing edge pickup bar 214 to a predetermined position about the shoe member 158 which corresponds to the width of the media. A predetermined number of vacuum solenoids 235,237,239 are then actuated to provide vacuum pressure to a predetermined number of suction cups 224–234 which correspond to the length of the media plate. The roller servo motor 270 is then energized to pivot the roller 264 along the bottom surface of the media plate. The action of the roller lifts the media to the engagement surfaces of the load shoe 158 and to the suction cups of the trailing edge pickup assembly 180. The roller servo motor is then energized to return the roller back to its initial position. The servo motor 48 for the load shoe assembly 30 is then energized to extend the assembly axially into the internal drum 50 to a docking position.

Figure 34A:
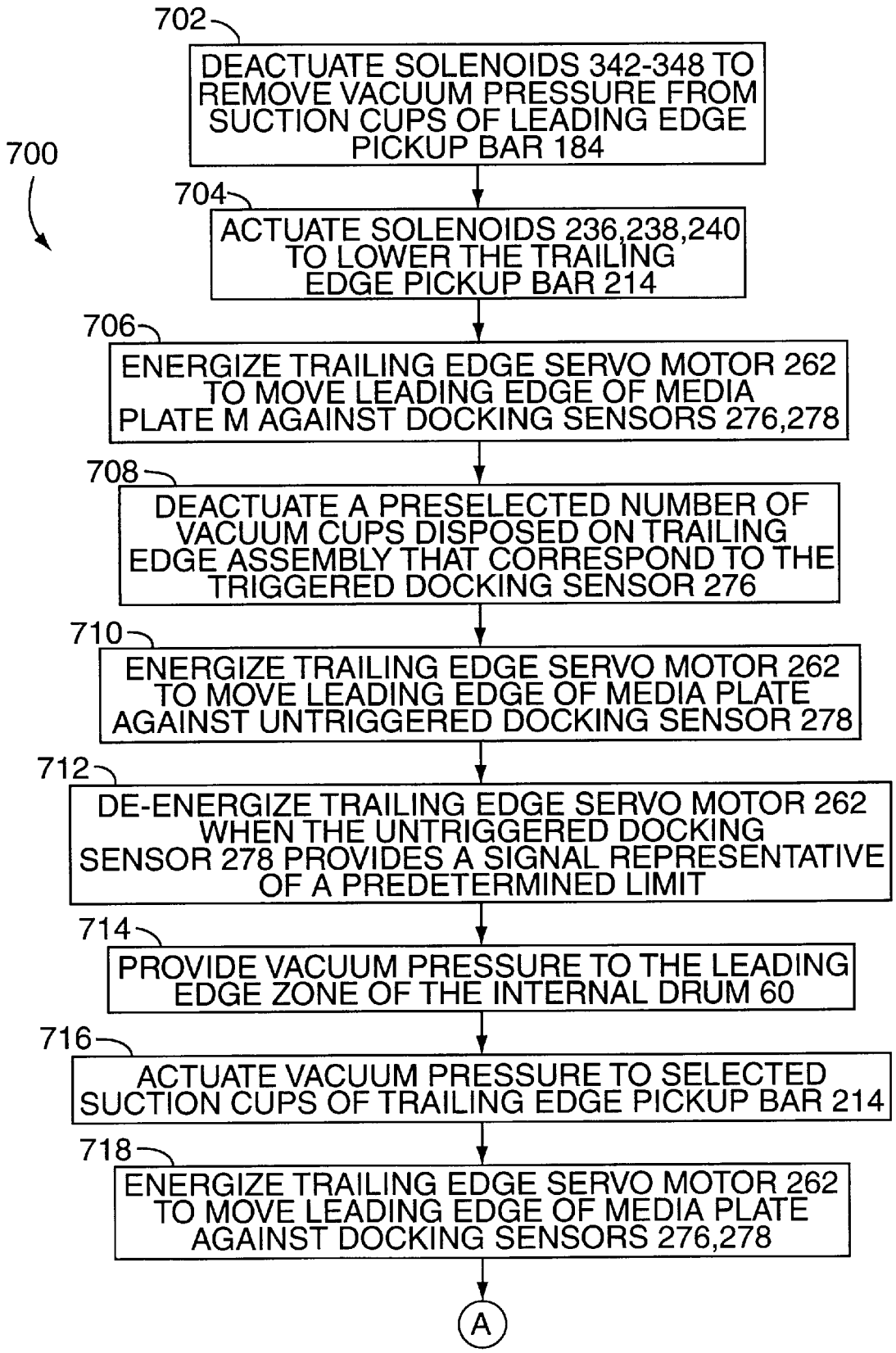
FIGS. 34*a* and 34*b* are functional diagrams of a preferred sequence of operations of the load shoe assembly of FIG. 1 to dock a media plate from the internal drum of the imaging device.
Figure 34B:
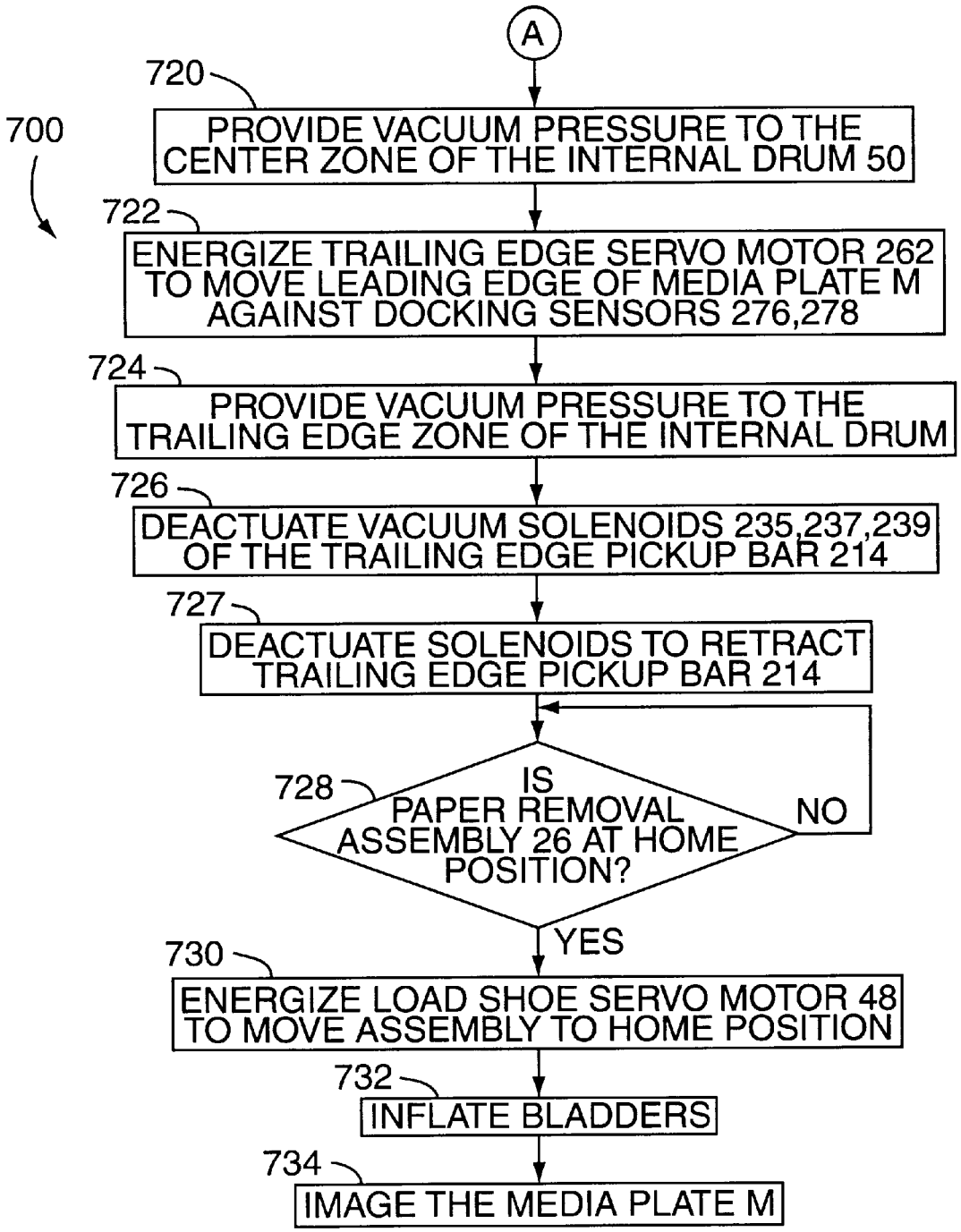

FIGS. 34(*a*)–(*c*) are diagrammatic illustrations of an algorithm 700, shown in blocks 702–734, performed by the controller 21, for docking the media plate M onto the internal drum 50 of the imaging device 14 after the load shoe assembly 30 is extended to the docking position. The leading edge of the media plate is first released onto the internal drum by deactuating the vacuum solenoids 342–348 disposed along the leading edge pickup bar. The trailing edge air cylinders 236,238,240 are actuated to extend radially or lower the trailing edge pickup bar to the drum surface. During positioning of the media plate on the internal drum, a slight vacuum is initially applied at the leading edge portion of the drum in order to remove any air or air pockets that may exist between the leading edge of the media sheet and the corresponding position of the internal drum. In some cases, the media plate can shift relative to the internal drum when a vacuum is subsequently applied to the entire media plate. Removing the air thus provides the advantage of more precisely positioning the media plate on the internal drum.

Figure 34C:
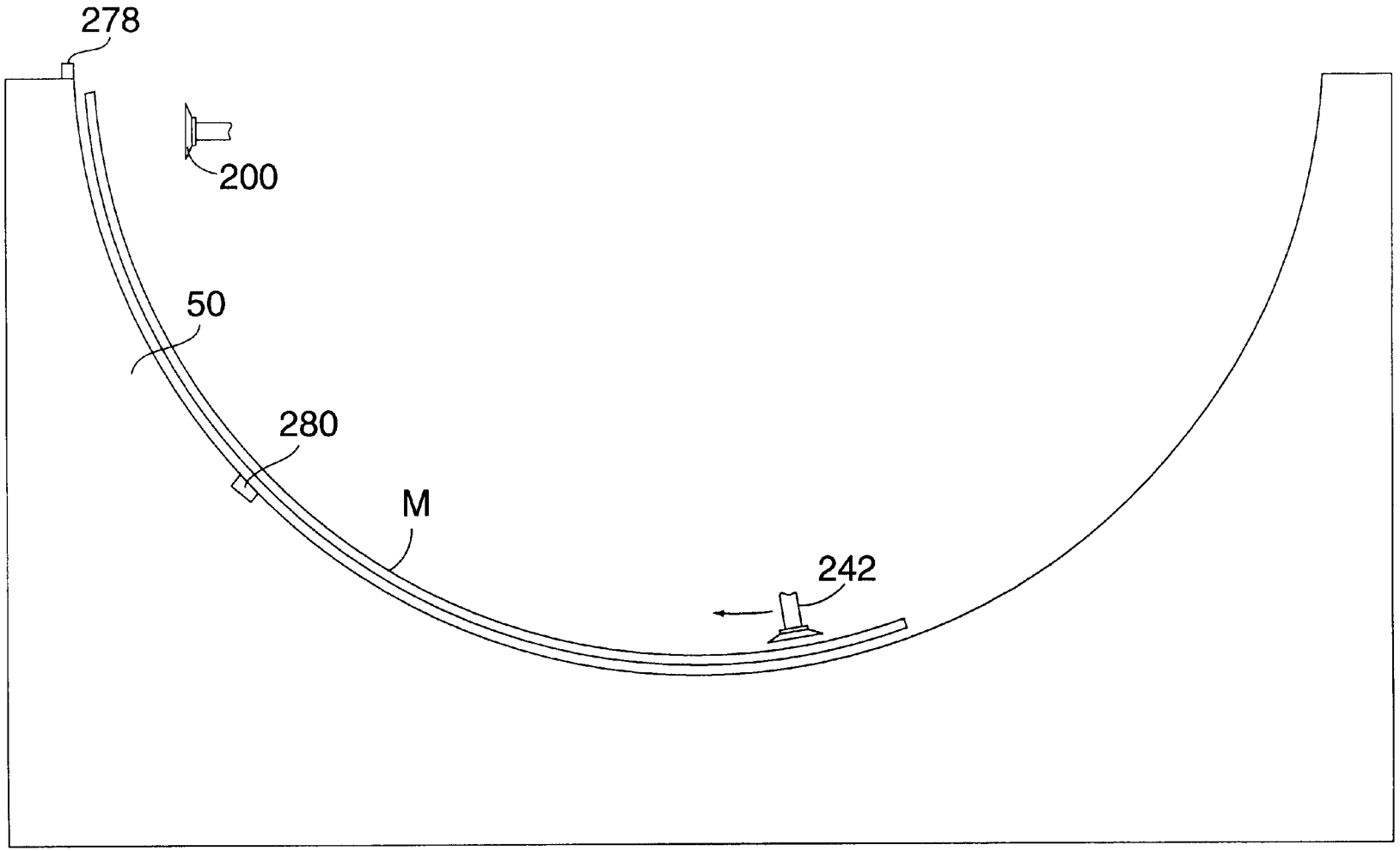
FIG. 34*c* is a schematic, end view of the load shoe of FIGS. 2, 3 and 8–10, illustrating a the movement of a trailing edge suction cup during loading of a media plate.

As also illustrated in FIG. 34*c*, the trailing edge servo motor 262 is then energized to move the media plate M laterally against the docking sensors 276,278 disposed at the leading edge of the drum 50. The controller 21 continues to move the media plate laterally until one of the docking sensors 276,278 is triggered, indicating that the point of contact between the plate and the triggered docking sensor 276 is properly positioned on the drum. The controller then deactuates a preselected number of vacuum solenoids 235, 237,239 to remove vacuum pressure from the suction cups disposed opposite from the triggered docking sensor 276. The servo motor 262 is again energized to move the media plate against the untriggered docking sensor 278 until it is triggered. The release of vacuum pressure from a number of suction cups permit the media plate to pivot or rotate about a triggered docking sensor 276 to be adjusted squarely on the drum surface.

This method of positioning the media plate M against the docking sensors 276, 278 includes the advantage of providing both lateral and rotational movement of the media plate on the drum surface using a single motor for lateral movement and selective actuation of the suction cups engaging the trailing edge of the media plate. The flexibility of the suction cups also permit the media plate to both engage the triggered sensor 276 and rotate as the trailing edge pickup bar 214 is moved laterally. This method eliminates the need to have independently controlled motors disposed at each end of the pickup bar and the associated motor control systems to rotate the media plate.

After the media plate M is properly positioned on the surface of the internal drum 50, vacuum pressure is then applied at the leading edge portion of the drum. The trailing edge servo motor 262 is then energized to move the media plate laterally towards the docking sensors 276, 278 a predetermined distance. Vacuum pressure is then applied to the central portion of the drum. The servo motor 262 is again moved a predetermined distance and vacuum pressure is applied to the trailing portion of the drum to secure the plate to the drum.

After the media plate M is secured to the drum 50, vacuum pressure to the suction cups disposed on the trailing edge pickup assembly 180 is removed and the air cylinders 236,238,240 are deactuated to retract the trailing edge pickup bar 214. In some cases, the trailing edge media plate may not completely rest on the surface of the internal drum when the vacuum is applied. Accordingly, the controller actuates the air cylinders 236, 238, 240 to re-extend the trailing edge pickup bar 214, which engages and urges the entire trailing edge against the surface of the internal drum. When the paper removal assembly 26 is clear of the load shoe assembly 30, the servo motor 48 of the load shoe assembly is energized to retract the assembly back away from the drum. The air bladders 49 are then inflated to level the internal drum and the media plate is imaged.

FIGS. 35(*a*)–(*c*) are diagrammatic illustrations of an algorithm 740, shown in blocks 742–778, performed by the controller 21, for unloading the media plate M from the internal drum 50 of the imaging device 14 after the media plate is imaged. While the media plate is being imaged, the controller 21 provides a signal to actuate air cylinders 332,359 to retract the leading edge and trailing edge pickup bars 326,350. The air cylinder 314 of the unload shoe assembly 288 is actuated to extend the assembly axially toward the internal drum. The servo motor 374 of the trailing edge pickup bar 350 is moved to a predetermined position to engage the trailing edge of the media plate.

Figure 35A:
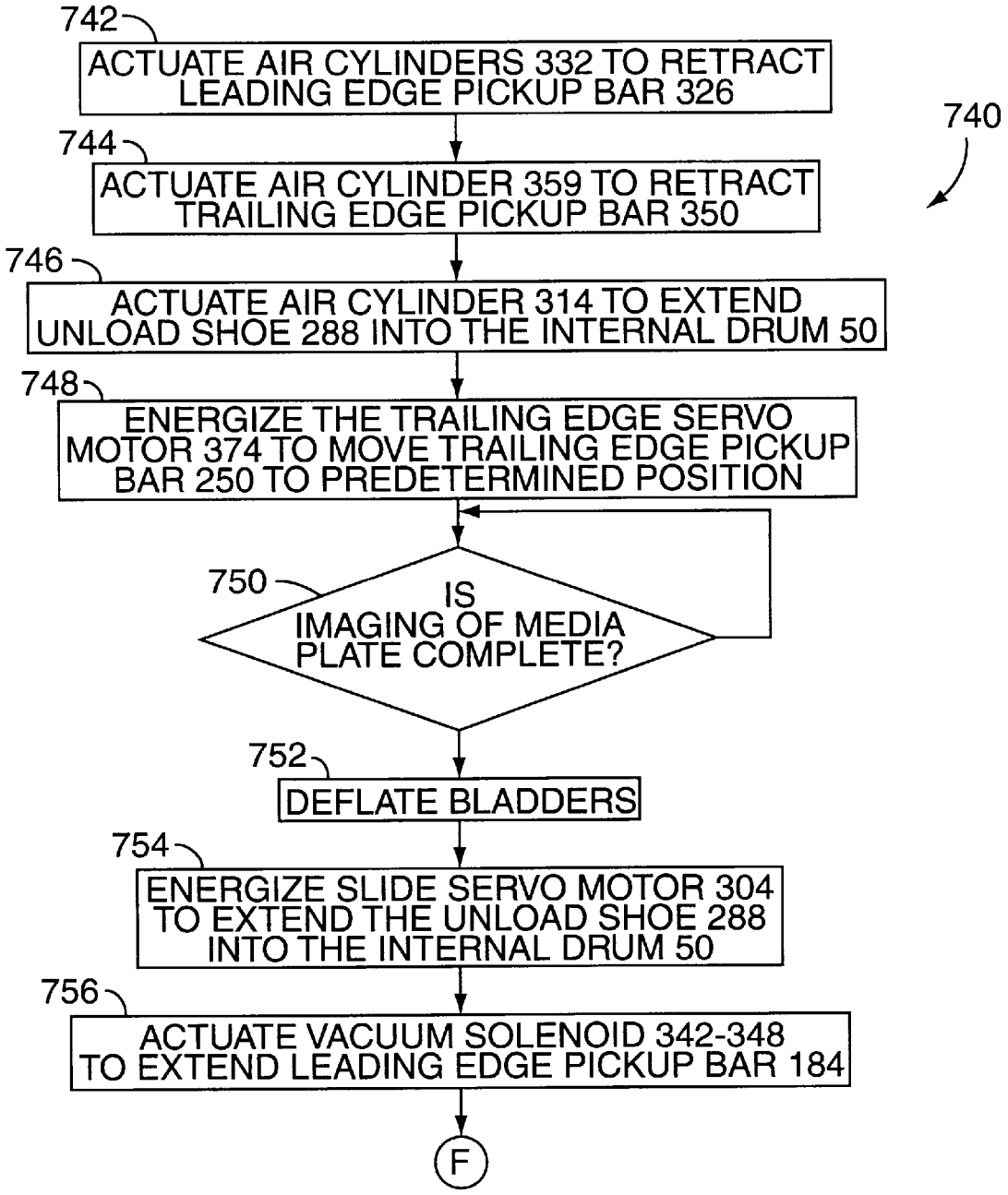
FIGS. 35*a*, 35*b* and 35*c* are functional diagrams of a preferred sequence of operations of the unload shoe assembly of the media unload module of FIG. 1 to unload a media plate from the internal drum of the imaging device.
Figure 35B:
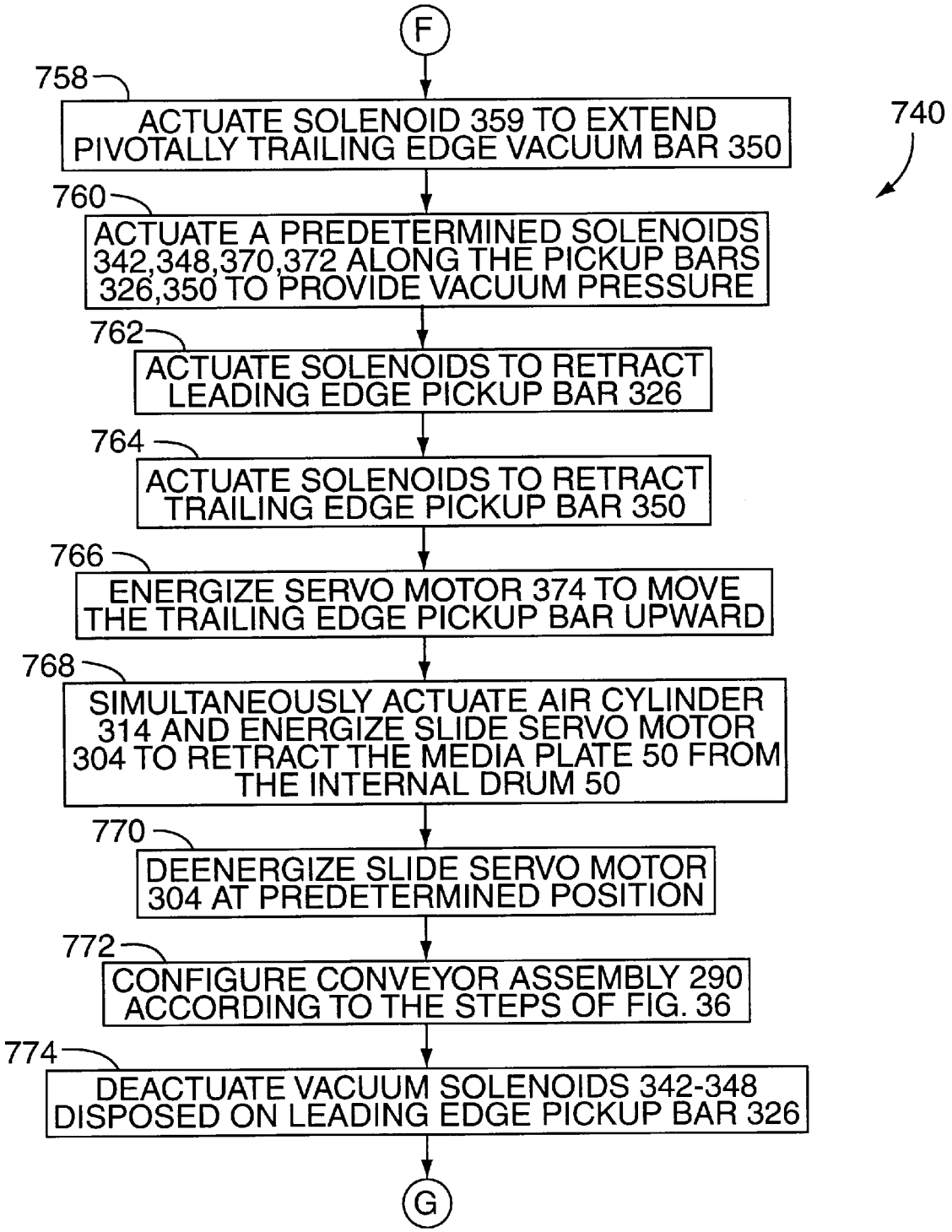
Figure 35C:
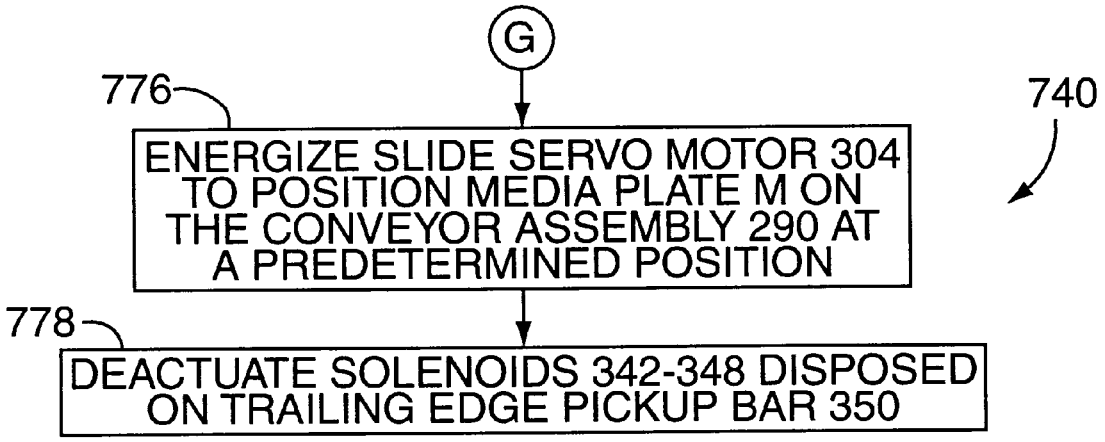
Figure 35D:
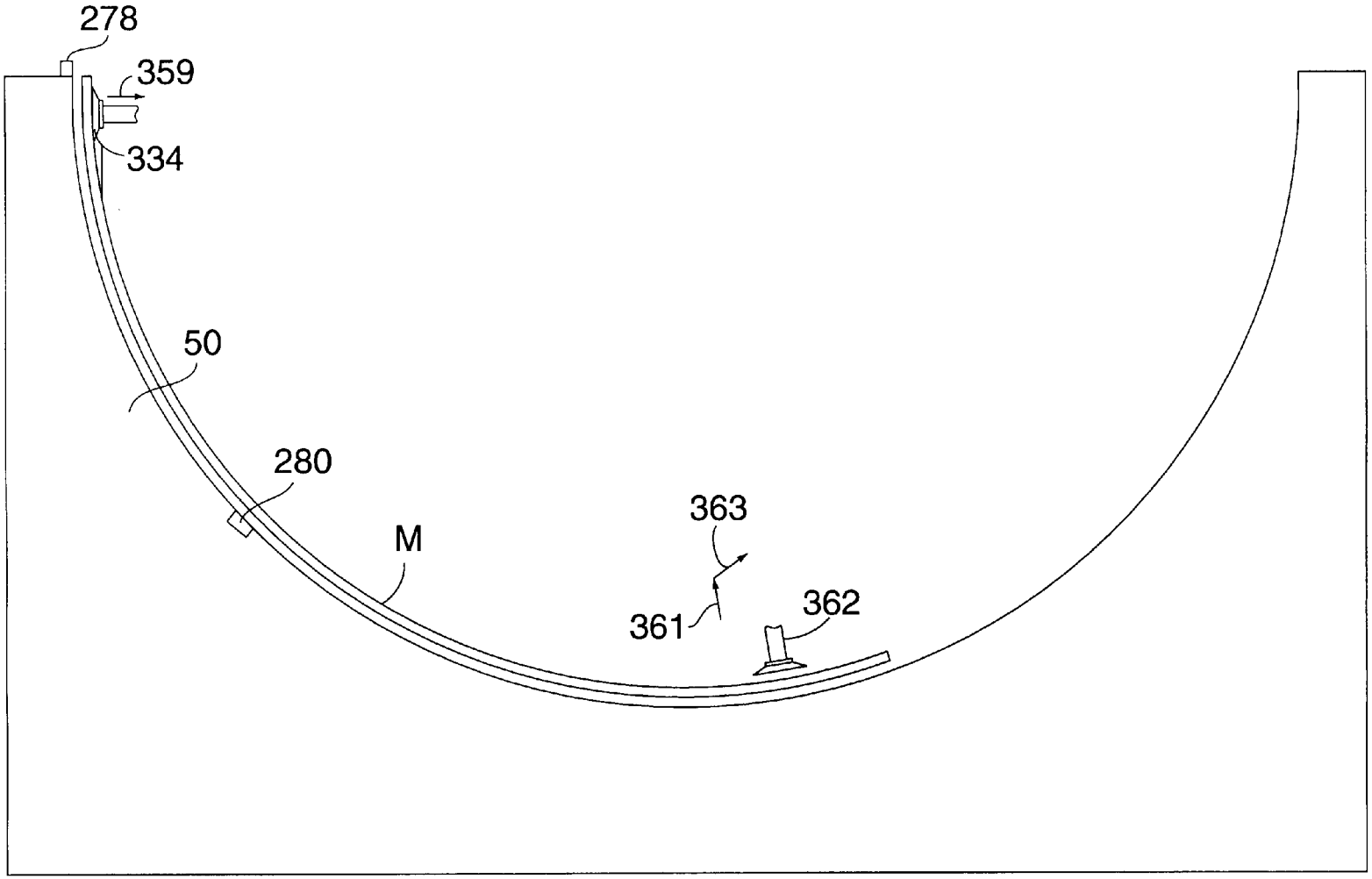
FIG. 35*d* is a schematic, end view of the unload shoe of FIGS. 13–15, illustrating a the movement of leading edge and trailing edges suction cups during unloading of a media plate from the internal drum of the imaging device.

When the imaging of the media plate M is complete, the air bladders 49 (FIG. 2) are deflated to lower the internal drum 50 onto a rigid support surface. The slide servo motor 304 is energized to extend the unload shoe 288 into the internal drum. The air cylinders 332,359 of the pickup bars 326,350 are actuated to extend and pivot, respectively, to engage the surface of the media plate, as shown in FIG. 35*d*. A predetermined number of vacuum solenoids 342,348,370, 372 are actuated to provide vacuum pressure to the suction cups contacting the media plate. Each of the pickup bars 326,350 are then retracted to lift the media off the internal drum, as indicated by the arrows 359, 361 of FIG. 35*d*. Since the retracting action reduces the effective diameter of a retained plate, the trailing edge assembly 324 is moved upward away from the docking sensors 276,278 to take up the media plate and secure the upper surface of the plate to the engagement surface of the unload shoe 288, as indicated by the arrow 363 adjacent to the cup 362 in FIG. 35*d*.

The controller 21 then simultaneously actuates the unload shoe air cylinder 314 and energizes the slide servo motor 304 to retract the unload shoe assembly 288 quickly from the internal drum 50. The media plate is moved to a predetermined position over the conveyor assembly 290. The conveyor assembly is configured according to the direction of transport of the plate to the next processing station, which will be described in greater detail hereinafter. The vacuum solenoids 342–348 of the leading edge suction cups are then deactuated to release the leading edge of the media onto the conveyor assembly. The trailing edge servo motor 374 is moved to adjust the leading edge of the media plate to a predetermined position to reduce or eliminate adjustment of the plate at the next processing station. The trailing edge of the media plate is dropped onto the conveyor assembly 290 by removing the vacuum pressure from the trailing edge pickup bar 350.

Figure 36:
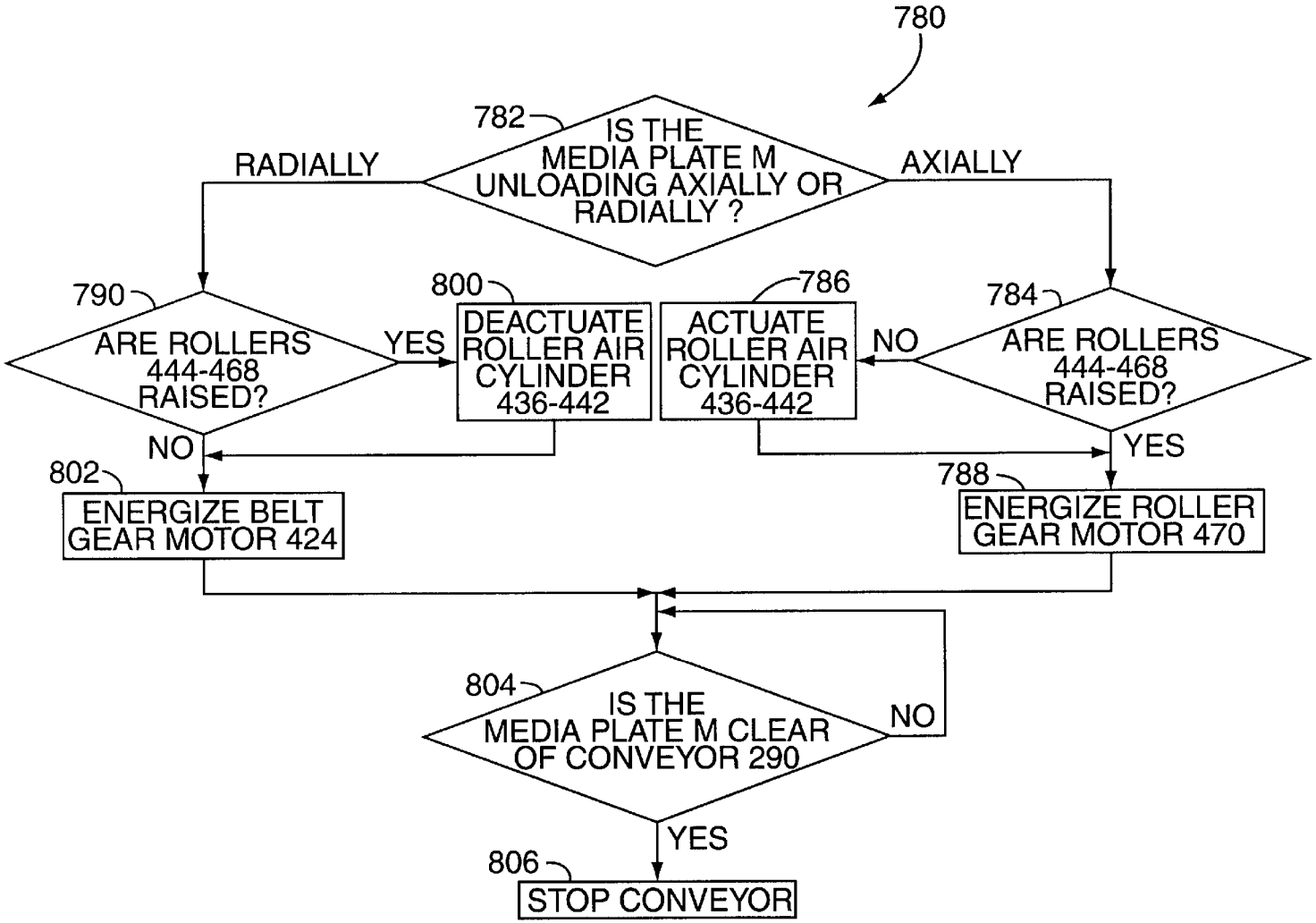
FIG. 36 is a functional diagram of a preferred sequence of operations of the conveyor assembly of the media unload module of FIG. 1 to transport a media plate to the next processing station.

FIG. 36 is a diagrammatic illustration of an algorithm 780, shown in blocks 782–806, performed by the controller 21, for configuring the conveyor assembly 290 to permit selective movement of the media plate M either radially or axially to the next processing station. If the media plate must be transported radially, the controller determines whether the rollers 444–468 are raised above the flat belts 400–422. If not, the rollers are lowered by deactuating the roller air cylinders 436–442. Once the rollers are in the lowered position, the belt gear motor 424 is energized to transport the media to the next processing station.

If the media plate M is being transported axially to the internal drum 50, the controller 21 again determines whether the rollers 444–468 are raised. If not, the rollers are raised by actuating the roller air cylinders. Once the rollers are in the raised position, the roller gear motor 470 is energized to transport the media plate to the next station.

While preferred embodiments have been shown and described, various modifications and substitutions may be made without departing from the spirit and scope of the invention. Accordingly, it is to be understood that the present invention has been described by way of example and not by limitation.

What is claimed is:

1. An apparatus for removing an interleaf from the top of a stack of media plates separated by interleaves as media plates are removed from the stack of plates, comprising:

an interleaf pickup member extending generally parallel to one edge of the stack for grasping and retaining a interleaf from the top of the stack of media plates;

means for rotating the interleaf pickup member generally about a longitudinal axis of the pickup member and between at least an interleaf engaging position and an interleaf wrapping position, the means for rotating supporting the interleaf pickup member;

means cooperating with the means for rotating the pickup member for moving the pickup member and the means for rotating in a first direction generally parallel to the top of the stack, the means for rotating rotating the pickup member between the interleaf engaging and wrapping positions as the means for moving the pickup member moves the member in the first direction in order to remove an uppermost interleaf from the stack of media plates.

2. The apparatus of claim 1, wherein an interleaf retained by the interleaf pickup is wrapped around the interleaf pickup as the pickup is rotated to enable separation of the interleaf from the media plate.

3. The apparatus of claim 1, further comprising:

means for moving the interleaf pickup in a second direction perpendicular to the first direction.

4. The apparatus of claim 1, wherein the interleaf pickup has a number of suction members for releasably retaining an interleaf.

5. The apparatus of claim 4, wherein the suction members are individually connected to a vacuum source and are actuatable independently of one another.

6. The apparatus of claim 1, further comprising:

means for detecting the presence of an interleaf on top of the stack of media plates.

7. The apparatus of claim 1, wherein the interleaf pickup member is mounted to the means for rotating so that the pickup member forms an angle relative to the edge of the stack, wherein one end of the pickup member engages the stack while the other end is vertically spaced from the stack.

8. The apparatus of claim 1, further comprising:

means for separating an adhered interleaf from the underside of the media plate being removed from the stack of media plates by the means for loading.

9. The apparatus of claim 8, further comprising:

means for detecting the presence of an interleaf adhered to the underside of a media plate being removed by the means for removing, the means for separating being actuated in response to the means for detecting.

10. The apparatus of claim 8, wherein the means for separating includes an air nozzle for directing an air jet along a common edge of the media plate and an interleaf, and a brush having a number of bristles overlying the common edge so that the common edge of a media plate and underlying interleaf moves across the brush as the media plate is removed to separate the interleaf from the media plate.

11. A method of removing paper from the media plate using a media transport device for an imaging device, the media transport device including paper removal assembly having a vacuum bar for engaging an interleaf sheet disposed on the surface of the media plate; the method comprising the steps of:

(a) securing the vacuum bar to paper disposed on a media plate;

(b) raising the vacuum bar;

(c) rotating the vacuum bar a predetermined number of degrees;

(d) moving the vacuum bar across the media plate beyond an edge of the media plate;

(e) lowering vacuum bar below the media plate;

(f) moving the vacuum bar below the media plate to a predetermined position;

(g) releasing paper from the vacuum bar; and (h) moving the vacuum bar below the media plate to an initial position.

12. A method, as set forth in claim 11, further comprising, prior to step (a), the steps of:

(a) moving the load shoe assembly forward into the internal drum;

(b) raising the upper carriage;

(c) moving an interleaf sensor over the media cassette;

(d) lowering the vacuum bar onto top sheet of a media plate; and (e) detecting presence of paper on upper surface of a media plate.

* * * * *